US006941604B2

(12) United States Patent
Ackeret

(10) Patent No.: US 6,941,604 B2
(45) **Date of Patent: *Sep. 13, 2005**

(54) MULTIPURPOSE HAND-HELD IMPLEMENT OF THE POCKET-KNIFE TYPE

(75) Inventor: Peter Ackeret, Kusnacht (CH)

(73) Assignee: CTech AG, Chur (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/652,268

(22) Filed: Aug. 28, 2003

(65) Prior Publication Data

US 2004/0034937 A1 Feb. 26, 2004

Related U.S. Application Data

(60) Continuation of application No. 09/905,429, filed on Jul. 13, 2001, now Pat. No. 6,874,189, which is a division of application No. 09/011,246, filed as application No. PCT/EP96/03338 on Jul. 29, 1996, now Pat. No. 6,286,745.

(30) Foreign Application Priority Data

Jul. 29, 1995 (DE) ..... 195 27 859

(51) Int. Cl.[7] ..... B26B 11/00
(52) U.S. Cl. ..... 7/160; 81/440
(58) Field of Search ..... 7/118, 127, 128, 7/158, 160; 81/440

(56) References Cited

U.S. PATENT DOCUMENTS

| | | | |
|---|---|---|---|
| 400,987 | A | 4/1889 | Wilzin |
| 492,084 | A | 2/1893 | Brigham |
| 533,219 | A | 1/1895 | Hardy |
| 551,052 | A | 12/1895 | Shonnard et al. |
| 563,305 | A | 7/1896 | Paffrath |
| 616,689 | A | 12/1898 | Ruettgers |
| 662,005 | A | 11/1900 | Lewis |
| 689,513 | A | 12/1901 | Papendell |
| 698,080 | A | 4/1902 | Treas |
| 749,230 | A | 1/1904 | Severance |
| 790,432 | A | 5/1905 | Heilrath |
| 857,459 | A | 6/1907 | Hendrickson |
| 1,234,345 | A | 7/1917 | Keeran |
| 1,412,373 | A | 4/1922 | Shields |
| 1,431,835 | A | 10/1922 | Neft |
| 1,451,607 | A | 4/1923 | Bates |
| 1,603,914 | A | 10/1926 | Hermann |
| 1,647,405 | A | 11/1927 | Giesen |

(Continued)

FOREIGN PATENT DOCUMENTS

| | | |
|---|---|---|
| DE | 819 542 | 11/1951 |
| DE | P.A. 190350-3458 | 6/1958 |

(Continued)

OTHER PUBLICATIONS

Brochure, "Wenger. The Genuine Swiss Army Knife", 27 pages, date unknown.

(Continued)

*Primary Examiner*—James G. Smith
(74) *Attorney, Agent, or Firm*—Brinks Hofer Gilson & Lione

(57) ABSTRACT

A multipurpose hand-held implement, comprising at least two components which can be locked in a closed position and then form a compact, essentially closed body, in the case of which the two components, with preferably confluent contours, are directed towards one another. In the closed position, the body forms the handle for actuating utensils, such as a knife, staple remover or cutter, which are accommodated in the components in a set-back manner, such that they can be pushed out. The two components are preferably connected to one another in an articulated manner and, after release of the locking means, can be moved relative to one another in order to actuate, for example, a stapler, a hole puncher or a pair of scissors. Further utensils, for example a magnifying glass, a pointer or a laser pointer may be accommodated in the components.

22 Claims, 38 Drawing Sheets

U.S. PATENT DOCUMENTS

Figure 1:
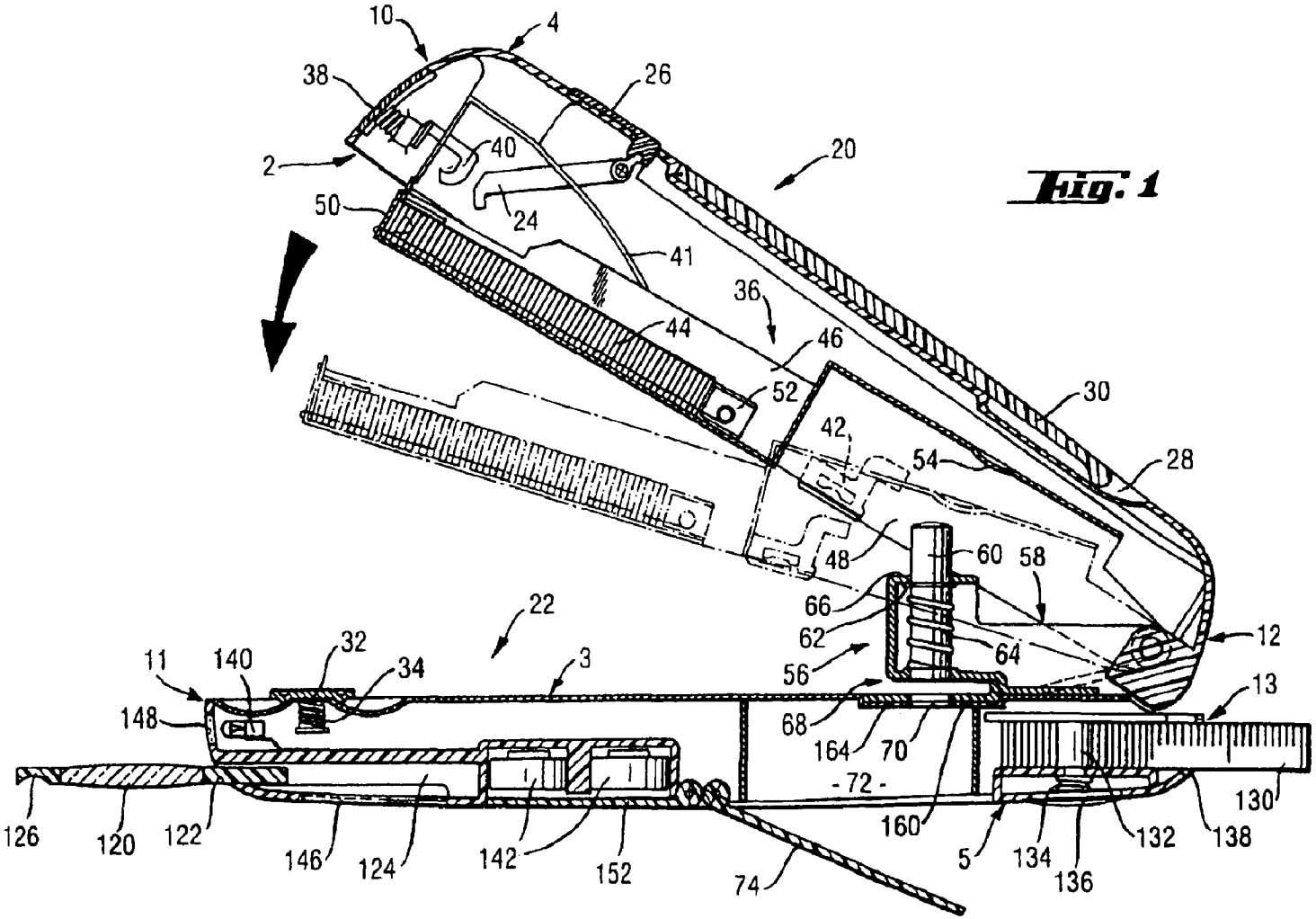

| | | | |
|---|---|---|---|
| 1,965,291 | A | 7/1934 | Kowald |
| 2,199,430 | A | 5/1940 | Greve |
| 2,250,290 | A | 7/1941 | Berg |
| 2,264,322 | A | 12/1941 | Maynard |
| 2,316,246 | A | 4/1943 | Hyatt |
| 2,416,277 | A | 2/1947 | Siegel |
| 2,486,500 | A | 11/1949 | Shocket |
| 2,601,999 | A | 7/1952 | Sly |
| 2,726,393 | A | 12/1955 | Vogel |
| 2,808,646 | A | 10/1957 | Lohr, Jr. et al. |
| 3,315,295 | A | 4/1967 | Jeter, Jr. et al. |
| 3,640,443 | A | 2/1972 | Itagaki |
| 3,907,190 | A | 9/1975 | Mitsuhashi |
| 3,951,325 | A | 4/1976 | Mitsuhashi |
| 4,002,281 | A | 1/1977 | Hsu |
| 4,040,556 | A | 8/1977 | Dahle |
| 4,114,793 | A | 9/1978 | Hsu |
| 4,240,572 | A | 12/1980 | Mitsuhashi |
| 4,243,168 | A | 1/1981 | Balma |
| D259,596 | S | 6/1981 | Gray |
| 4,288,018 | A | 9/1981 | Taniguchi |
| D262,585 | S | 1/1982 | Anema |
| 4,491,261 | A | 1/1985 | Mitsuhashi |
| 4,640,451 | A | 2/1987 | Steiner et al. |
| 4,719,700 | A | 1/1988 | Taylor, Jr. |
| 4,727,610 | A | 3/1988 | Lin |
| 4,729,170 | A | 3/1988 | Hartmeister |
| 4,779,785 | A | 10/1988 | Amagaya |
| 4,783,867 | A | 11/1988 | Tsao |
| 4,794,692 | A | 1/1989 | Wang |
| 4,811,486 | A | 3/1989 | Cunningham |
| D302,102 | S | 7/1989 | Amagaya |
| D308,462 | S | 6/1990 | Komatsu |
| D316,932 | S | 5/1991 | Escher, Jr. |
| D318,070 | S | 7/1991 | Amagaya |
| 5,027,994 | A | 7/1991 | Lee |
| D321,637 | S | 11/1991 | Chan |
| 5,114,257 | A | 5/1992 | Hsu |
| 5,184,765 | A | 2/1993 | Orozco |
| D336,415 | S | 6/1993 | Cheng |
| 5,331,741 | A | 7/1994 | Taylor, Jr. |
| 5,584,124 | A | 12/1996 | Marthaler et al. |
| 5,626,275 | A | 5/1997 | Chen |
| D380,900 | S | 7/1997 | Pearson et al. |
| 5,655,697 | A | 8/1997 | Yeh |
| D402,313 | S | 12/1998 | Tzeng |
| D407,432 | S | 3/1999 | Tell |
| 5,896,665 | A | 4/1999 | Harris |
| D409,385 | S | 5/1999 | Pearson et al. |
| 5,911,761 | A | 6/1999 | Tilley |
| D414,935 | S | 10/1999 | Bould |
| D415,201 | S | 10/1999 | Leins |
| 5,960,498 | A | 10/1999 | Nabors et al. |
| 5,979,734 | A | 11/1999 | Chang |
| 6,009,582 | A | 1/2000 | Harrison et al. |
| 6,038,723 | A | 3/2000 | Nabors et al. |
| D425,125 | S | 5/2000 | Leins |
| D427,764 | S | 7/2000 | Conway |
| 6,105,189 | A | 8/2000 | Nabors et al. |
| D430,393 | S | 9/2000 | Conway |
| D434,073 | S | 11/2000 | Leins |
| D434,796 | S | 12/2000 | Coleman |
| D436,130 | S | 1/2001 | Leins |
| D437,615 | S | 2/2001 | Leins |
| D441,020 | S | 4/2001 | Leins |
| 6,233,769 | B1 | 5/2001 | Seber et al. |
| D448,410 | S | 9/2001 | Leins |
| 6,286,745 | B1 | 9/2001 | Ackeret |
| D451,674 | S | 12/2001 | Leins |
| D460,339 | S | 7/2002 | Lin |
| D463,494 | S | 9/2002 | Mori |
| D464,679 | S | 10/2002 | Leins |
| 6,460,433 | B1 | 10/2002 | Ackeret et al. |
| 6,493,893 | B1 | 12/2002 | Ackeret |
| D472,931 | S | 4/2003 | Leins |
| D474,507 | S | 5/2003 | Leins |
| 6,708,360 | B2 | 3/2004 | Ackeret |
| D493,837 | S | 8/2004 | Leins |
| 2001/0037528 | A1 | 11/2001 | Ackeret |
| 2004/0034937 | A1 | 2/2004 | Ackeret |

FOREIGN PATENT DOCUMENTS

| | | | |
|---|---|---|---|
| DE | 26 25 749 | A1 | 12/1977 |
| DE | 31 39 995 | A1 | 4/1983 |
| DE | 35 38 596 | | 5/1987 |
| DE | 40 21 645 | A1 | 2/1991 |
| DE | 41 10 688 | A1 | 9/1991 |
| DE | 93 01 374.4 | | 5/1993 |
| DE | 195 27 859 | A1 | 1/1997 |
| DE | 197 45 799 | A1 | 7/1998 |
| EP | 0 306 678 | A2 | 3/1989 |
| EP | 0 783 938 | A2 | 7/1997 |
| GB | 19 327 | | 9/1896 |
| GB | 10 067 | | 4/1897 |
| GB | 140 515 | | 12/1918 |
| GB | 2 186 227 | A | 8/1987 |
| GB | 2196896 | A | 4/1988 |
| JP | 41-22884 | | 11/1941 |
| JP | 53-71379 | | 6/1978 |
| JP | 53-71380 | | 6/1978 |
| JP | 2-19484 | | 2/1990 |
| JP | 08-112781 | A | 5/1996 |
| WO | WO 84/01739 | | 5/1984 |
| WO | WO 86/01449 | | 3/1986 |
| WO | WO 94/17963 | | 8/1994 |
| WO | WO 95/1113 | | 4/1995 |
| WO | WO 97/04924 | | 7/1996 |
| WO | WO 98/32570 | | 7/1998 |
| WO | WO 02/00067 | | 1/2002 |
| WO | WO 02/00397 | | 1/2002 |
| WO | WO 03/069091 | | 8/2003 |
| WO | WO 03/074235 | | 9/2003 |

OTHER PUBLICATIONS

Borchure, "Wenger. The Genuine Swiss Army Knife™", 8 pages, date unknown.

Six photographs showing top, bottom, left–side, right–side, front and rear views of "MoMA PLUS" device, date unknown.

WIPO International Designs Bulletin Issue No. 01/1997 (DM/038962), published Mar. 27, 1997.

WIPO International Designs Bulletin Issue No. 07/1998 (DM/044810), published Oct. 30, 1998.

PCT International Search Report for PCT/EP96/03338.

26
24
20
90
80 ; 102
85
104
106
56
3
22
100
83
106
102
80

Fig. 16
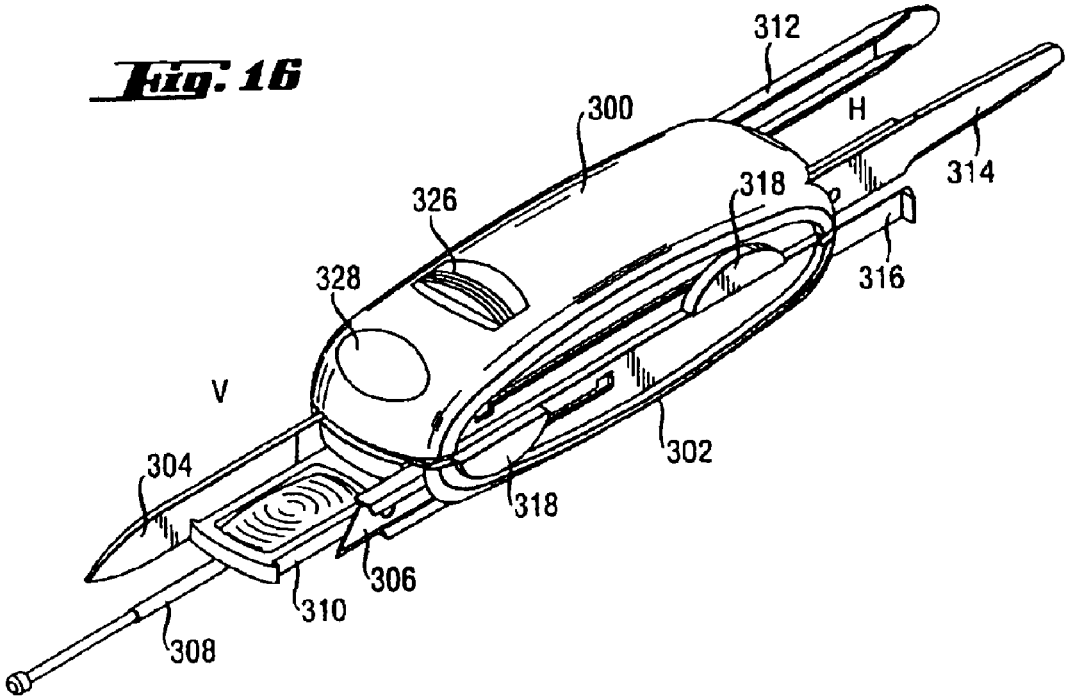
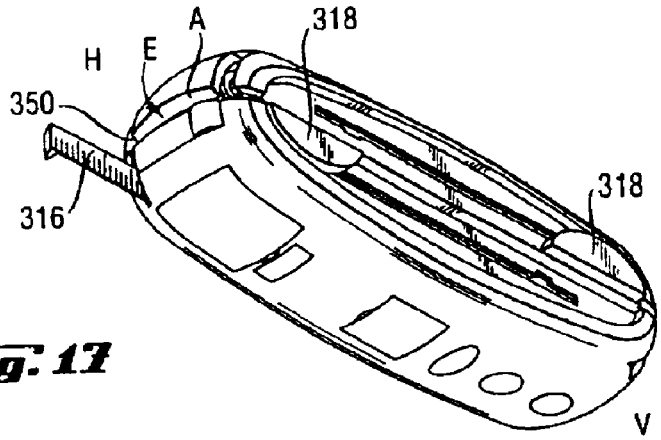
Fig. 17

328
376
408
364
366
326
406
372
387
463
386
384
420
422
380
378
402
404
426
412
414
362
436
410
416
400
-418-
322
344
398
392
396
389
390
388
394

Fig. 34
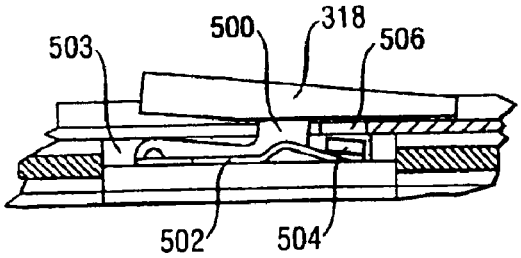
Fig. 35
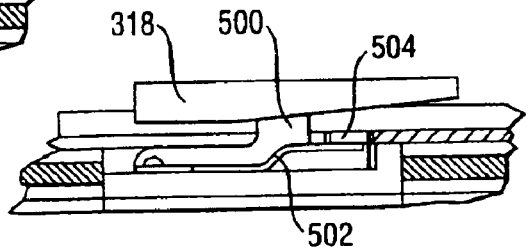
Fig. 36
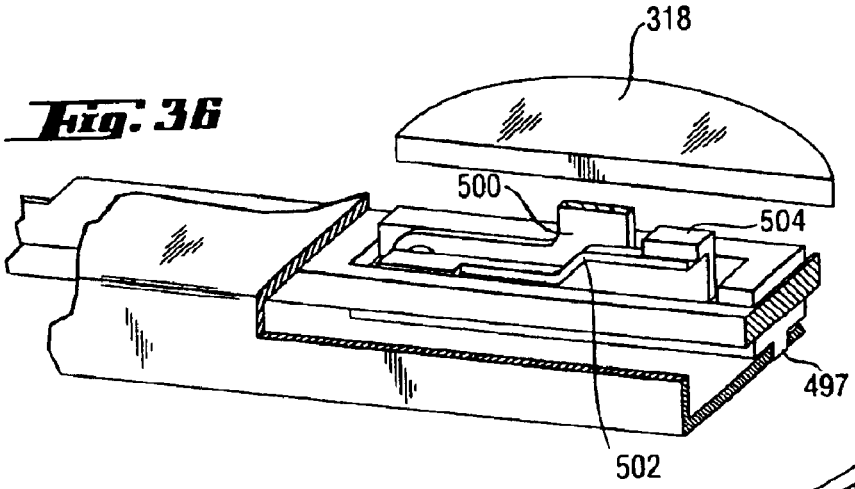
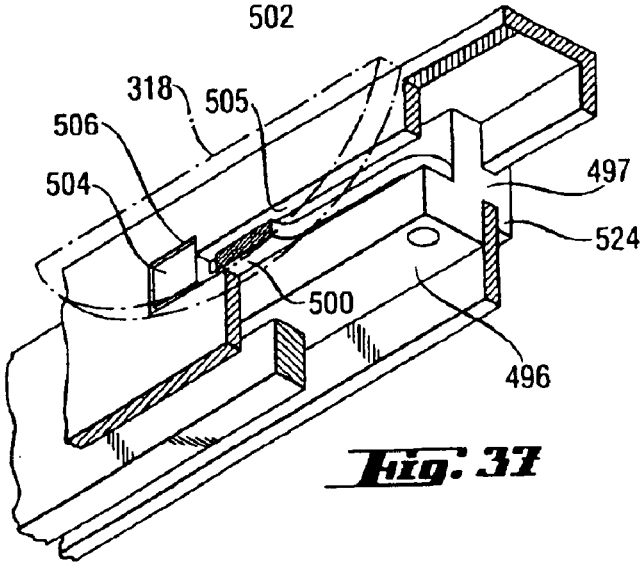
Fig. 37

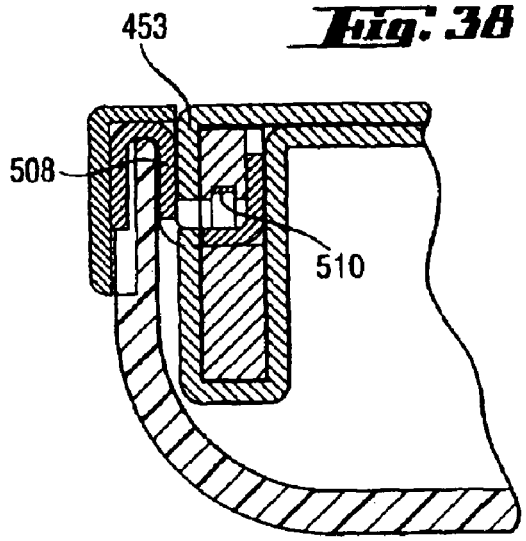
Fig. 38
Fig. 39
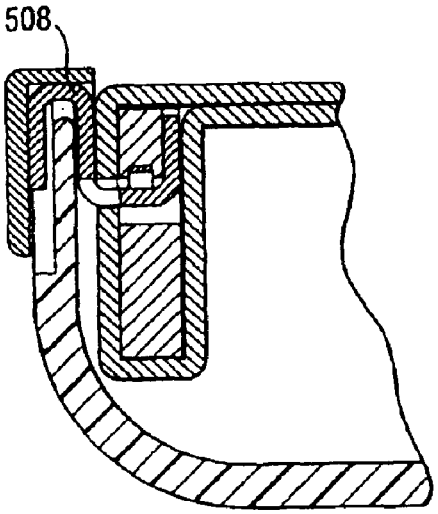
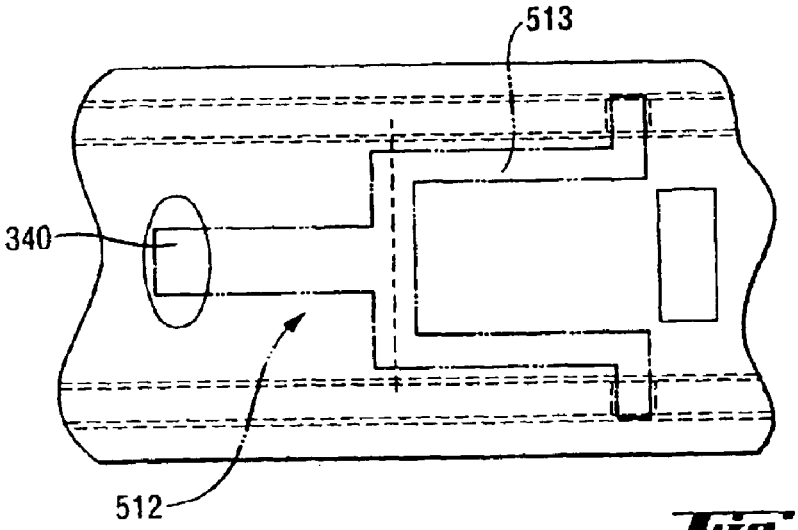
Fig. 40

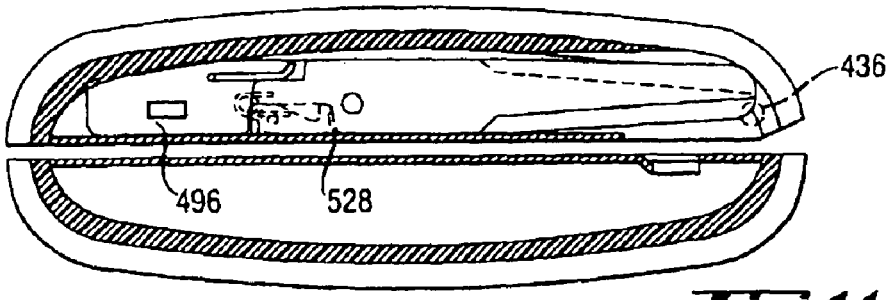
Fig. 41
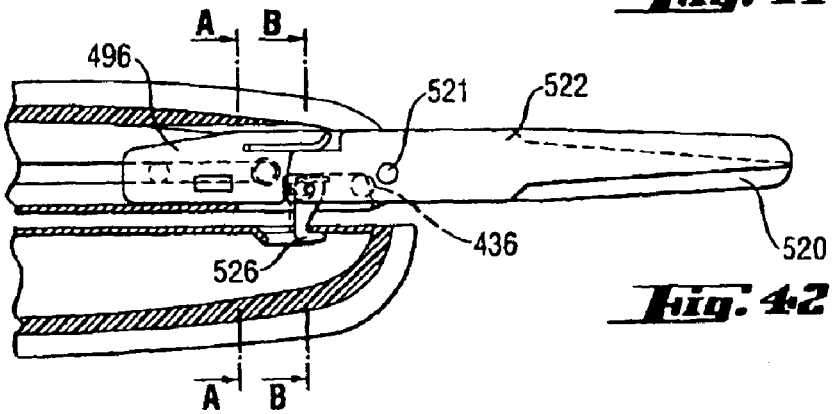
Fig. 42
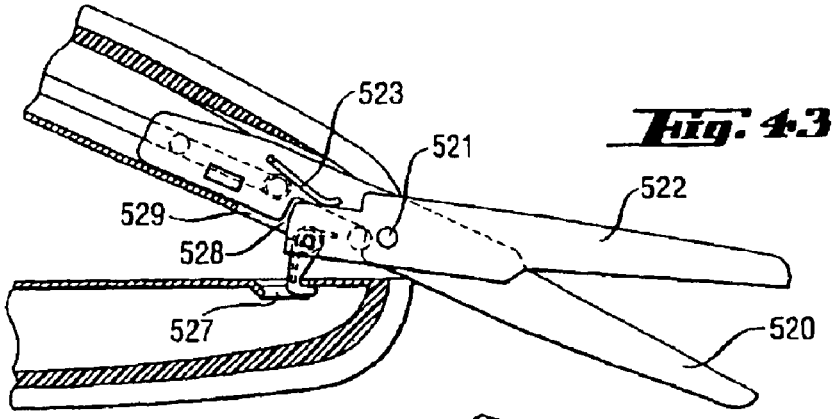
Fig. 43
Fig. 44
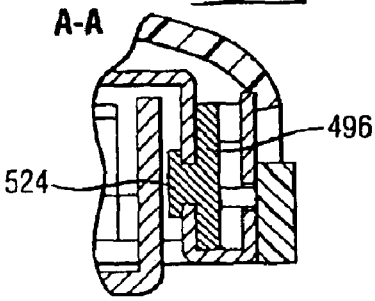
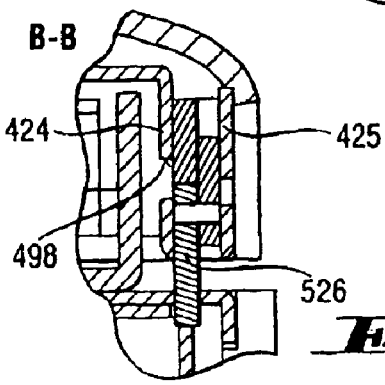
Fig. 45

Fig. 66
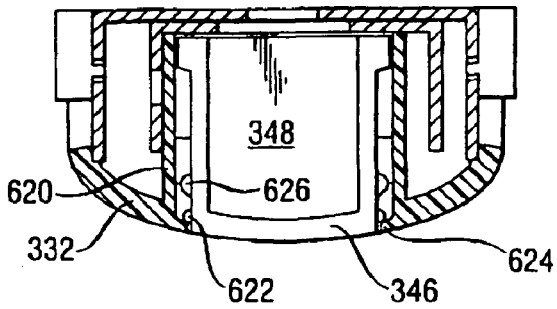
Fig. 67
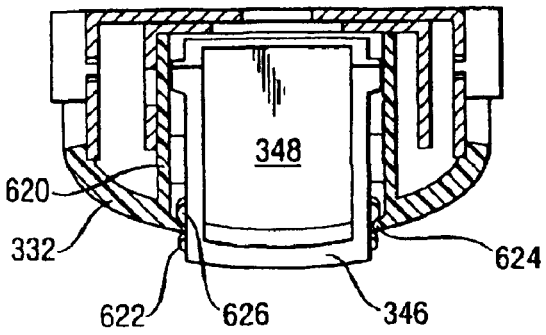
Fig. 68
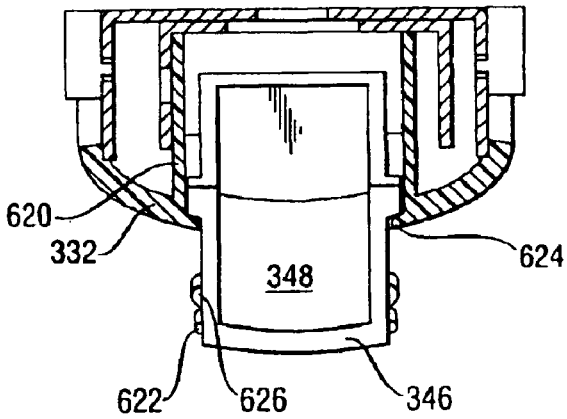
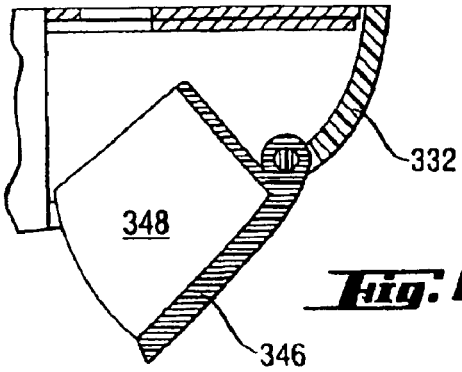
Fig. 69

MULTIPURPOSE HAND-HELD IMPLEMENT OF THE POCKET-KNIFE TYPE

CROSS-REFERENCE TO RELATED APPLICATIONS

This application is a continuation of application Ser. No. 09/905,429, filed Jul. 13, 2001 now U.S. Pat. No. 6,874,189, which is a division of application Ser. No. 09/011,246, filed Dec. 7, 1998 (now U.S. Pat. No. 6,286,745), which claims the benefit of international application PCT/EP96/03338, filed Jul. 29, 1996, which was published in the German language as Application No. WO/97/04924 on Feb. 13, 1997. The '429 and '246 applications are hereby incorporated by reference herein.

The invention relates to a multipurpose hand-held implement of the pocket-knife type. "Of the pocket-knife type" means here that the implement is to be small, compact and suitable for carrying in a pocket and that, when not in use, there are no exposed points or sharp edges which could result in injury.

Pocket knives are often provided with a large number of tools: not just with large or small knife blades, but also with files, screwdrivers, saws, etc. The tools are usually articulated on a body and, by over-coming spring prestressing, are swung out into their use position. In some cases, it is also possible for small tools to be removed in their entirety from the body.

Some types of tools can only be accommodated on or in a pocket knife if compromises are made as regards the functional capacity. For example, there are pocket knives with swing-out scissors which, however, are then of too flimsy a design for most purposes and are also too small for a large number of applications.

The object of the invention is to provide a multipurpose hand-held implement of the pocket-knife type which makes it possible to accommodate tools which, up until now, have been extremely difficult to produce, if at all, in pocket-knife form. The term "tool" here is to be understood in the broadest sense and is intended to cover all conceivable implements or utensils which are used as auxiliary means for work and leisure purposes.

So, for example, for carrying out office and presentation work, use is made of a large number of different implements, devices and hand tools, such as stapling implements, hole punchers, scissors, magnifying glasses, letter openers, adhesive-tape dispensers and so on. Each tool or utensil is usually just provided for a single function. This does not pose any particular problem in an office, where the necessary space is available.

However, these utensils are often used in locations other than an established working area, for example in production areas or warehouses, when travelling on aeroplanes or trains, or in a hotel, but also, for example, in meetings, lectures or in schools, colleges and libraries. The user is then forced to carry along a vast array of utensils which are bulky and heavy, could cause injury and take up a lot of space, for example, in baggage.

It would therefore be desirable to render such a piece of office equipment transportable in a compact form.

A first aspect of the present invention provides a multipurpose hand-held implement, in particular for office work, having a first component and a second component which are connected movably to one another and can be moved between a first position, in which they form together an elongate, essentially cuboidal body, and a second position, in which access can be gained to a free space between the two components, means being provided for securing the components in the first position in a manually releasable manner. In contrast to conventional pocket tools with only one carrier body out of which one or more functional parts can be swung or drawn out, two such components are provided here, which also makes it possible to accommodate functional parts in which two part-tools are to be moved relative to one another, that is to say, for example, a hole puncher or a stapler.

A second aspect of the invention provides a handheld implement of the pocket-knife type, comprising a first component, which contains at least one tool or tool part, and a second component, which contains at least one tool or tool part, it being possible, for actuating at least one tool, for the two components to be moved in a guided manner relative to one another and to be brought into a closed position, in which the two components, with essentially congruent contours, form a compact, essentially closed body, means being provided for securing the components in the closed position in a manually releasable manner. A compact body is achieved in the locked state; in the unlocked state, it is possible to actuate one or more tools which are difficult to provide, if at all, on a conventional pocket knife.

Characteristic functions for which one tool part is to be accommodated in one of the components or shells and the other associated tool part is to be accommodated in the other component or shell includes hole punching, stapling and cutting with a pair of scissors. The parts required for these functions have a bearing on further aspects of the invention:

A third aspect of the invention provides a combined implement having a hole puncher and a stapler, comprising a first component with functional elements of the hole puncher and of the stapler, and a second component which contains the other functional elements of the hole puncher and of the stapler and can be moved, relative to the first component, out of an open position, in which the two components are spaced apart by a distance sufficient for the insertion of paper which is to be stapled or punched, counter to the prestressing of a spring into a closed position, in which the two components, with essentially congruent contours, form a compact, essentially closed body, and means being provided for securing the components in the closed position in a manually releasable manner.

A further aspect of the invention relates to a combined implement having a hole puncher and a pair of scissors, which comprises: a first component with functional elements of the hole puncher, and a second component which contains the other functional elements of the hole puncher and can be moved, relative to the first component, out of an open position, in which the two components are spaced apart by a distance sufficient for the introduction of paper which is to be punched, counter to the prestressing of a spring into a closed position, in which the two components form, with essentially congruent contours, a compact, essentially closed body, means being provided for securing the components in the closed position in a manually releasable manner, and the scissors being accommodated in one of the components and being displaceable out of this position into a functional position, in which they can be actuated by means of relative movement of the two components.

In a comparable manner, the invention also relates to a combined implement having a stapler and a pair of scissors, comprising a first component with functional elements of the stapler, and a second component which contains the other functional elements of the stapler and can be moved, relative to the first component, out of an open position, in which the two components are spaced apart by a distance sufficient f or the introduction of paper which is to be stapled, counter to the prestressing of a spring into a closed position, in which the two components, with essentially congruent contours, form a compact, essentially closed body, means being provided for securing the components in the closed position in a manually releasable manner, and the scissors being accommodated in one of the components and being displaceable out of this position into a functional position, in which they can be actuated by means of relative movement of the two components.

Yet another aspect of the invention relates to a combined implement having a stapler and a tool, comprising a first component with functional elements of the stapler, and a second component which contains the other functional elements of the stapler and can be moved, relative to the first component, out of an open position, in which the two components are spaced apart by a distance sufficient for the introduction of paper which is to be stapled, counter to the prestressing of a spring into a closed position, in which the two components, with essentially congruent contours, form a compact, essentially closed body, means being provided for securing the components in the closed position in a manually releasable manner, and the tool being accommodated in on of the components and being displaceable out of this component into a functional position, in which the body, in its closed position, forms the handle for manipulating the tool.

A further aspect of the invention relates to a combined implement having a hole puncher and a tool, comprising a first component with functional elements of the hole puncher, and a second component which contains the other functional elements of the hole puncher and can be moved, relative to the first component, out of an open position, in which the two components are spaced apart by a distance sufficient for the introduction of paper which is to be punched, counter to the prestressing of a spring into a closed position, in which the two components, with essentially congruent contours, form a compact, essentially closed body, means being provided for securing the components in the closed position in a manually releasable manner, and the tool being accommodated in one of the components and being displaceable out of this component into a functional position, in which the body, in its closed position, forms the handle for manipulating the tool.

A further aspect of the invention relates to a combined implement having a pair of scissors and a tool, comprising a first component, and a second component which can be moved, relative to the first component, out of an open position, in which the two components are spaced apart by an actuating distance, counter to the prestressing of a spring into a closed position, in which the two components, with essentially congruent contours, form a compact, essentially closed body, means being provided for securing the components in the closed position in a manually releasable manner, the scissors being accommodated in one of the components and being displaceable out of this component into a functional position, in which they can be actuated by means of relative movement of the two components, and the tool being accommodated in one of the components and being displaceable out of this component into a functional position, in which the body, in its closed position, forms the handle for manipulating the tool.

A combined implement comprising a stapler, a hole puncher and a staple remover is known, for example, from the printed document DE-A-26 25 749. However, this implement is obviously designed for use on a desk and cannot be made into a compact body of the pocket-knife type.

The two components or shells are preferably designed as elongate, cuboidal hollow bodies which are delimited by a base surface, a top surface and in each case two side surfaces and end surfaces.

The two components are preferably of approximately the same size, are preferably shaped approximately symmetrically and, in the first position or closed position, are located approximately congruently one above the other, their base surfaces being directed towards one another, with the result that they form together an essentially closed, compact body.

The outer contours of the components are preferably rounded on all sides, so that the implement can be held equally well in all use positions. In this case, the two side surfaces may be flattened and set back with respect to the outer contours of the implement for the purpose of accommodating operating elements, for example sliding switches, with the result that the operating elements do not project beyond the contours of the housing. A separating joint may be provided between the components in order that one's hand does not get caught when closing the implement. A particularly pleasing form is achieved if a joint which runs all the way around or a gap is arranged between the preferably symmetrical components.

Of course, it is also possible for the components to be of different sizes, in particular of different heights; it is also possible for the contours to differ from one another.

Alternatively, of course, it is also possible for the components to be moved wholly or partially one inside the other or on over the other and to be overlapped completely or partly in the first position, for which purpose the contours of the components have to be matched with one another correspondingly.

In order to ensure accessibility to the free space between the components for specific uses of the hand-held implement, for example for stapling or hole punching, corresponding housing openings or access slots could be provided on the components in such an embodiment.

It would also be possible to provide more than two components and thus to operate various part-functions of the hand-held implement, for example hole puncher and stapler or a pair of scissors, via separate components.

The components may be connected to one another via a parallel guide or via an articulation which is preferably arranged in the vicinity of one end surface of the components and whose axis of rotation runs transversely with respect to the longitudinal axis of the components and parallel to the base and top surfaces.

The articulation may be arranged in the cavity of one component and be connected to the other component via a bearing block.

In the first position, the components are locked by a locking mechanism which is preferably arranged at a distance from the articulation and can be activated and deactivated via a manually actuable locking-mechanism button which is preferably placed on one of the top surfaces, in the vicinity of the end wall located opposite the articulation.

The design of the locking mechanism here is to be selected such that, in the unlocked position, rather than projecting beyond the base surfaces, where it could obstruct certain functions of the implement, it is located behind the base surfaces and can be moved resiliently behind these.

In a preferred embodiment, locking takes place outside the free space provided for the implement functions, for example stapling and hole punching, for example on the bearing block.

In order to avoid malfunctions, in particular inadvertent opening or locking of the implement, the locking mechanism should be latched in the locked and in the unlocked position. In this case, the locking-mechanism switch may be designed, for example, as a sliding switch with two latch-in positions.

In order to move the components from the first position into the second position, a spring which is preferably designed as a leg spring or compression spring and is arranged on, or in the vicinity of, the articulation may be provided.

The second position is defined by a stop which delimits the opening path of the components.

The components are to be provided with corresponding recesses into which the housing sections which run towards one another when the implement is opened can move, in which case it should be ensured that the accesses to the free spaces, for example the push-in slot to the hole puncher, remain open.

In addition to the tools or utensils whose functional elements are accommodated in both components, for example stapler and hole puncher, it is also possible for various additional tools and utensils to be accommodated in the individual components, it being possible for these tools and utensils to be moved out of the components into a use position from a storage position, in which they are essentially accommodated in the components.

The utensils are arranged in the components with their broad sides preferably parallel to the base, top or side surfaces, and are mounted with rotary, swinging or sliding action in said components.

For purposes of swinging out or displacing the utensils into their use position, corresponding opening slots are to be provided on the outer surfaces of the components.

One or more utensils, preferably arranged parallel to one another, may be accommodated in the components, it being possible for said utensils to be swung out or displaced into their use position in the same or opposite movement directions.

In the case of a preferred design, the displaceable utensils are mounted in the components with their broad sides parallel to the side surfaces and resting directly against the latter in a longitudinally displaceable manner, and they can be displaced into their use positions through correspondingly arranged opening slots on the end surfaces.

A free space in which assemblies of further utensils may be accommodated is preferably provided between the utensils which are mounted such that they rest against the side surfaces.

For the purpose of guidance in the components, the utensils may be provided with guidance continuations at their ends which are at the rear in the push-out direction, said guidance continuations being mounted in the components in longitudinal guides, for example via sliding blocks in longitudinal slots.

The use positions of the utensils are defined by stops which delimit the swing-out or push-out path.

The utensils are fixed in the storage and use positions by means of manually releasable arresting means.

The arresting means may be provided individually for each utensil or jointly for a number of utensils.

The swing-in and swing-out or sliding movements of the utensils may be assisted by spring force.

The utensils can be adjusted via operating elements which are preferably arranged on the side or top surfaces of the components.

In the case of displaceable utensils, corresponding longitudinal slots are to be provided in the sides and/or top surfaces; a number of operating elements could also be assigned a common longitudinal slot.

Set-back hollows could be provided on the side and/or top surfaces for the operating elements, the latter being positioned in said set-back hollows such that their outer surfaces are in alignment with the outer sides of the top and/or side surfaces.

In this arrangement, a common set-back hollow could be provided for a number of operating elements.

In the case of utensils which are mounted in the components such that they can be displaced in opposite directions, the operating elements could be arranged such that they run onto one another. It could consequently be ensured that in each case only one of the two utensils is extended.

Alternatively, the operating elements could be arranged such that they are offset with respect to one another, with the result that they could be displaced past one another and the extension paths of the utensils could thus be increased. The operating elements are preferably connected to the utensils in the region of the guidance continuations and are provided simultaneously for activating and deactivating the arresting means. For this purpose, the operating elements could be designed, for example as push buttons or sliding switches or be provided with ones with which the arresting means can be activated and deactivated.

A central locking means, which additionally blocks all the utensils or groups of utensils in the storage positions, could also be provided. This additional locking means could be designed as a separating operating element or, for example, could also be combined with the locking-mechanism button. It is also possible to provide, for suitable utensils, for example magnifying glass, measuring rule or pointer or writing implements, end-side grip hollows by which said utensils can be gripped and drawn out into their use positions or drawn out of the components to the full extent.

Certain utensils, for example measuring rule or writing implements are preferably accommodated in the components such that they can be removed therefrom. For this purpose, it is possible to provide channels into which the utensils can be pushed and arrested or locked. Such channels may extend over the entire length of the components and be accessible via push-in slots on the end surfaces. It is also possible for receiving compartments which can be swung out of the components to be provided.

For the purpose of replacing worn or defective utensils, the latter may also be designed such that they are connected releasably to the guidance continuations. For this purpose, the guidance continuations can preferably be moved out of the components to such an extent that it is possible to exchange the utensils outside the components. The utensils may optionally be arranged in one or in both components with their broad sides parallel to the top and bottom surfaces and/or to the side surfaces, and such that they can be swung and/or displaced in the same direction or opposite directions, in any combinations corresponding to the requirements placed on the hand-held implement in each case.

The utensils may comprise fixed or exchangeable blades or else so-called "cutter blades" with break-off blade sections, the latter preferably being mounted in a longitudinally displaceable manner in the component and also being arrestable in the intermediate positions of the displacement path. For optimum manipulation, the cutting edges of the blades are preferably directed, in the use position, towards the top surfaces of the component in which they are mounted.

The utensils may also comprise a staple remover, which preferably has a U-shaped cross-section, the base surface and the two lateral leg surfaces tapering towards the free end. In addition, the outer end of the staple remover could also be designed as a screwdriver.

For the best possible manipulation, the staple remover is preferably arranged directly on the inner side of a top or side surface, is bevelled on its outwardly directed base surface and is directed, by means of the leg surfaces, towards the longitudinal axis of the component in which it is mounted.

The staple remover is preferably guided in a longitudinally displaceable manner in the component, a staple-detaching means preferably being arranged at the opening slot for the staple remover, said detaching means meshing with the U-profile of the staple remover and detaching the staples when the staple remover is pushed into the implement.

Furthermore, the utensils may comprise a pair of scissors, which is preferably mounted in a longitudinally displaceable manner in one of the components with the scissor blades swung together.

In the case of the preferred embodiment with an articulation which is arranged in the vicinity of an end surface and whose axis of rotation runs transversely with respect to the longitudinal axis of the component and parallel to the base or top surface, the scissor blades are preferably arranged in the component such that their broad sides run parallel to the side surfaces of the component and the scissors axis runs parallel to the axis is of rotation of the articulation, the scissors preferably being accommodated in the component in which the articulation is arranged.

In order to use the scissors, the scissor blades are moved out of the component, through an opening slot arranged in the end wall located in the vicinity of the articulation, until the scissors axis and the axis of rotation of the articulation are essentially located one above the other or concentrically with respect to one another. The scissor blades are extended beyond the scissors articulation by scissor shanks. One of the scissor shanks is designed as a guidance continuation and is mounted in a longitudinally displaceable manner in the component, while the second scissor shank, upon opening of the scissor blades, in the use position, moves, through a recess provided in the base surface, in the direction of the other component.

In the use position of the scissors, the second scissor shank is held in operative connection with the other component, for example, by a scissors spring, which pushes the scissor blades or shanks apart from one another or via a coupling element, with the result that the scissor blades can be swung open and closed by virtue of the movements of the components between the first and the second positions. In this case, it has to be ensured that, to compensate for the movement geometry, the second scissor shank remains longitudinally movable with respect to the component on which it is supported or to which it is coupled. When the first scissor shank is pushed back into the component, the scissor blade connected to the second scissor shank runs onto that termination edge of the opening slot of the end wall which is directed towards the top surface, as result of which the two scissor blades or shanks are swung together and can thus be pushed back into their storage position in the component to the full extent.

Alternatively, of course, it would also be possible for the components to be moved into the first position first of all and for the scissor blades or shanks, already swung together as a result, to be pushed back into the component thereafter. Appropriate control means preferably make it possible for the scissor blades to be coupled and uncoupled and pushed out and pushed in in any relative position of the components.

In order to ensure that the cut material does not collide with the components, the scissor blades are to be provided with corresponding deflecting edges and the end surfaces of the components are to be provided with corresponding rounded sections, these guiding the cut material past the components.

By virtue of the pivot point of the scissor blades being displaced beyond the articulation, the distance between the end surfaces and the deflecting edges of the scissor blades can be increased and the deflection improved. Additional fixed or movable deflecting means, which can preferably be activated or deactivated by the push-out or push-in movement of the scissors, could also be provided on the scissor blades and/or on the components. Thus, for example, the introduction slot for a hole puncher could be closed off when the scissors are in use.

The slide for moving the scissors between the storage position and the use position is preferably arranged on the guidance shank, in which case the other scissor shank is to be provided with a corresponding recess or is to be shortened, with the result that the scissor blades can be closed to the full extent.

Alternatively, it would also be possible to provide a pair of scissors which, rather than being activated by the relative movements of the components, can be pushed or swung out of one of the components and is actuated by hand, preferably with the components in the closed state. In this case, the scissor blades are opened via a separate scissors spring which can be deactivated for the purposes of retracting the scissors into the component or extending them therefrom. This could be carried out via a separate locking member preferably arranged on the scissors or via the guide in the component or via control means, in which case the functions of locking and unlocking the scissors in the outer use position and opening and closing the scissor blades are preferably coupled to one another.

A magnifying glass could be provided as a further utensil, said magnifying glass preferably being arranged in a plate-like mount which is mounted displaceably in the component with its broad sides parallel to the base and top surfaces and can be displaced into its use position through an end-side opening slot. The magnifying glass is preferably pushed out by a spring and is secured in the component by a locking arrangement which can be released on the end side. In the guide region, the magnifying glass is preferably forked or recessed such that there is space for additional utensils. The plate-like mount may comprise two pieces which are connected to one another via a pivot pin which is arranged transversely with respect to the push-out direction and parallel to the plane of the pieces, the outer piece containing the magnifying glass, which may be angled with respect to the component, this considerably improving manipulation, in particular, in combination with a lamp arranged on the end surface.

The utensils may further comprise a measuring rule with ruler and template function, said measuring rule preferably being accommodated loosely in the components and being removable therefrom to the full extent for convenient manipulation. A push-in channel may be provided for accommodating this utensil, said channel preferably being arranged directly on the inner side of one of the top surfaces and extending essentially over the length of the component into which the measuring rule is pushed with its broad side parallel to the top surface.

The measuring rule can be secured in the storage position in the component by means of protrusions or a releasable locking means, and it can be removed from said component by an end-side removal grip or with the aid of a push-out spring.

Utensils may further comprise a measuring tape, which may preferably be accommodated in one of the components so as to be rolled up around an axis located perpendicularly with respect to the top and base surfaces, and which may be drawn out of the component through an opening slot provided on the end and/or the side surfaces. The measuring tape is preferably arranged outside the displacement path of the displaceable utensils arranged on the side walls, with result that the maximum width of the interior of the component can be utilized for accommodating the measuring tape. The measuring tape may be provided with a roll-up spring and a fixing brake which can be activated and deactivated via a button arranged preferably on the end surface.

Of course, it would also be possible to accommodate the measuring tape in the components so as to be rolled up around an axis located perpendicularly with respect to the side and/or end surfaces, in particular when the separating plane between the components does not run centrally or the components move one inside the other or one over the other and the necessary installation height is thus available for accommodating the vertically arranged measuring tape in one of the components.

In addition, or alternatively, to the measuring tape, an adhesive-tape dispenser could also be accommodated in the components.

In order to receive the exchangeable rolls of adhesive tape, one of the components could comprise a mount with a hub on which the roll of adhesive tape is mounted rotatably. The roll of adhesive tape could then be arranged in the components analogously to the variants for installing the measuring tape.

In order to draw off the adhesive tape, a through-passage slot, preferably provided with a tear-off edge, would have to be provided at an appropriate location in a side, end or top surface of the component. In the case of a preferred design, the tear-off edge could be arranged on a tape holder which is connected movably to the component, could, for example, be swung out of the component and, in the process, moves the start of the adhesive tape out of the component to such an extent that it can be gripped conveniently. The inner surface of the tape holder could be coated with a non-stick coating, with the result that the adhesive tape is detached easily from the tape holder when the latter is swung out. The tape holder could latch in the inner and/or outer position, or else could be moved from one position into the other by spring force.

In order to exchange the rolls of adhesive tape, the mount could be accessible via an opening which can be closed off preferably by means of a cover.

Alternatively, the mount could be moved out of the component, for example on a carrier, to such an extent that the roll of adhesive tape can be introduced into the mount or removed therefrom. It would also be possible for the entire adhesive-tape dispenser to be swung or pushed out of the component in order to be used.

As a further utensil, a lamp whose light-outlet opening is preferably located on an end surface could be accommodated in the components.

The batteries necessary for supplying power to the lamp could be accommodated in the component in a battery compartment which is arranged behind the lamp and is accessible via an opening, for example in the top surface, which can be closed off by a cover. The lamp could be switched on and off via an electric switch arranged preferably on the top surface in the vicinity of the light-outlet opening.

If the hand-held implement is equipped with the lamp and magnifying glass, these could be arranged, in a preferred embodiment, on a common end surface or on two adjacent end surfaces, such that it is possible to illuminate the space beneath the magnifying glass extended into the use position.

It would also be possible, in such an embodiment, for the lamp to be arranged directly in the magnifying glass and/or to be switched on automatically when the magnifying glass is extended.

In addition, or alternatively, to the lamp, it would, furthermore, be possible to accommodate a so-called laser pointer (illuminated pointer) in the components, the light-outlet opening of which is preferably likewise arranged on an-end surface.

In the case of a combined installation of lamp and laser pointer, these are preferably arranged one beside the other or one above the other in the same component, provided with a common light-outlet opening, fed via a common power supply and can be operated via a combination switch, for example position 1: light on, position 2: push button for the laser.

A pointer which can be drawn out telescopically could likewise be provided, which pointer can preferably be drawn out of one of the components through an end-side opening, it being possible to provide a push-out device by means of which the pointer is pushed out of the component until it can be gripped.

The utensils may also comprise a stapler, in which case the functional elements are accommodated in both components. In the case of a preferred embodiment, the stapling head is arranged in the first component and the anvil is arranged in the second component.

For this variant, the two components are preferably connected to one another, in the vicinity of one end side, via an articulation, whose axis of rotation runs transversely with respect to the longitudinal axis of the components and parallel to the base and top surfaces, the stapling head as well as the anvil being arranged in the vicinity of the end surfaces located opposite the articulation. In order to ensure that, even with the maximum number of sheets being provided, the stapling head rests properly on the stapling material and the latter cannot be damaged by the components, that region of the components which contains the free space into which the stapling material can be pushed is to be correspondingly recessed, and the pivot arm on which the stapling head is arranged with an inclined section directed towards the stapling material is to be arranged in the first component. In order to receive the staple block, the stapler mechanism comprises a staple magazine which is guided movably in the first component. Preferably, the staple magazine is mounted on the articulation and can be pivoted concentrically with respect to the components. In this arrangement, the staple magazine is prestressed in the direction of the second component by a magazine spring and is moved out of the first component to such an extent that the staple driver is extended out of the staple magazine beyond the height of the staple block.

The outer position of the staple magazine is delimited by a magazine stop which is arranged, for example, as a sliding switch on the first component and/or on the staple magazine and can be deactivated manually, with the result that the first component and the staple magazine can be pivoted apart from one another in order for the staple block to be introduced. Alternatively, the path of the magazine spring could also be delimited by a stop arranged in the first component. Consequently, a magazine stop for delimiting the outer position of the staple magazine could be dispensed with, and the operation of pivoting the first component and staple magazine apart from one another for the introduction of a staple block could take place without the magazine stop being deactivated.

In order to improve the accessibility to the staple magazine for introduction of the staple block, the stop which delimits the opening path of the components could be deactivated. Furthermore, it would also be possible to delimit the opening path of the staple magazine by a stop on the second component and for the first component to be moved beyond this stop. In the case of this embodiment, the spring force for moving the components from the first position into the second position could preferably be transmitted from the second component to the first component via the staple magazine. In the case of this embodiment, depending-on the design of the staple magazine, the opening path of the first component beyond the staple magazine could be delimited by a fixed or releasable stop.

In a preferred embodiment, it is to be possible for the stapler to be deactivated. This is necessary, in particular, when further utensils, for example a pair of scissors or a hole puncher, which are likewise actuated between the first position and the second position by the relative movements of the components are integrated in the hand-held implement. In this case, it is to be ensured that, when the scissors or hole puncher are used and, of course, also when the components are locked with respect to one another, the stapler remains non-active. In addition, it is advantageous if the additional high spring force of the magazine spring takes effect only when the stapler is used since, otherwise, this force also has to be overcome when the hole puncher or scissors are used and when the components are locked with respect to one another. Depending on the type of deactivating mechanism, the overall height of the first component may be considerably reduced and, as a result, the implement may be of a considerably more compact construction. It is possible to deactivate the stapler in a number of ways. For quick and straightforward manipulation of the implement, the activation and deactivation of the stapler can take place via an actuating member arranged preferably on the outer side of the components. An advantageous solution is obtained by the actuating member being arranged, in the vicinity of the stapling head, in that end region of the first component which is located opposite the articulation. The actuating member is advantageously designed here as a push-button switch, sliding switch or rocker switch, and it should be noted that, when said switch is actuated, the force vector is directed such that it does not result in any closing movement of the open implement. The stapler is preferably activated in each case only for a single stapling operation. It is consequently ensured that deactivation of the stapler before the implement is locked or before using other functions of the implement, for example the hole puncher or the pair of scissors, cannot be "forgotten", it also being possible, of course, to design the deactivating mechanism such that, after activation, the stapler remains active for a number of stapling operations until such time as it is deactivated via the actuating member. It would also be conceivable to design the deactivating mechanism such that a selection could be made between a number of functions, for example stapler off, stapler on, single stapling operation. Furthermore, the stapler mechanism should be designed such that it can be activated only when the implement is open and activation cannot take place when the implement is closed, since otherwise, when the implement is next opened, the stapler would be in the activated state even though this function is perhaps not required at all. This could be effected, for example, by the deactivating mechanism being blocked when the implement is in the closed state. Furthermore, it should be ensured that inadvertent locking of the implement—for example as a result of the locking-mechanism switch being displaced by mistake—is not possible when the stapler is in the activated state. This is preferably effected by the locking mechanism and the deactivating mechanism being safeguarded with respect to one another to such an extent that, when the stapler is in the activated state, the locking mechanism cannot be brought into the closed position. An advantageous solution is obtained when the locking mechanism is designed such that locking of components is possible only in the closed position thereof.

In the case of a preferred embodiment, it would be possible to provide, for deactivation of the stapler, a magazine locking mechanism which, with the stapler driver retracted, secures and locks the staple magazine in the first component counter to the force of the magazine spring. Locking advantageously takes place automatically after each single use of the stapler, and for activation of the stapler, the magazine locking mechanism is released manually. Consequently, the staple magazine is moved out of the first component up to the magazine stop under the action of the force of the magazine spring and, in the process, the staple driver is drawn out of the staple magazine to such an extent that the staple block can move up towards the staple stop. The extension movement of the staple magazine could be braked here by a damping element. After a single stapling operation has taken place, the staple magazine is automatically locked in the first component again. The magazine locking means is preferably deactivated via a stapler button which is arranged on an outer surface of the component, for example on the end surface located next to the stapling head. In the case of this preferred embodiment, the magazine locking mechanism is prestressed by a spring and locks the staple magazine automatically after each single stapling operation. It is only the deactivation of the magazine locking mechanism which takes place manually via the stapler button before each stapling operation.

As has been mentioned, it would also be possible for the automatic locking of the staple magazine to be switched off manually and the stapler thus to be switched over for "single stapling operation" and "repeated stapling operation". In the case of these variants with a lockable staple magazine, it should be ensured that a staple block which has been newly introduced in the staple magazine remains at a distance from the staple stop until the staple driver is retracted into the staple magazine. This could be effected, for example, via an additional or movable staple stop by means of which the staple block is held back from the range of action of the staple driver until the latter is retracted into the magazine, and which is activated or deactivated, for example, by the relative movement between the staple magazine and first component when a new staple block is introduced.

The stapler could also be deactivated by direct interruption in the operative connection between the staple driver and staple block, for example the retraction of the staple driver into the staple magazine being prevented by a blocking member or the staple driver being arranged movably in the first component and being capable of adjustment from a non-active position into an active position, for example, by being displaced or swung out, as a result of which, in the case of these embodiments too, it would be possible to select between "single stapling operation" and "repeated stapling operation". It would also be possible for the blocking member or the staple driver to be prestressed respectively into the active or non-active position by a spring and to be guided back into these positions via a positive-control means after each stapling operation and to be capable of activation in each case only for a "single stapling operation", for example by means of a stapler button. For a kinematic reversal, it would, of course, also be possible, for deactivation of the stapler, to move the staple block out of the range of action of the ram and into a non-active position.

Finally, it would also be possible, for deactivating the stapler, to move the entire stapler unit, with the staple magazine and the stapler driver extended out of the staple magazine, into the first component by means of an actuating member and, for activating the stapler, to extend said unit out of said first component. In addition, it would be possible to move the anvil and, if necessary, the base surface of the second component away from the range of action of the stapling head, with result that those parts of the stapler unit which project out of the first component can move into the second component when the implement is closed without the stapler being activated thereby. However, it is obvious that these embodiments result in an increase in the overall height of the implement.

The staple magazine preferably has a U-shaped cross-section and can be formed in one piece from sheet metal by punching and bending. In a preferred design, the open side of the U-shaped profile is directed towards the top surface of the first component in the front section of the staple magazine and towards the second component in the rear section adjoining the articulation. In this case, the front section is intended as a receiving space for the staple block, while the rear section is provided with a recess, for example, for a hole-puncher punch guide arranged in the second component and with an activating device for the punch. As a result of the receiving space for the staple block being shortened in this way, the loading slide is preferably pushed against the staple stop via a tension spring. A particularly compact design is obtained by using a clock spring which is mounted in the loading slide and, by means of its free end, is fastened on the staple magazine in the region of the staple stop.

For introduction of the staple block, it would also be possible for the staple stop to be arranged movably on the staple magazine and to be pivoted away so as to permit the staple block to be introduced into the staple magazine on the end side.

Alternatively, the staple magazine could also be designed as a so-called "spring compartment". In the case of this design, the staple magazine is mounted in a longitudinally displaceable manner in an outer channel mounted on the articulation and, upon actuation of a release member, is forced forwards out of the outer channel, under the action of the force of a push-out spring, to such an extent that the staple block can be introduced into the extended magazine from above. Consequently, it would be possible to dispense with a means for swinging open the magazine and/or first component for the introduction of staples, and this considerably improves the stability and manipulation of the implement. Depending on the type of deactivating mechanism of the stapler, it has to be ensured that the spring compartment can only be released when the stapler mechanism is activated and the end wall of the first component is raised above the outer channel to such an extent that the spring compartment can extend beneath the end wall. The spring compartment is preferably released via an actuating member which is arranged in the region of that end wall of the first component which is located is in the vicinity of the articulation, and which is in operative connection with the spring compartment via webs which are guided laterally past the opening spring and—if present—the hole-puncher mechanism. The base wall of the outer channel has to be set back in the region of the stapling head to such an extent that, during stapling, in each case the staple-outlet opening of the magazine comes into contact with the stapling material in front of the outer channel.

The stapler could also be provided with a so-called flat-clinch mechanism, by means of which a first part-displacement of the components drives the staples into the paper which is to be stapled and said staples are bent over thereafter via a second part-displacement of the components. In order to be able to construct the implement to be as narrow as possible, despite the installation of such a mechanism, the magazine and/or the outer channel may be provided with base openings which are arranged as closely as possible to the main spring and through which the transmission lever arranged in the first component projects downwards in the direction of the second component. Consequently, the transmission mechanism can be positioned between the walls of the bearing block and thus be protected against damage and be accommodated in the implement such that it is hidden from view.

The anvil of the stapler is preferably arranged on the base surface of the second component. A number of anvils, for example for open or closed stapling, may be mounted movably in the second component on a separate slide or rotary plate.

Free spaces are preferably provided between the staple magazine and/or the outer channel and the side and/or top surfaces of the first component, in which free spaces it is possible to accommodate further, in particular longitudinally displaceable or swing-out flat utensils, for example a knife, blade, pair of scissors, staple remover/screwdriver, measuring rule or magnifying glass. These may be guided on the first component and/or on the staple magazine and/or outer channel.

The locking mechanism for locking the components is preferably arranged in the space between the stapler unit and the top surface of the first component, the operative connection to the second component taking place via coupling elements which are preferably guided laterally past the staple magazine and/or outer channel.

Finally, the utensils may also comprise a hole puncher, in which case the functional elements are also distributed between both components. In the case of a preferred embodiment, the hole-puncher mechanism is preferably arranged in the second component and is activated by the first component during the movement from the second position into the first position.

The hole puncher is provided with only one punch, which permits a considerably simplified, smaller and compact construction of the hand-held implement. In addition, the hand-held implement can be readily used, without adaptation, for the large number of standard hole-to-hole distances, these differing from country to country, and, finally, it is also the case that less pressure is required for the punching operation, which is advantageous, in particular, when the hand-held implement is used without a table for support.

It would be possible, in the event of the components moving between the first position and the second position, for the hole puncher to be carried along with said components in each case since no other applications of the hand-held implement are disrupted by the hole-puncher actuation. Of course, the functioning of the hole puncher could also, however, be switched on and off.

The hole-puncher mechanism comprises a punch which is preferably mounted, perpendicularly with respect to the base and top surfaces, in a punch guide arranged on the second component.

It is also the case that, for provision with a hole puncher, the components are preferably connected to one another, in the vicinity of one end side in each case, via an articulation whose axis of rotation runs transversely with respect to the longitudinal axis of the components and parallel to the base and top surfaces, the punch preferably being arranged between the articulation and the end surfaces located opposite the articulation, approximately centrally with respect to the longitudinal axis of the components and in the vicinity of the articulation.

The punch guide advantageously forms, together with the bearing block, a common assembly, which is fastened on the second component in the region of the base surface and extends in the direction of the first component, in which case corresponding recesses are to be provided in the first component and/or in the outer channel or in the staple magazine.

The punch is activated by the first component or by the staple magazine or the outer channel, with which the punch can be brought into operative connection.

The operative connection can be produced via a carry-along member, for example via a transverse bolt guided in the punch and in the staple magazine and/or in the outer channel or in the first component or via in each case one separate carry-along member for pushing and pulling one or more of these parts.

The advantage of this variant is that the punch is guided in both movement directions with positive control and therefore jamming of the punch during punching can also easily be released again by pulling the first component. It would also be possible, in the case of this embodiment, for the bolt to serve as a stop for delimiting the opening path of the component and/or of the outer channel or of the staple magazine. Finally, in the case of this variant, the wear is reduced since, when the stapler and scissors are used, the punch is carried along without spring loading. The overall height can be reduced if the carry-along member or members is or are arranged above the punch guide. In order to reduce the frictional forces which are caused by the tilting moment occurring when force is transmitted to the punch, the transmission of forces could take place, for example, via a connecting rod or via a ball mounted on the end surface of the punch. Of course, the punch could also be prestressed into the non-active position by a compression spring arranged preferably in the punch guide, in which case it would only be the activation of the punch which would take place via a carry-along member.

Consequently, the first component and/or outer channel and staple magazine could be pivoted beyond the outer stop of the punch, which would be advantageous, in particular, for the introduction of the staple block into the staple magazine. The compression spring arranged on the punch could also be used, at the same time, for moving the components from the first position into the second position.

Furthermore, the hole-puncher mechanism comprises a bearing platform which is arranged in the second component and is preferably located parallel to the base surface or in the plane thereof. An introduction slot for the paper sheets which are to be punched is provided between the bearing platform and the punch guide. The introduction slot is open on the two sides directed towards the side surfaces and one side directed towards the end surfaces of the components.

With the same arrangement of the punch in the components, it would be conceivable in principle for access to be gained to the hole puncher from both end surfaces, the construction of the implement being different for the two variants. The two variants also differ as regards ease of use of the hole puncher.

If the paper is pushed into the hole puncher from the end surfaces located opposite the articulation, then the two components, for the most part, project over the paper surface, which makes it more difficult to manipulate the hole puncher without a table for support. In order to avoid damage to the paper sheets by the components being pressed in, preferably a stop for delimiting the closing movement of the components during hole punching and/or corresponding recesses on the side and end and/or base surfaces of the components would have to be provided. Corresponding advancement of the punch should preferably ensure that the punching operation is terminated before the base and/or side and end surfaces of the first component come into contact with the surface of the paper. On the other hand, it should be ensured that, in the second position of the components, the punch is extended out of the introduction slot to the full extent.

If the paper sheets are to be introduced from the end surfaces located in the vicinity of the articulation, which considerably improves the manipulation of the hole puncher, then the bearing block should be arranged in the form of an extension arm on the punch guide connected to the second component. In the case of this embodiment too, the corresponding recesses should be provided on the components in order to ensure that the paper sheets cannot be damaged by the components when the latter are closed. These recesses may be in the form of a step-like offset section.

A preferred embodiment of the implement is obtained if the push-in openings provided for the hole puncher and the stapler are located in a common plane and are at the same levels when the implement is in the closed position. In addition, the components could be arranged such that, in the closed position, their base surfaces are spread apart from one another by a distance corresponding essentially to the height of the push-in slot for the hole puncher, and the anvil and the bearing platform for the hole puncher are arranged in the plane of the base surface of the second component. In this case, the paper stop for the hole puncher is advantageously formed by the two side walls of the bearing block.

A through-passage opening which is intended for the punch and serves, at the same time, as a die is provided in the bearing platform. Arranged beneath the through-passage opening, in the second component, is a receiving space which is intended for the punchings and can be emptied via an opening which can be closed off by a cover. In order to prevent overfilling of the receiving space, the opening is preferably arranged in the top surface of the second component, and the cover is articulated and locked such that it springs open automatically as a result of the pressure produced in the event of overfilling. The cover is preferably secured by two latch-in positions, with the result that, in the presence of excess pressure, it does not open to the full extent, but only into the first latch-in position and thus signals the overfilled state. This means that unintended emptying-out of the punchings can be prevented.

The dimensions of the punch guide and bearing block are selected such that, in the first position of the components, this assembly can be accommodated in the rear section, adjoining the articulation, of the staple magazine and/or outer channel.

For lateral alignment of the paper sheets, it would be possible to provide markings, which indicate the position of the punch, for example on the component end surfaces arranged above and/or beneath the push-in slot.

In the case of a preferred embodiment a window is arranged in the bearing platform, in the region between the paper stop and through-passage opening for the punch, and the region of the rear sheet edge of a sheet which has been introduced into the hole-punching slot can be seen from the outside through said window, via a light guide arranged in the second component.

The light guide is manufactured from an optically conductive material, for example PMMA or PC, and is preferably of a rectangular cross-section and in the form of a truncated pyramid, the smaller end surface resting against the window of the bearing platform, while the larger end surface is in alignment with the top surface of the second component. The window in the bearing platform preferably extends up to the paper stop, while, for stability reasons, a supporting surface is to be provided between this window and the through-passage opening for the punch.

The end surfaces of the light guide may be of lenticular design and, in order to protect against scratching or soiling, are set back slightly with respect to the bearing platform and top surface. A marking, which marks the centre of the punch, is provided on the window of the bearing platform and/or on that end side of the light guide which is directed towards the bearing platform. A marking provided on the sheet border means that the punching can be positioned precisely in a simple, convenient and quick manner. It goes without saying that, alternatively, a corresponding device could also be accommodated in the first component. The hand-held implement could also be provided with a sheet stop which is preferably guided movably on the second component and can be set differently for the desired hole-to-hole distances. The sheet stop could be mounted, for example, rotatably in the second component and be pivoted between a storage position, in which it is located essentially parallel to the longitudinal axis in the component, and the use position transverse to the longitudinal axis. The sheet stop could be designed with one or more arms, such that it can be drawn out and/or folded via articulations, and articulated on the second component, for example, concentrically with respect to the through-passage opening.

Finally, for establishing the distance between the holes, it would also be possible to use a punching template which is held together with the paper sheets and is introduced into the hole puncher together with said sheets. The punching template is preferably of an L-shaped cross-section and is held in position against the paper sheets in the centre of the sheet edges which are to be punched. End stops may delimit the displacement path of the punching template in the introduction slot. The hole punching takes place in the two stop positions which provide the desired distance between the holes. For a quadruple punching operation, the punching template can be displaced outwards along the sheet edges in each case by the distance between two holes. The punching template is preferably mounted displaceably in a guide groove, transverse to the longitudinal axis, in a second component.

In the region of the punch, corresponding recesses are provided on the punching template; the centre of the punching template may have a marking on it. In the case of a preferred embodiment, the measuring rule is designed as a punching template.

In order to secure the hand-held implement in a shirt pocket or, for example, on the partition of a compartment in a briefcase, said implement may be provided with a resilient fastening clip. The latter is preferably arranged in a complementary hollow on the top surface of the first component, behind the locking-mechanism switch, and can be swung open towards said switch.

In a preferred embodiment, the individual utensils and operating elements are distributed between, and arranged in, the two symmetrical components, which are approximately of equal height, as follows:

The staple magazine and the outer channel are arranged in the central region of the first component, extend approximately over the length of the component, are mounted, on the articulation, at one end such that they can be rotated concentrically with respect to the components, and can be activated at the other end via the stapler button arranged in the region of the end surface. The receiving space and the activating element for the punch and the punch guide are accommodated in that section of the staple magazine and/or outer channel which is directed towards the articulation. Between the staple magazine and/or the outer channel and the side surfaces of the first component there are arranged, on one side, preferably the right-hand side as seen in the push-out direction, the longitudinally displaceable scissors and, on the other side, the longitudinally displaceable staple remover/screwdriver, it being possible for these two utensils to be displaced into their use positions, through opening slots in the end surface arranged in the vicinity of the articulation, by means of the sliding switches arranged on the side surfaces. The locking mechanism is accommodated between the staple magazine and/or the outer channel and the top surface of the first component. The locking-mechanism switch is arranged in that end region of the top surface which is located opposite the articulation, and the operating element for the spring compartment is arranged in the rear end region located in the vicinity of the articulation.

The central region of the second component is subdivided into a number of sections arranged one behind the other. The receiving compartment for the punchings is accommodated in a first section, which adjoins the rear end surface located in the vicinity of the articulation. Adjoining this is the window for the positioning of the material for punching. Accommodated in the adjoining section is the roll-up measuring tape, which is routed laterally past the window for the hole puncher and past the receiving compartment for the punchings and passes out of the component through a slot arranged on the rear end side. An arresting switch for the roll-up measuring tape is likewise arranged on this rear end side. Adjoining this is the battery compartment and, provided with a light-outlet opening on the end surface located opposite the articulation, the section for accommodating the lamp and laser pointer. The battery compartment and receiving space for the punchings are accessible via swing-open covers on the top surface of the second component. The switches for actuating the lamp and laser pointer are arranged at that end of the top surface of the second component which is located opposite the articulation. The magnifying glass which can be extended above the light-outlet opening on the end surface is arranged between the lamp/laser section and the base surface of the second component.

Between the centrally arranged sections and the side surfaces of the second component there are arranged, on one side, the longitudinally displaceable knife blade and, on the other side, the longitudinally displaceable cutter blade, it being possible for these two utensils to be displaced into their use positions, through opening slots in the end wall located opposite the articulation, by means of the sliding switches arranged on the side surfaces. The guide for the knife blade extends essentially over the entire length of the component; the guide for the cutter extends only up to the roll-up measuring tape, which extends, on the cutter side up to the side surface of the component. The sliding switches are arranged in elongate, hollow-like depressions which are located in the side surfaces, extend approximately over the length of the components and are open towards the base surfaces. The hollows are symmetrical in the first and second components and thus form a common hollow when the hand-held implement is closed. The top and end surfaces of the components are preferably formed from single-piece shell-like caps which consist of plastic and are positioned on the preferably metal, U-shaped parts which form the base and side surfaces of the components, the side surfaces being set back slightly with respect to the plastic caps, with the result that the sliding switches are located approximately flush with the outer contours of the plastic caps. The operating elements arranged on the top and end surfaces are preferably located flush with the outer sides of the plastic caps. The hand-held implement could alternatively be provided with, or additionally be supplemented by, further utensils of conventional pocket knives. The utensils could also be arranged or combined differently in the hand-held implement. It would likewise be possible for the hand-held implement to comprise only one of the utensils or functions of those described.

Exemplary embodiments of the invention are illustrated in the accompanying drawings and described in detail hereinbelow.

Figure 9:
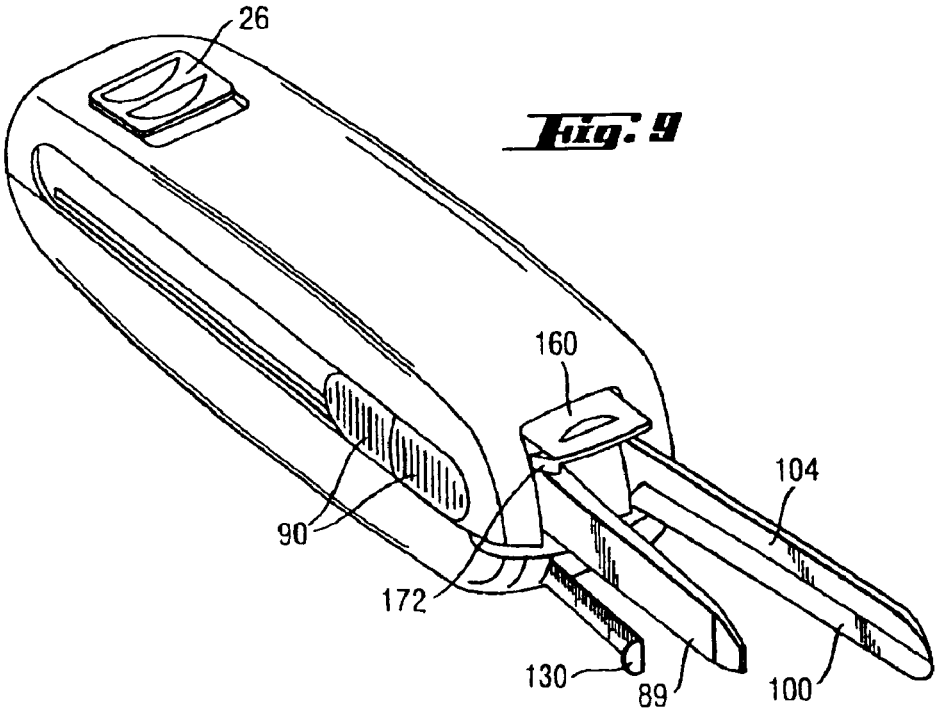
Figure 10:
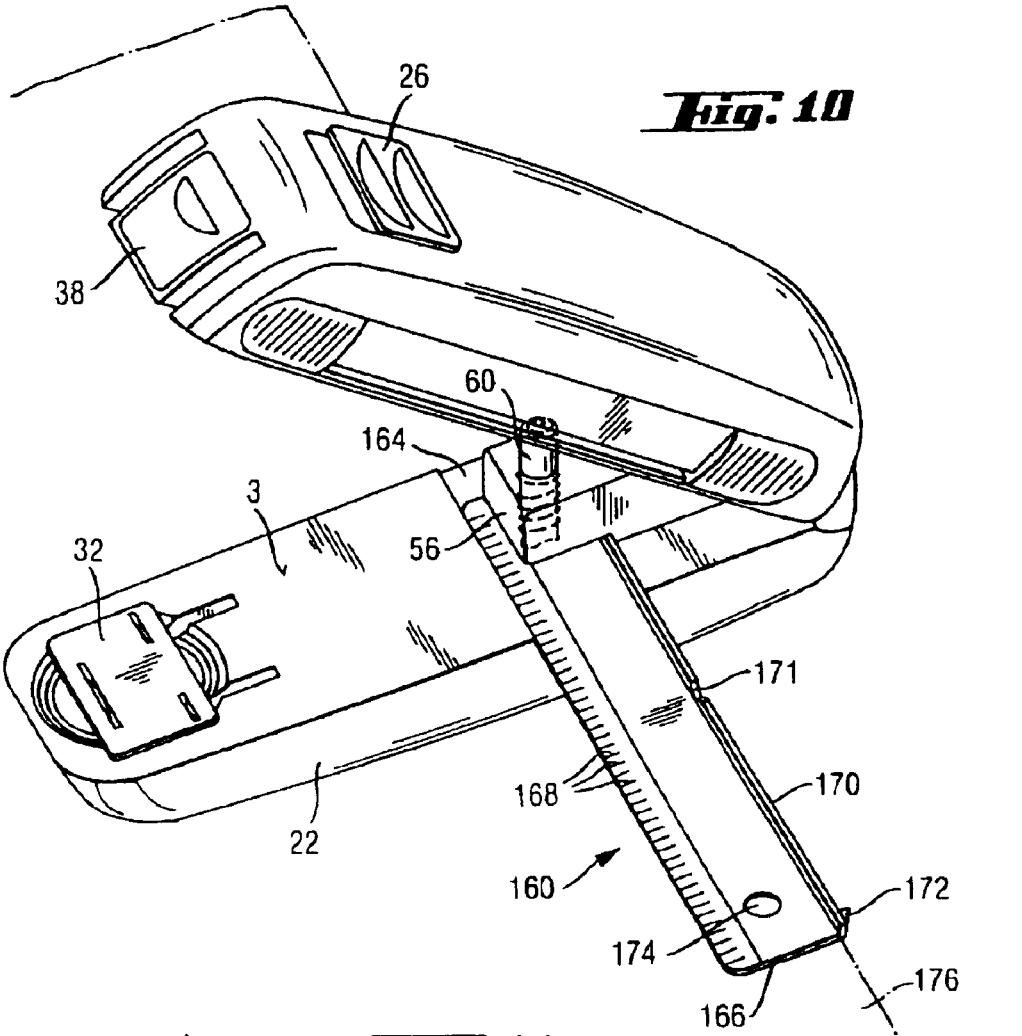
Figure 11:
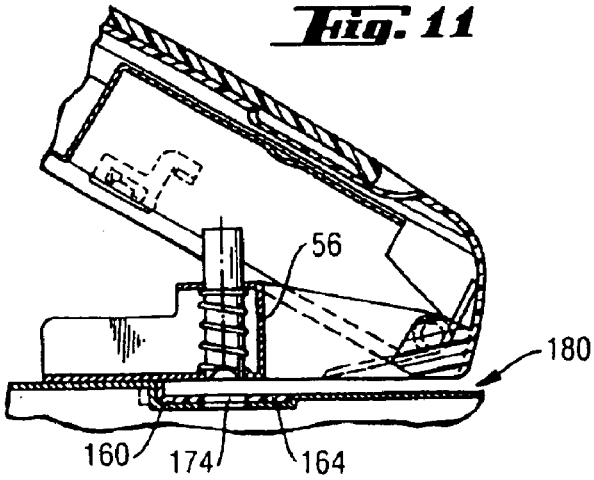
Figure 12:
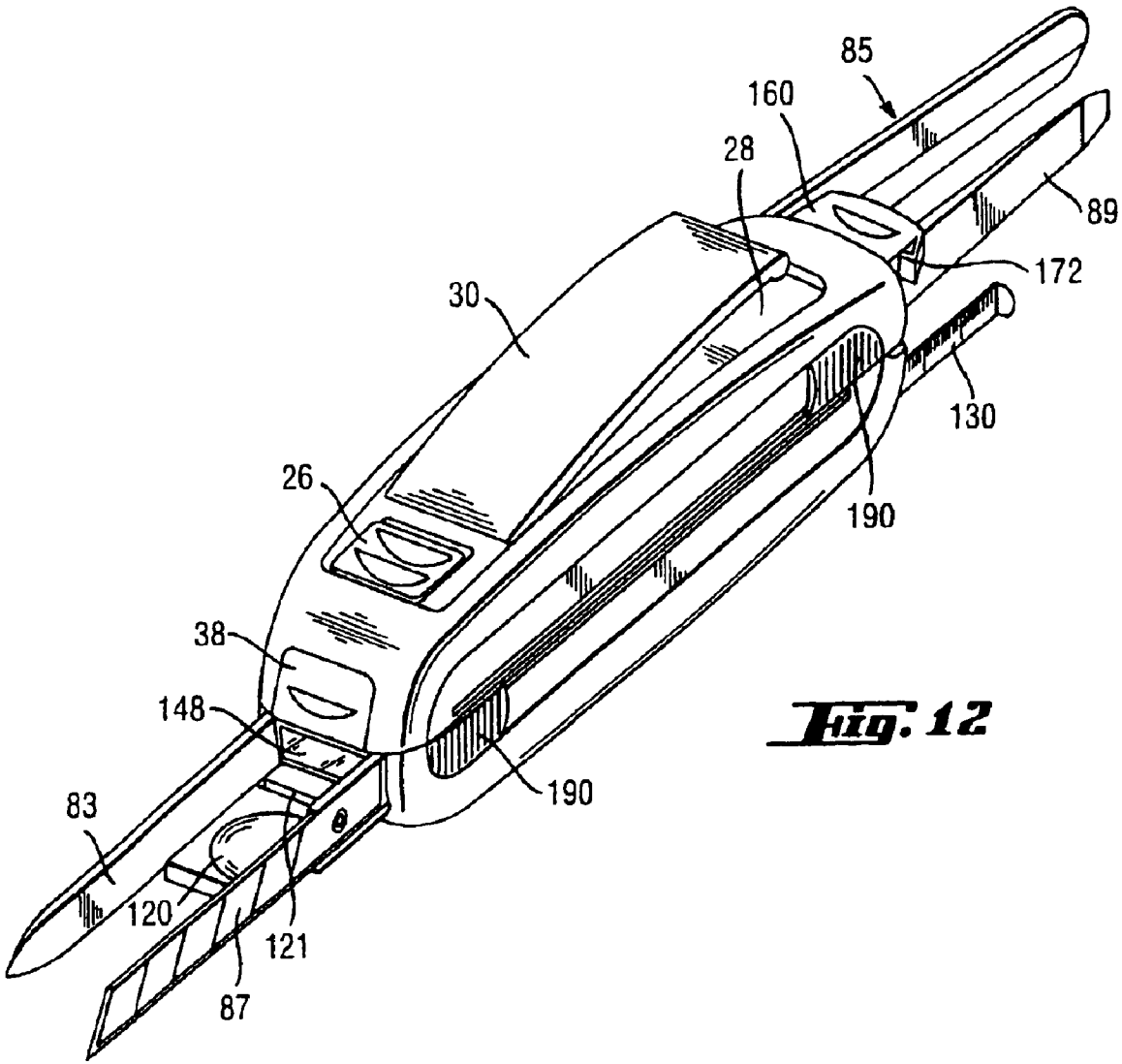
Figure 13:
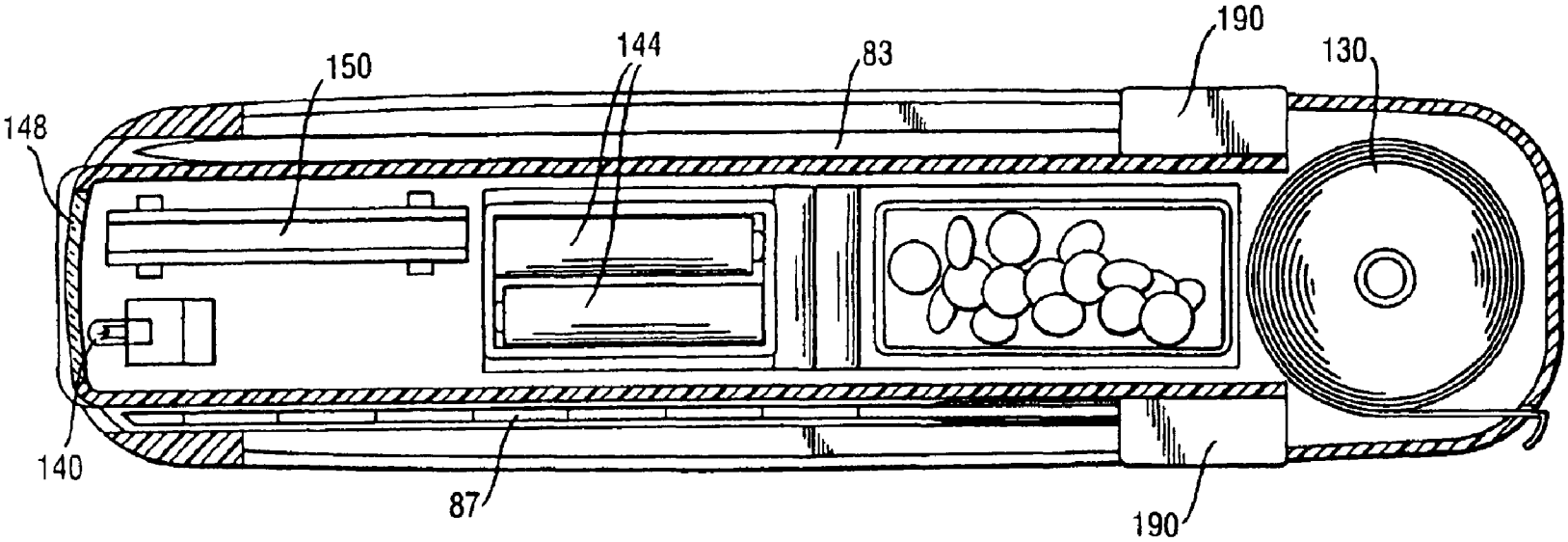
Figure 14:
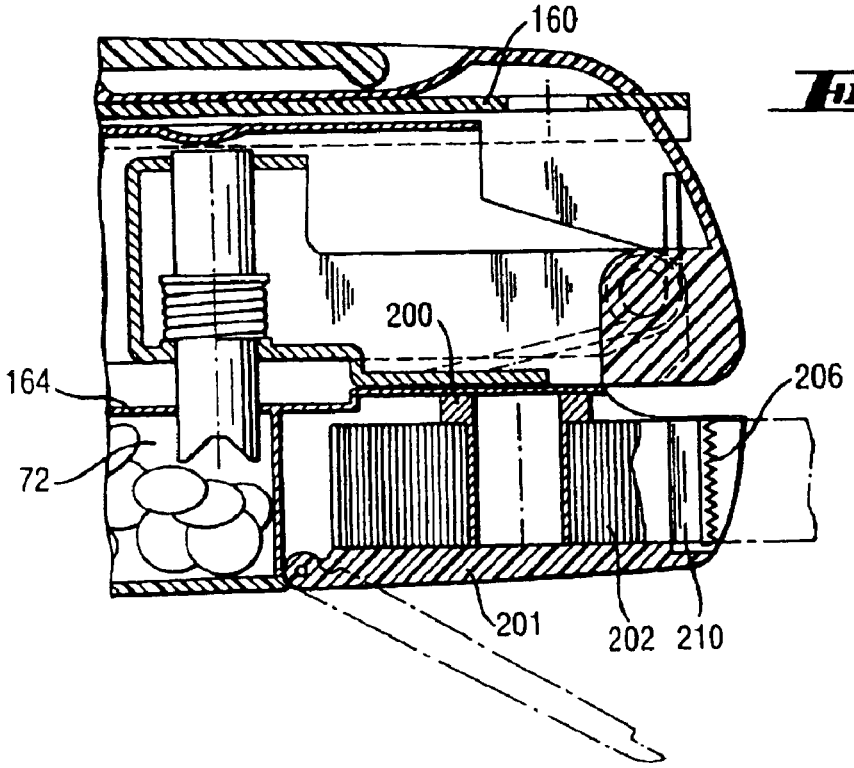
Figure 15:
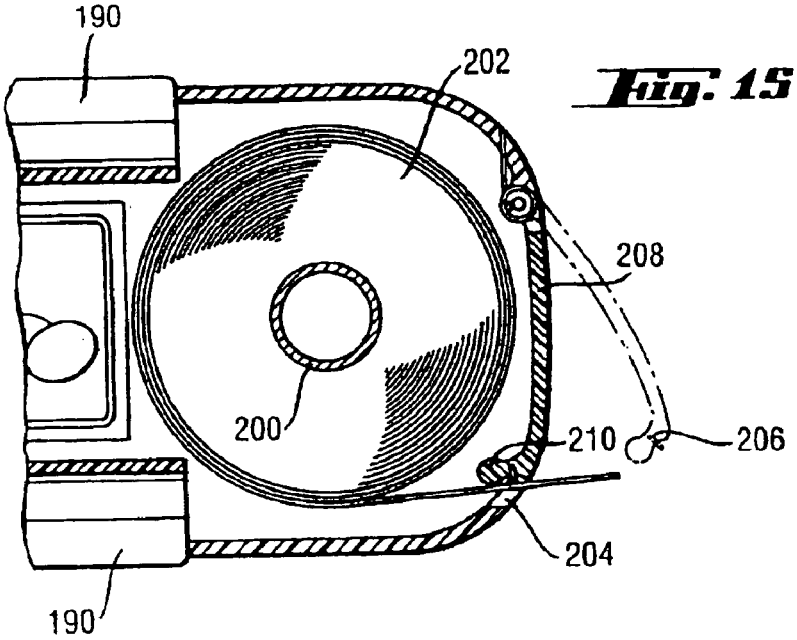
Figure 70:
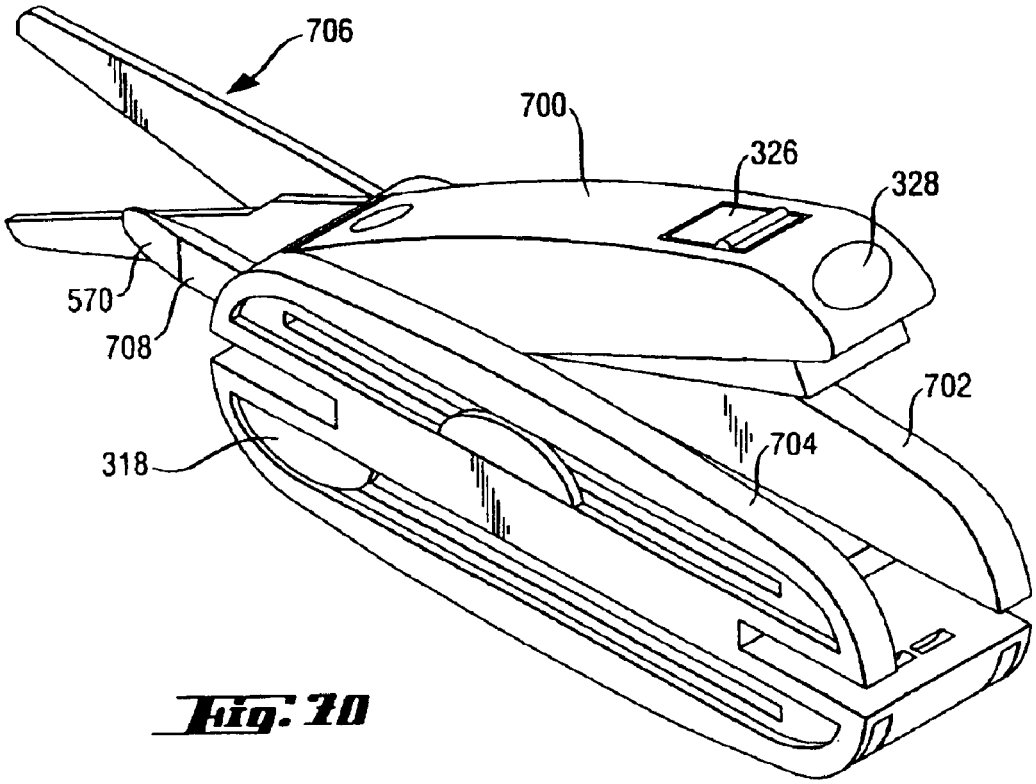

FIGS. 1 to 10 show a first embodiment, FIG. 11 illustrates a variant of this embodiment, FIGS. 12 and 13 show a second, preferred embodiment, and FIGS. 14 and 15 show a variant which can be used in the case of the first two embodiments. FIGS. 16 to 70 inclusive relate to a third, preferred embodiment.

Figure 2:
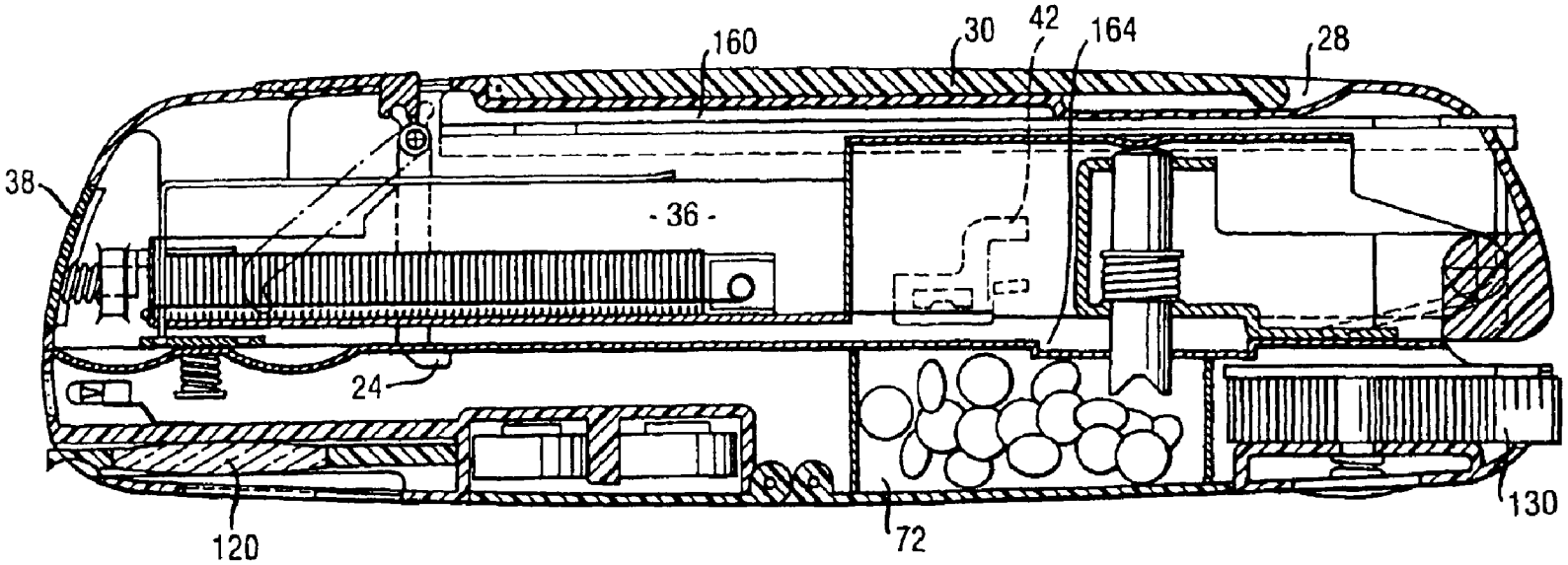
Figure 3:
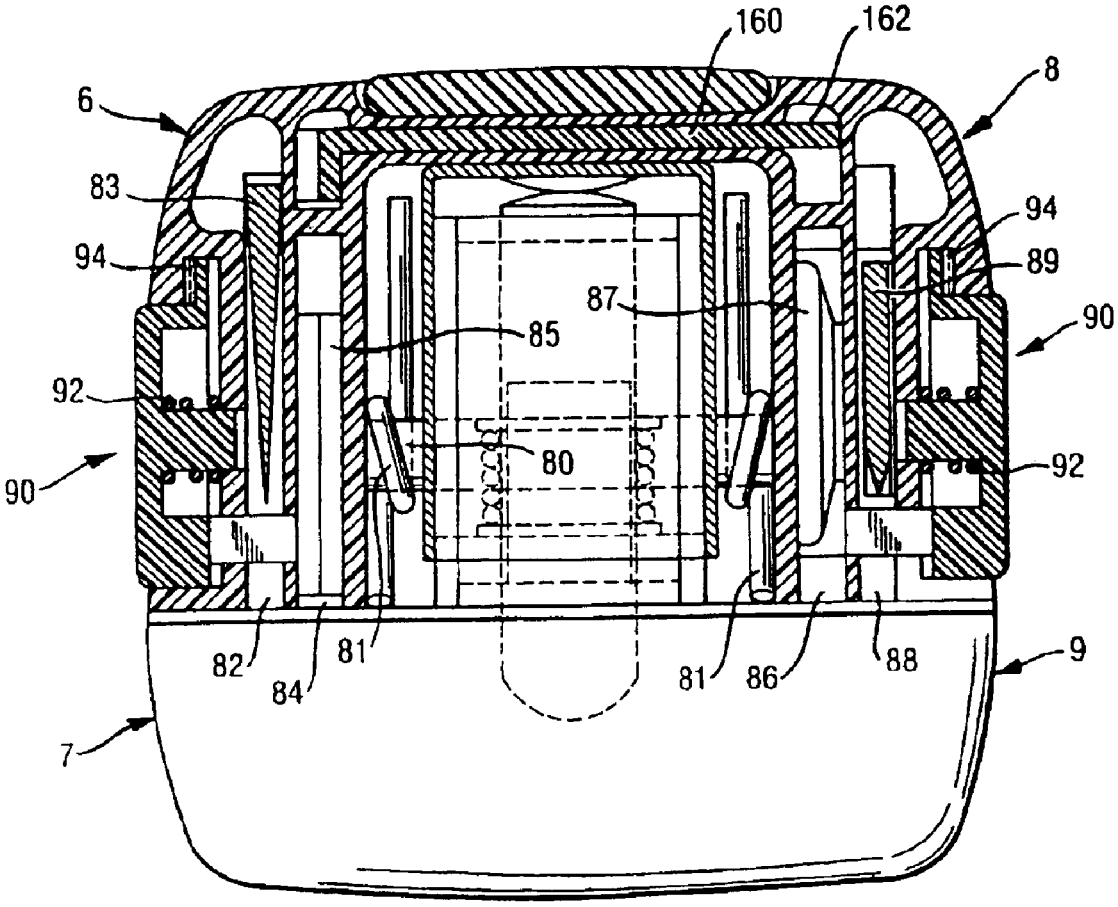
Figure 4:
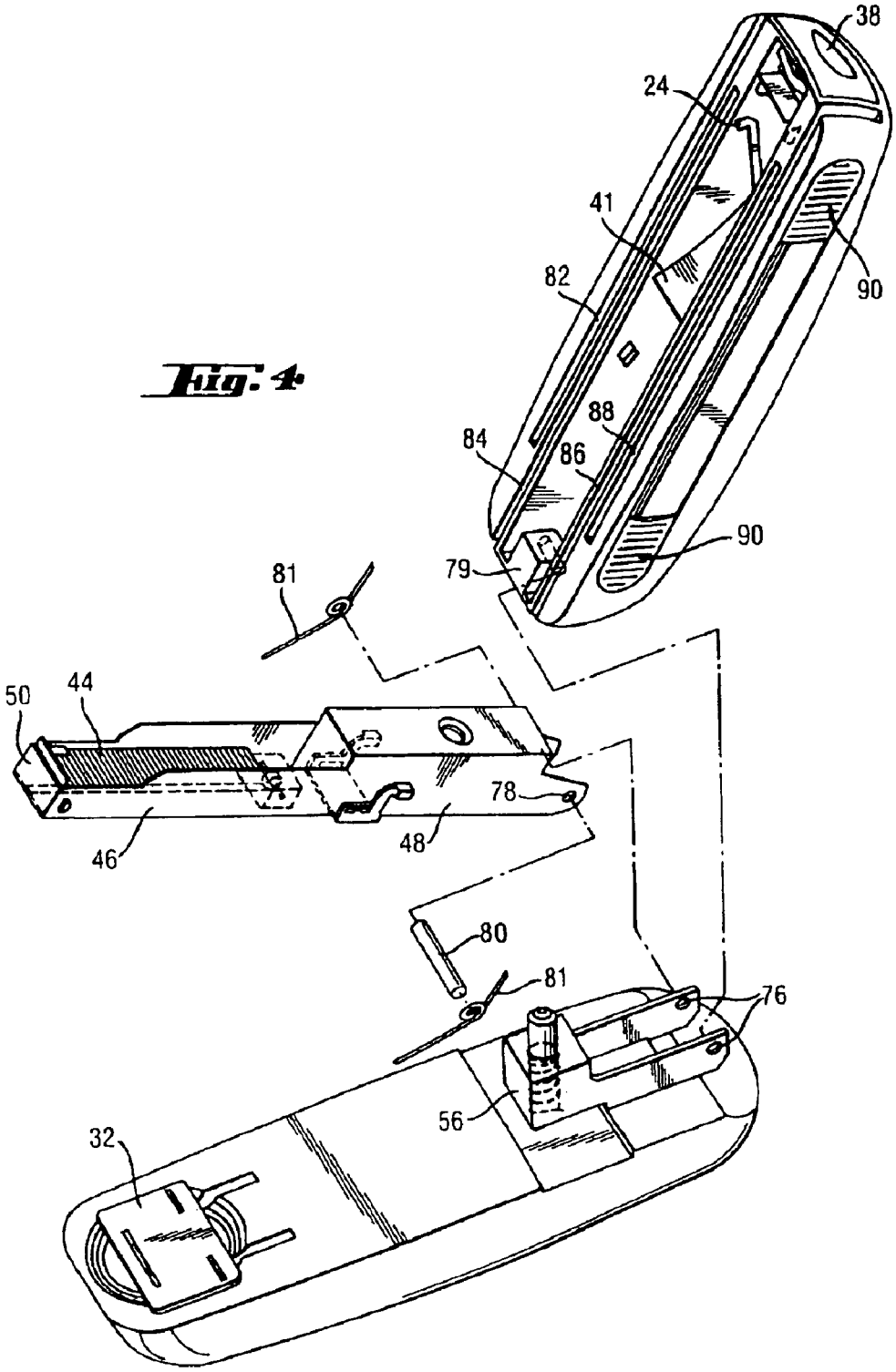
Figures 5, 6:
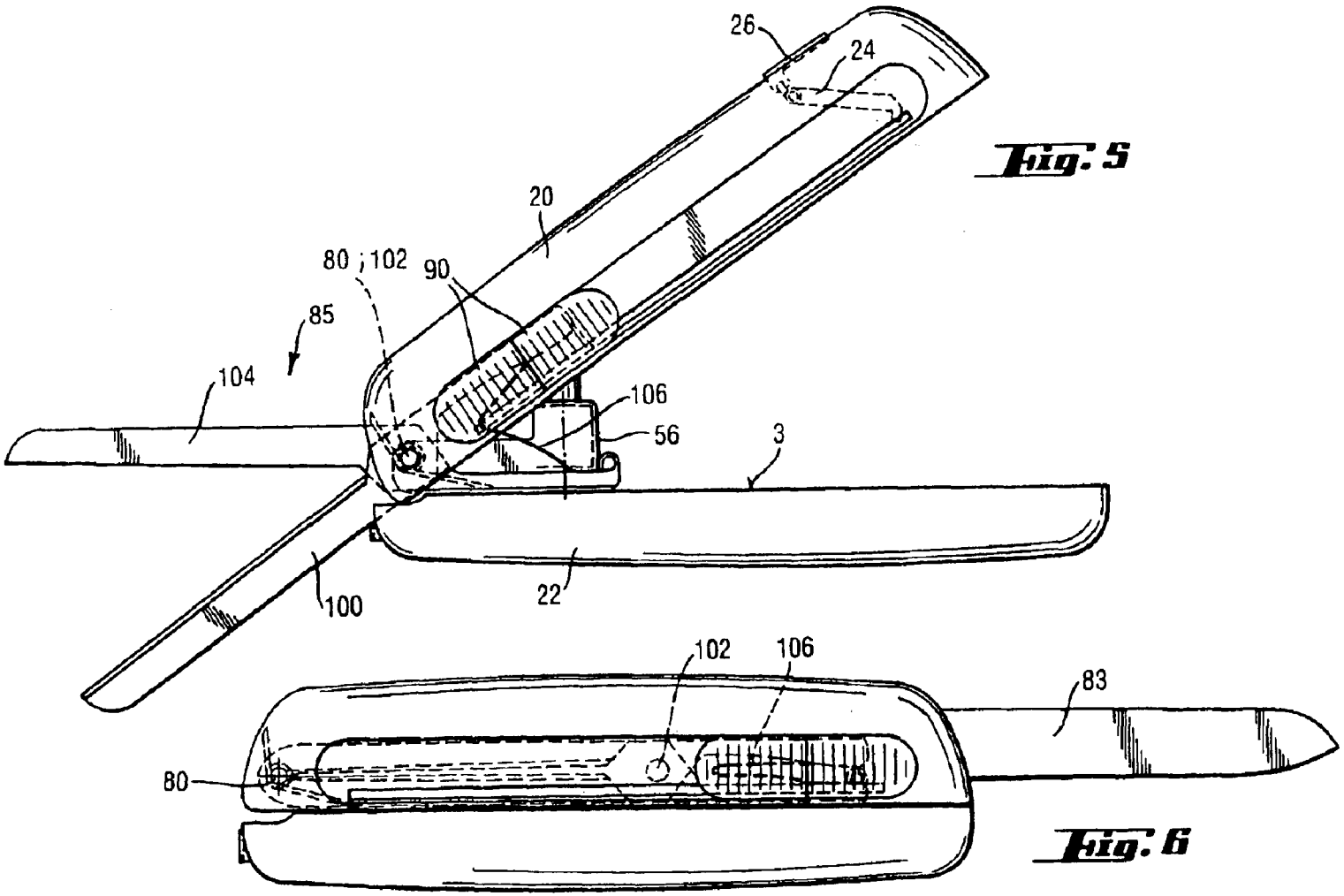
Figure 7:
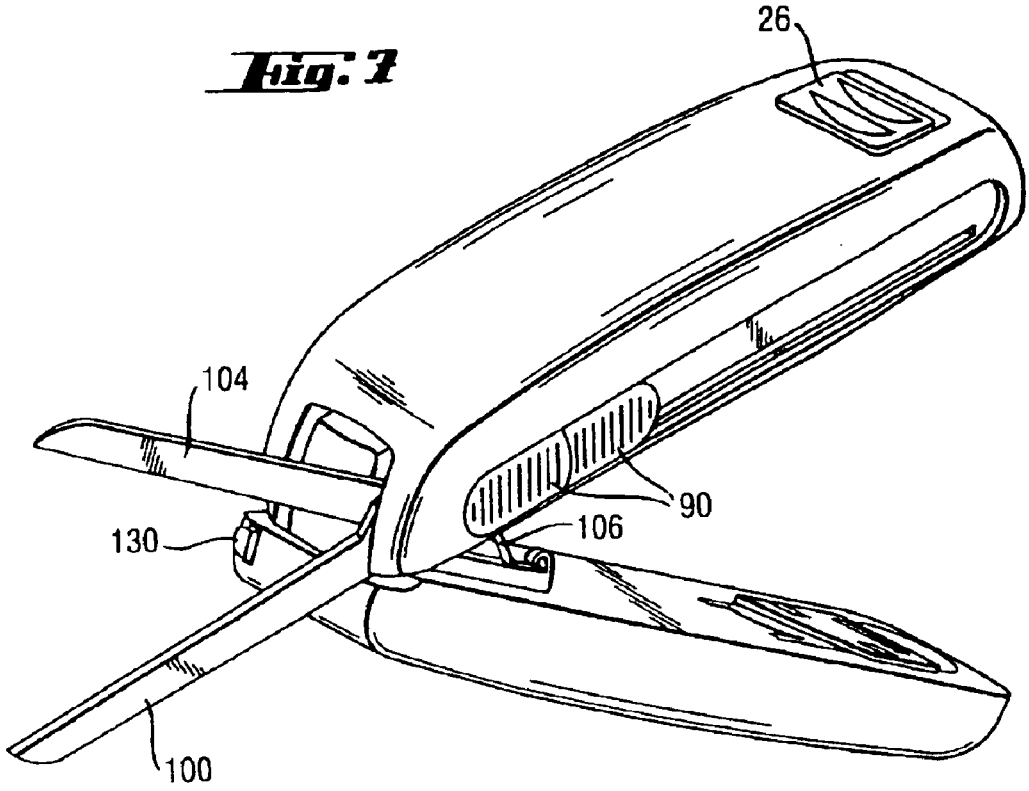
Figure 8:
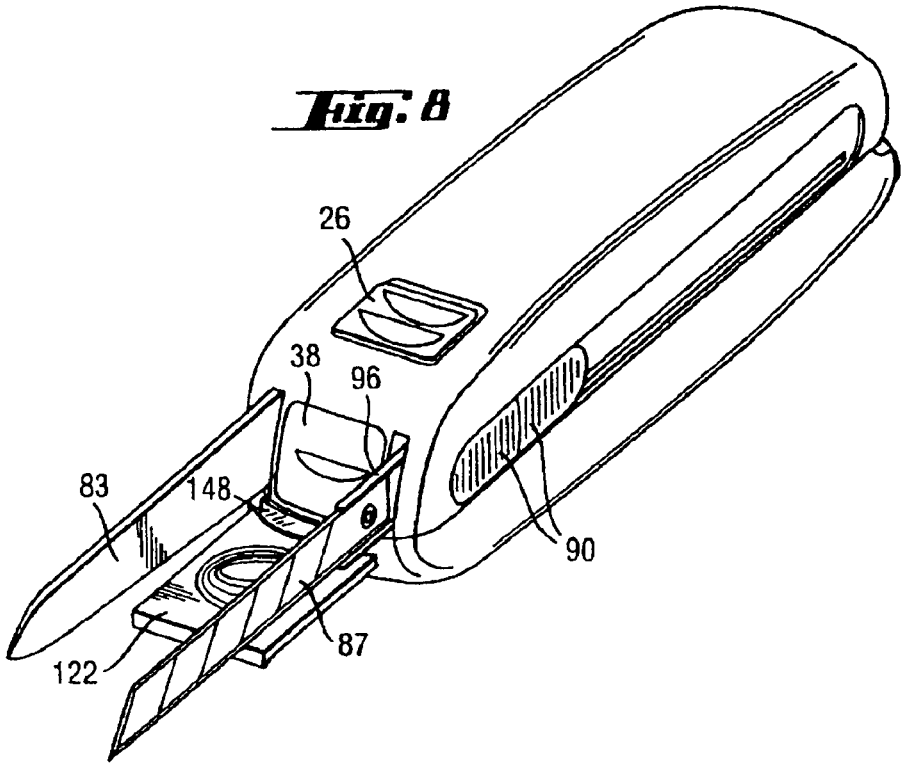
Figure 18:
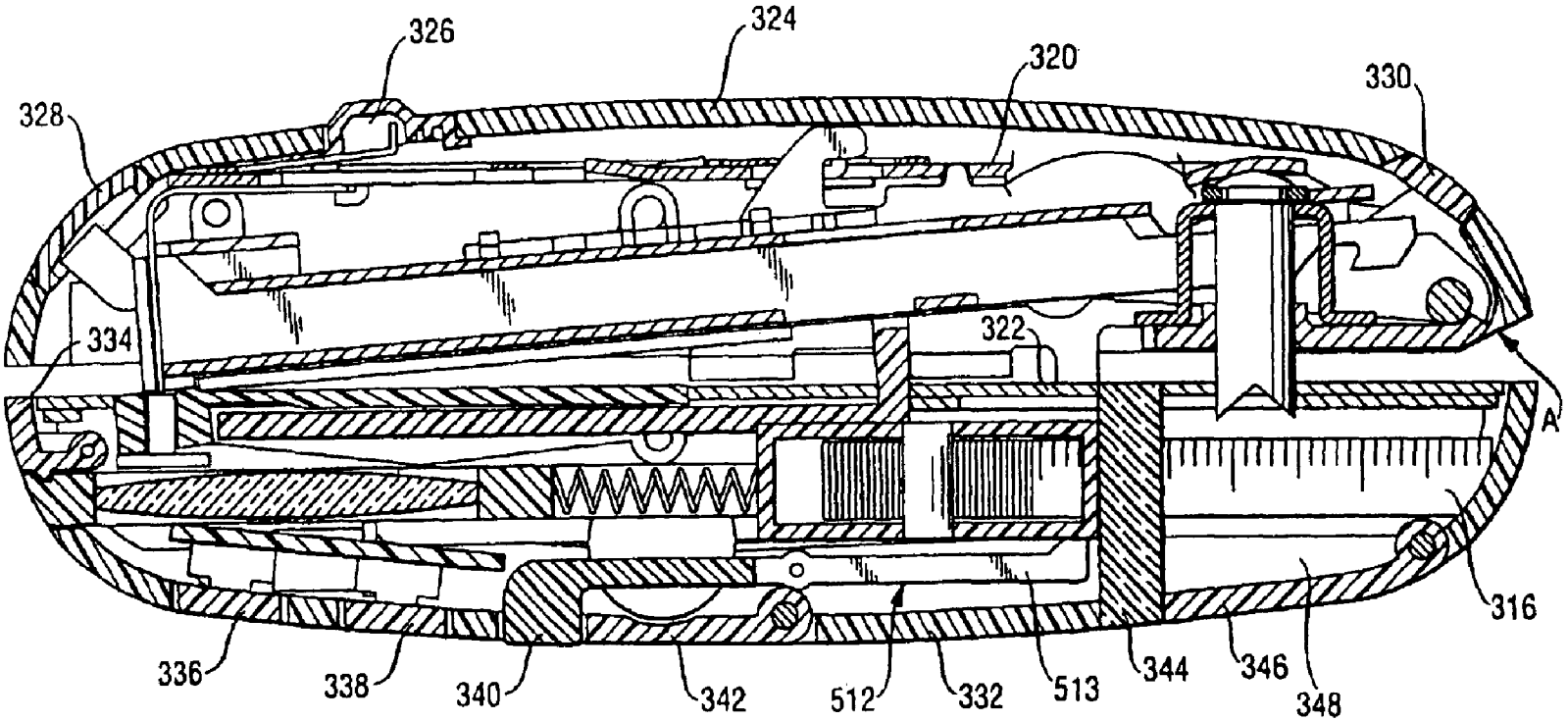
Figure 19:
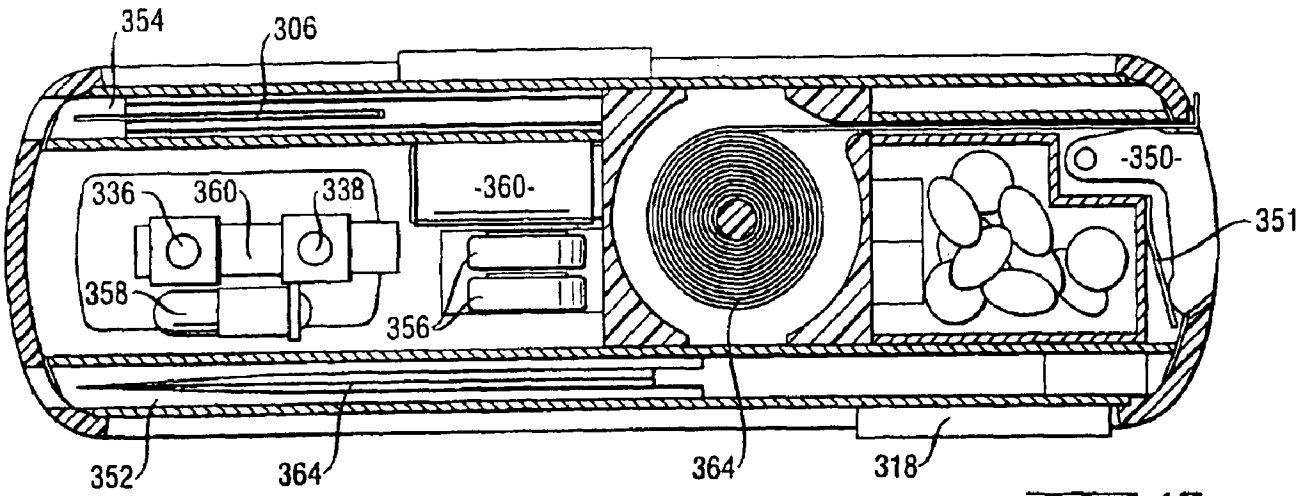
Figure 20:
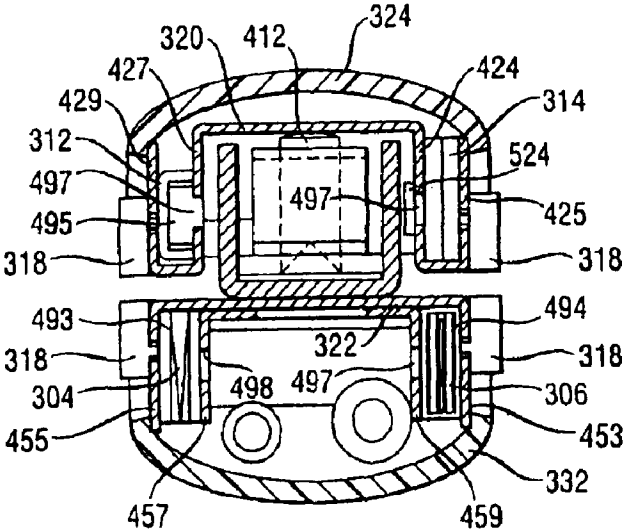
Figure 21:
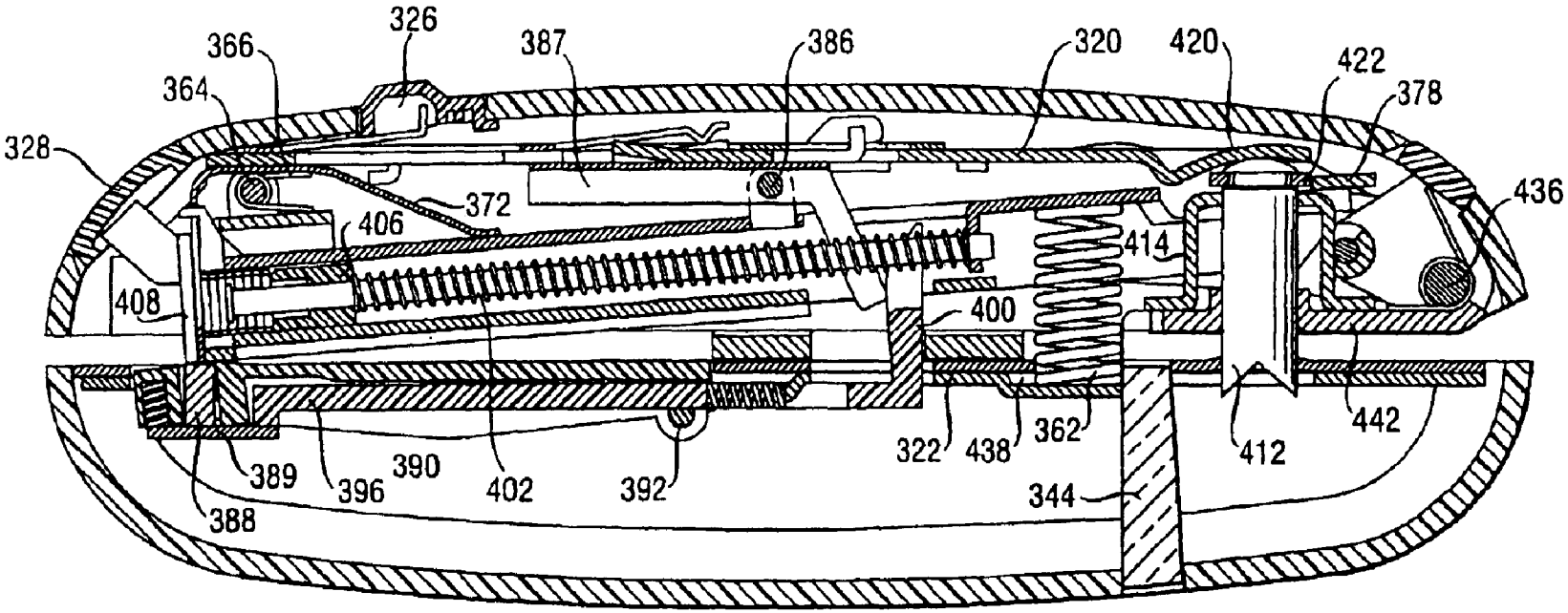
Figure 22:
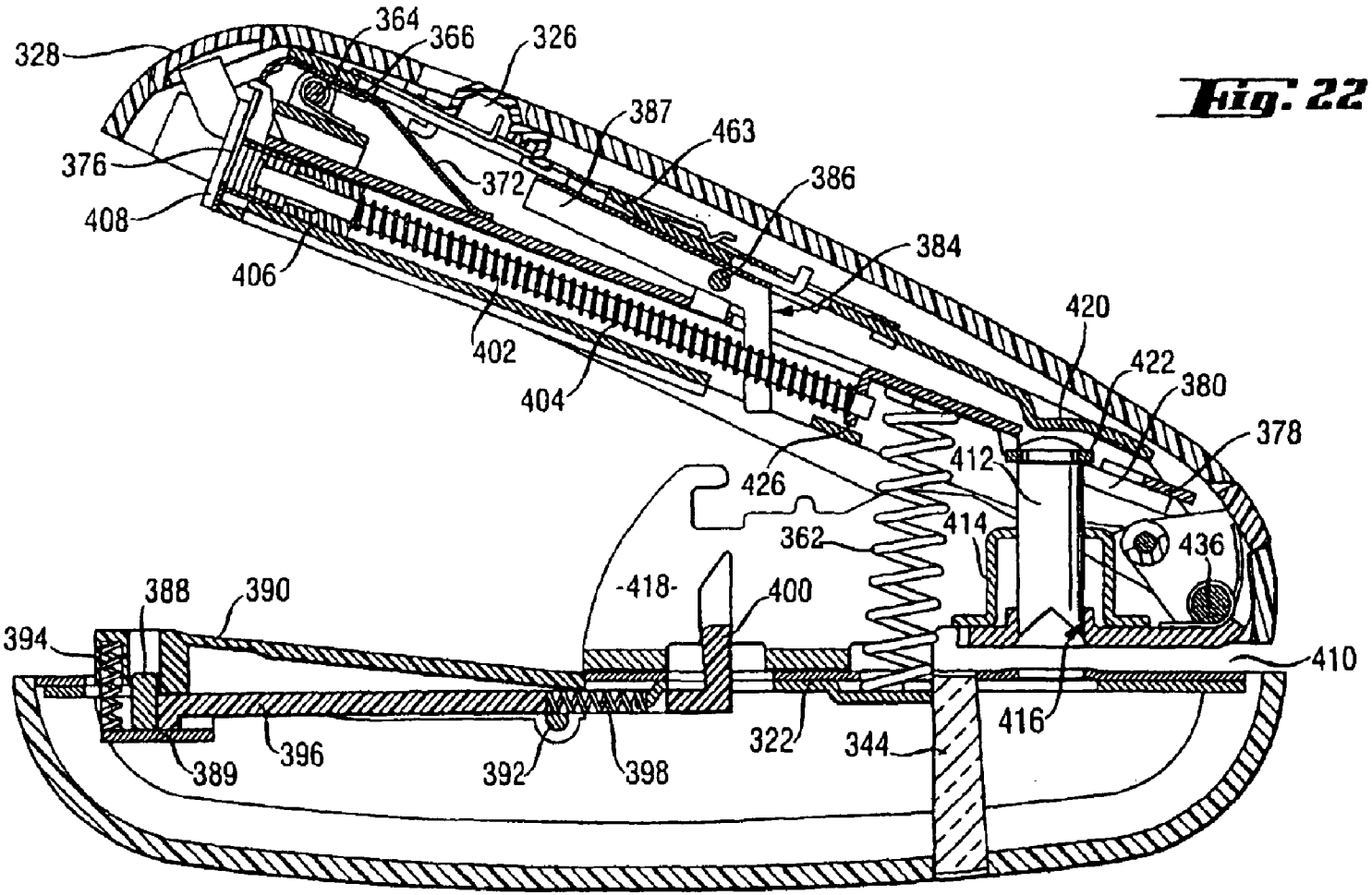
Figure 23:
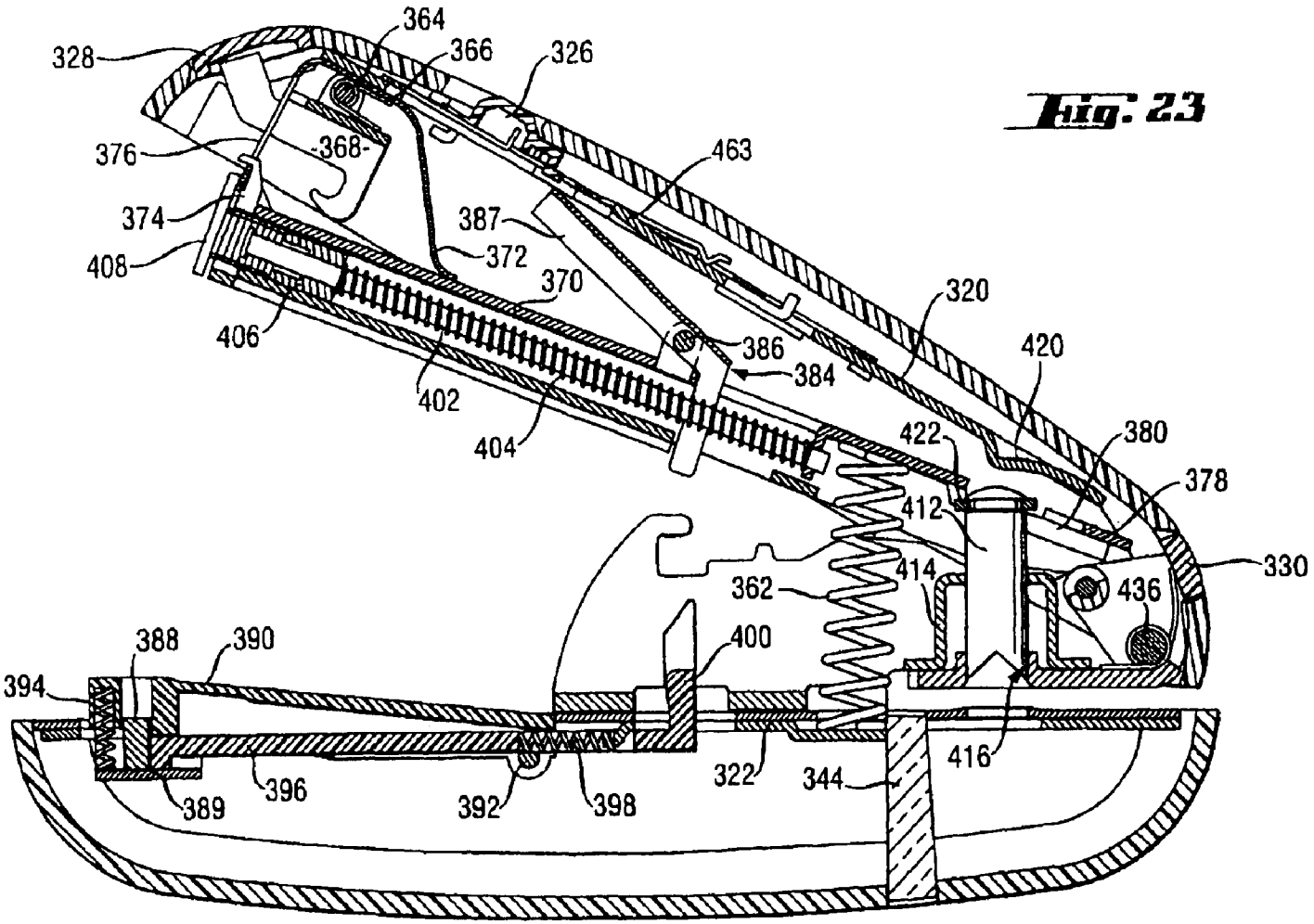
Figure 24:
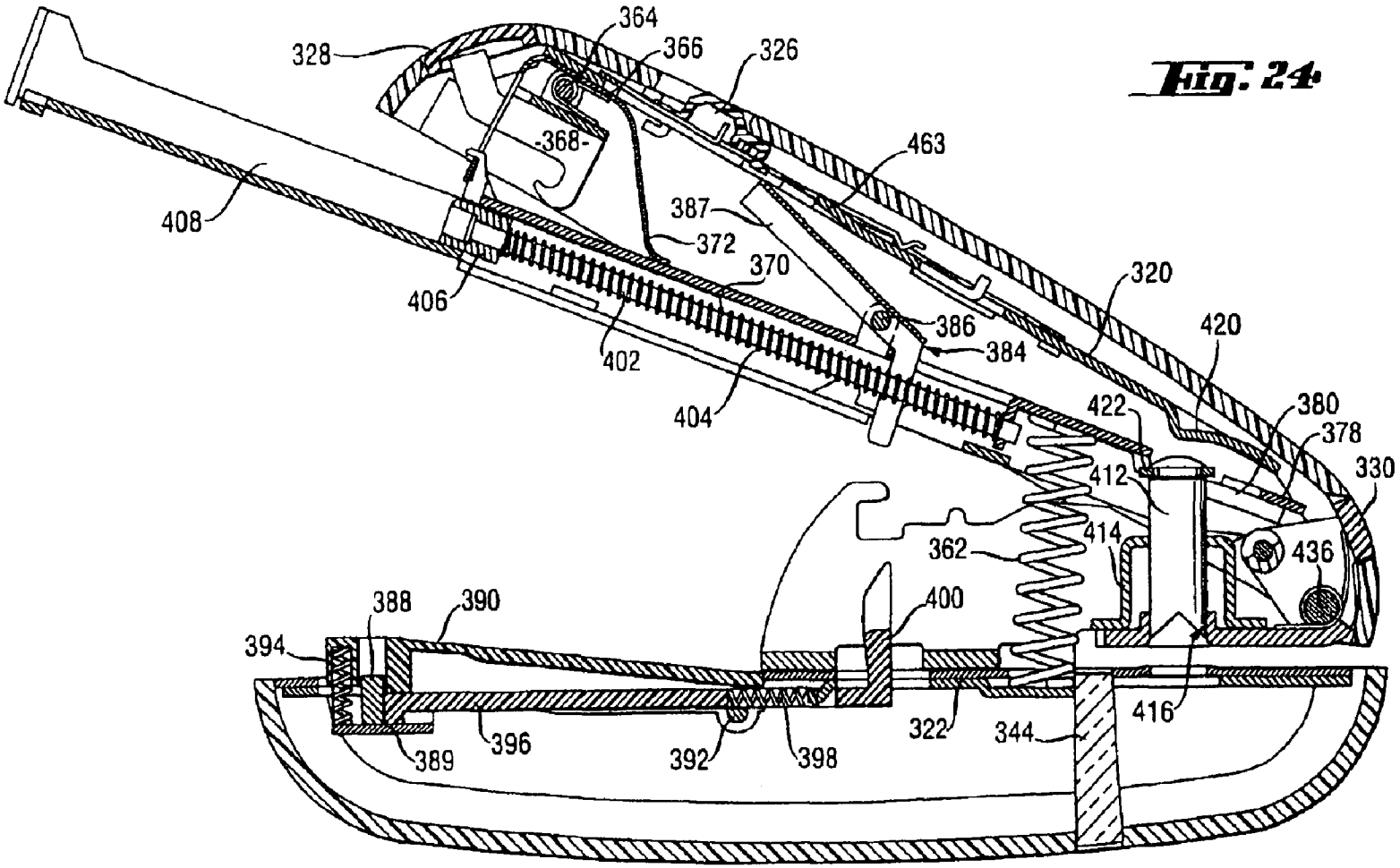
Figure 23A:
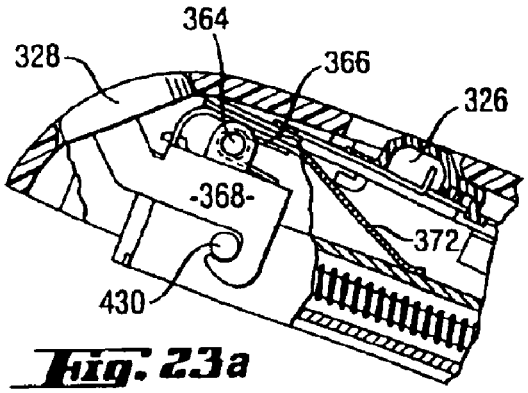
Figure 24A:
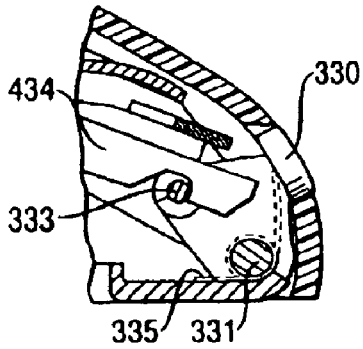
Figure 23B:
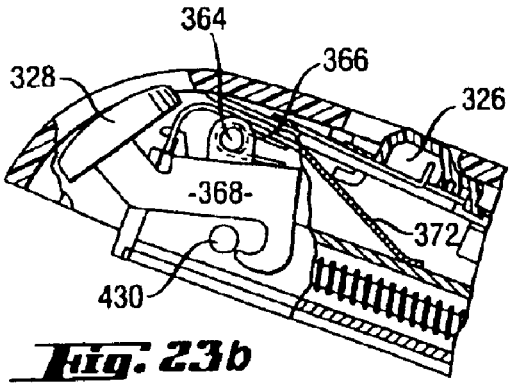
Figure 24B:
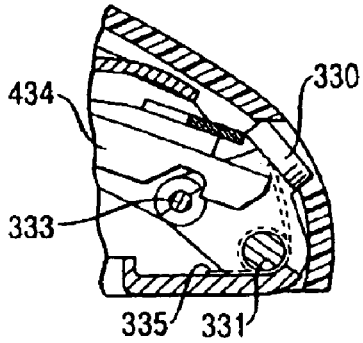
Figure 23C:
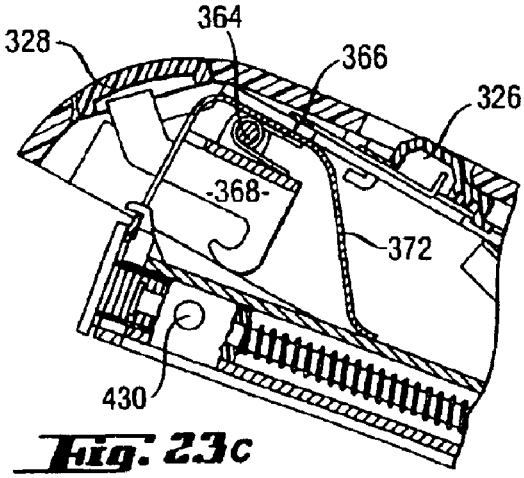
Figure 24C:
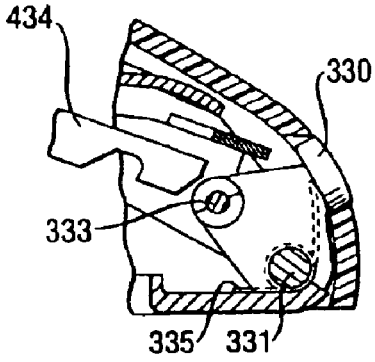
Figure 25:
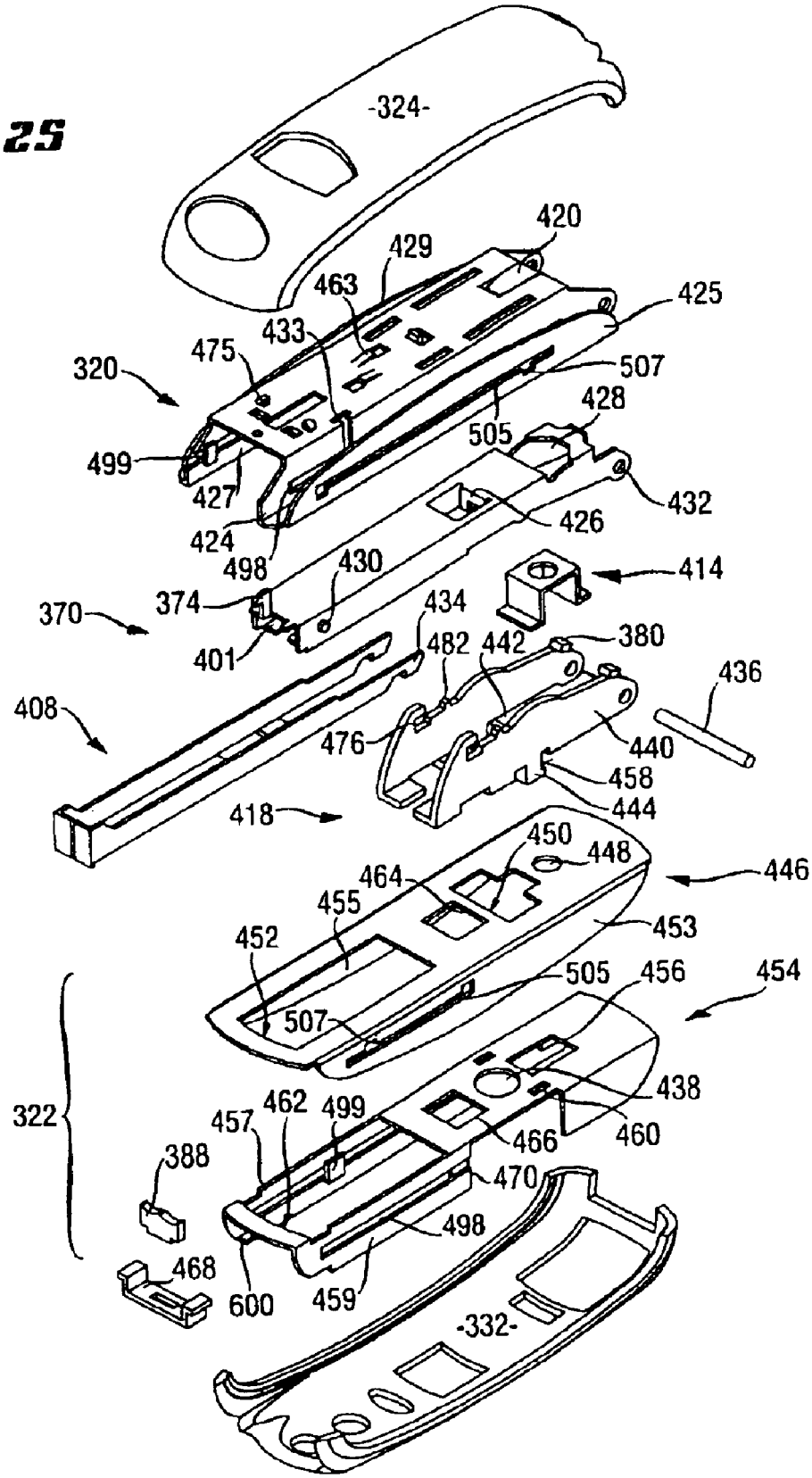
Figure 26:
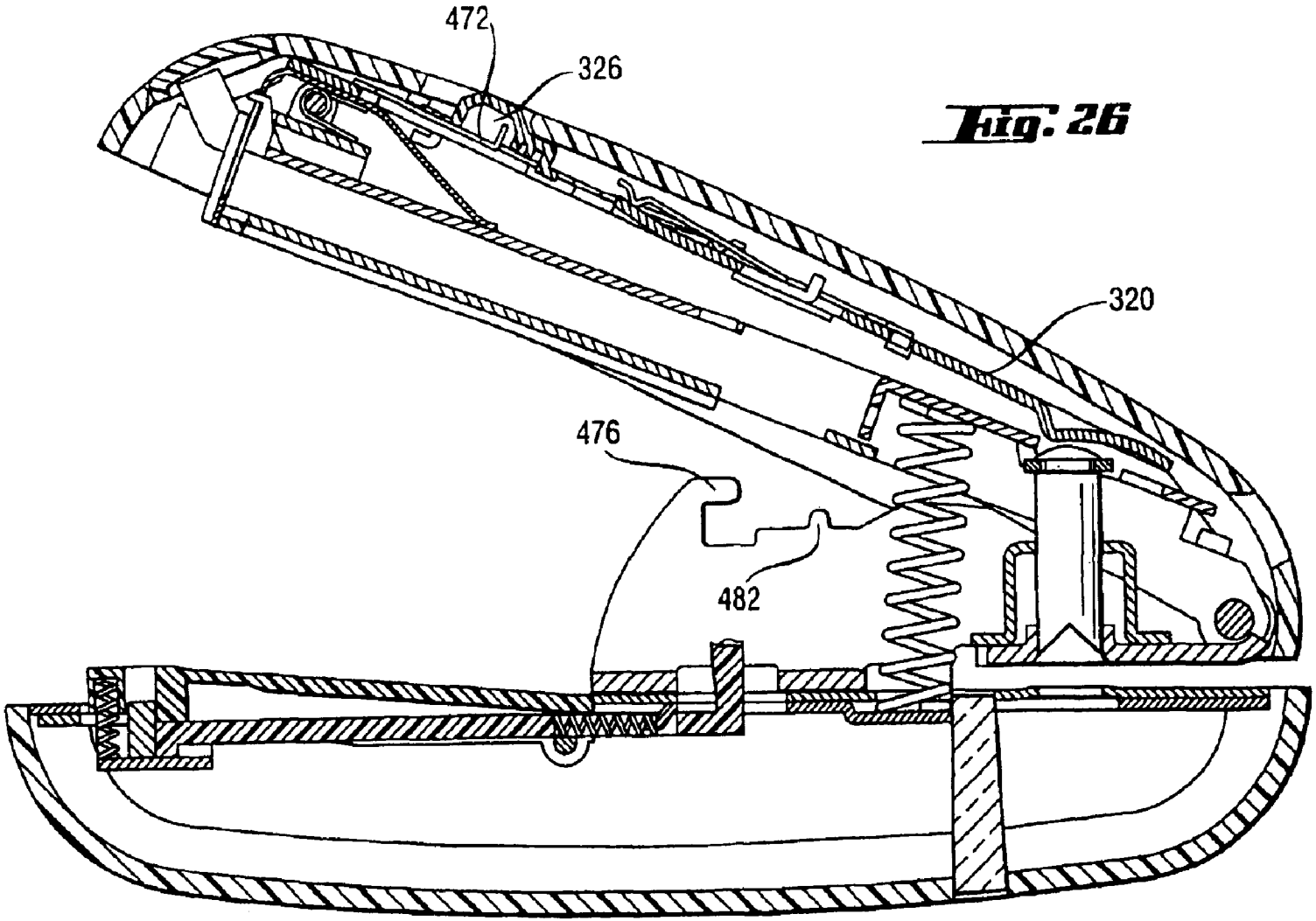
Figure 27:
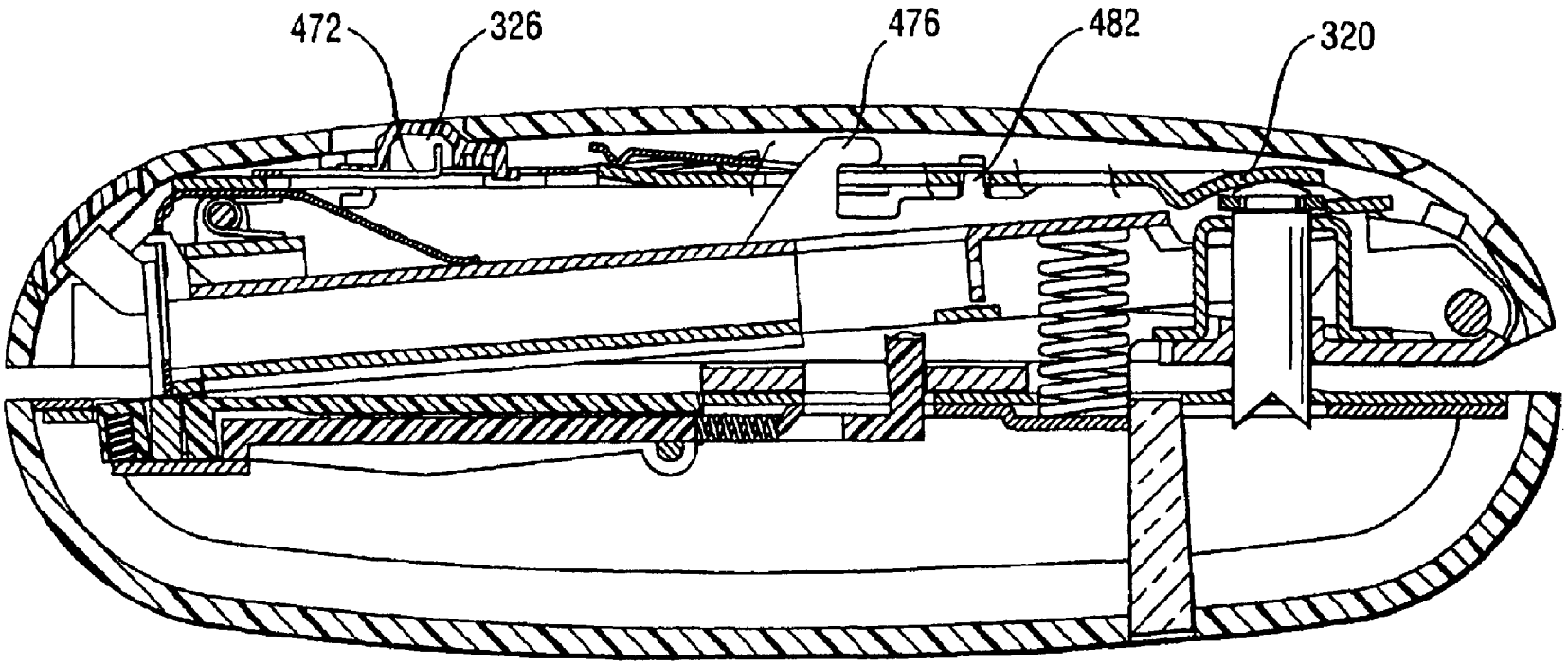
Figure 28:
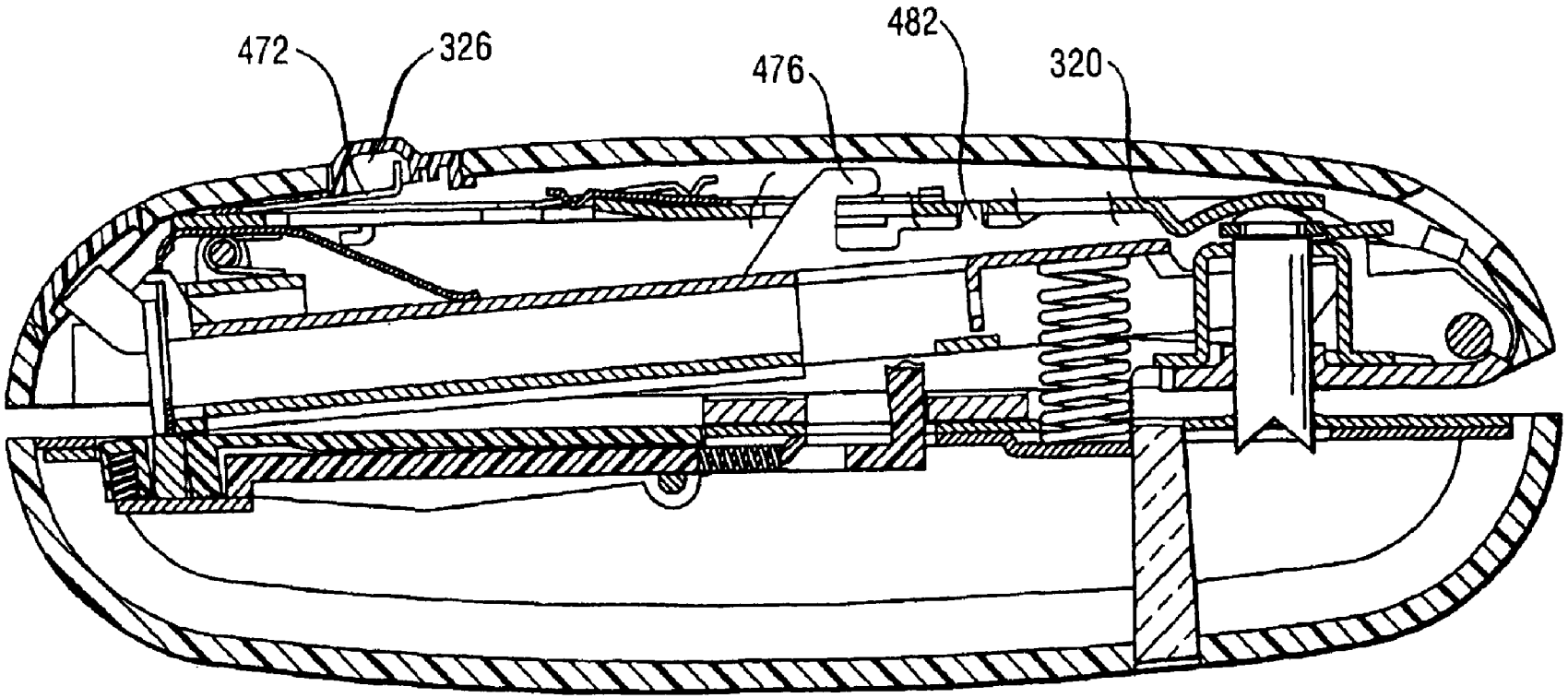
Figure 29:
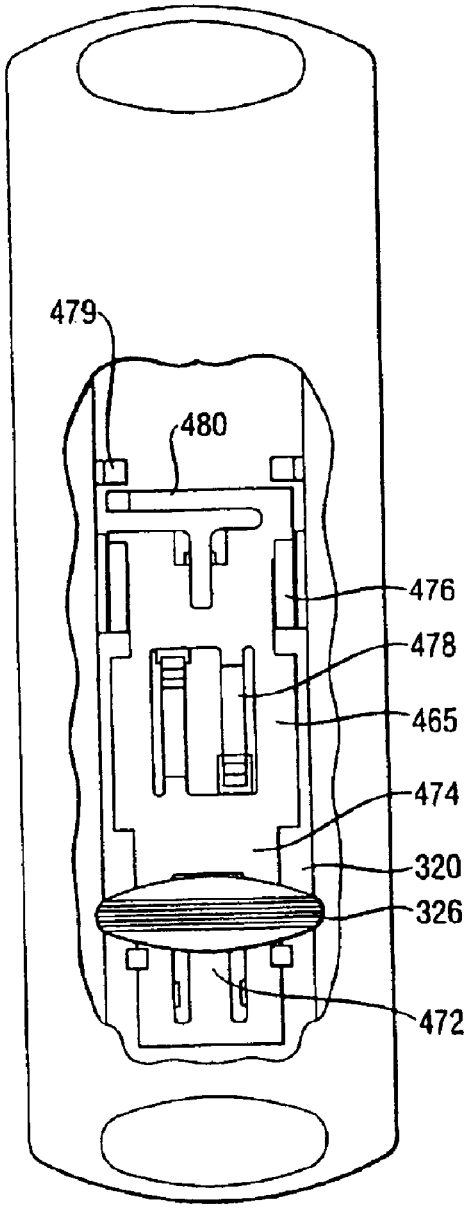
Figure 30:
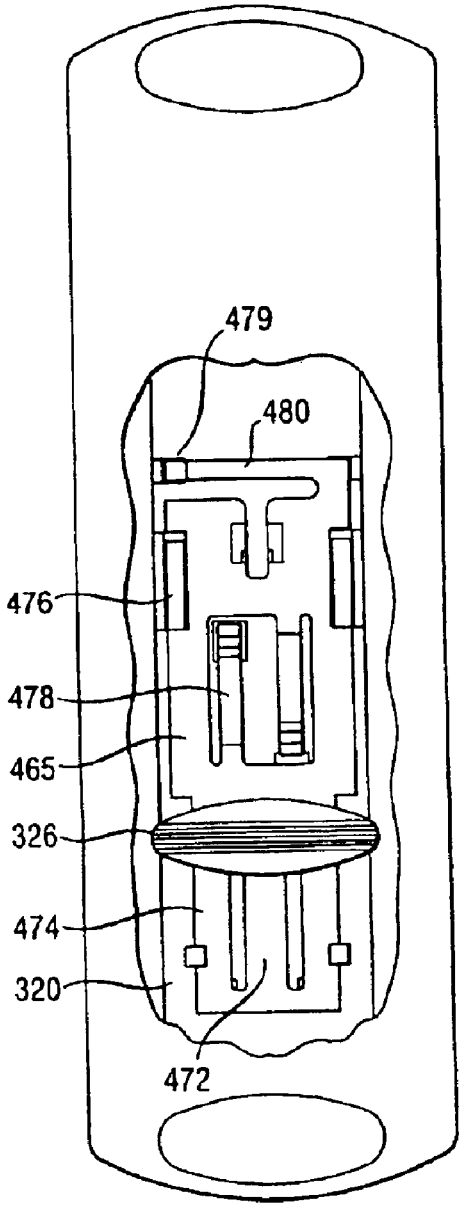
Figure 31:
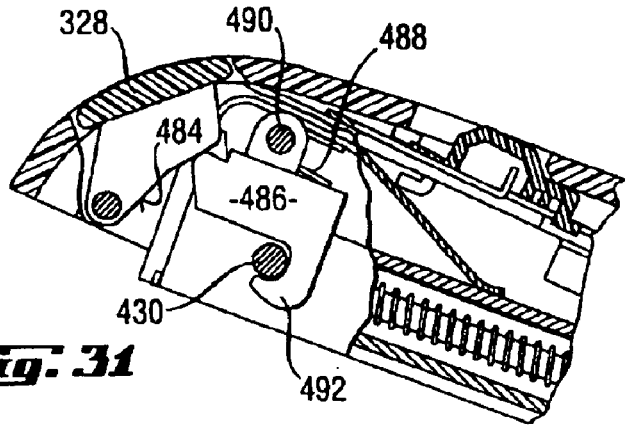
Figure 32:
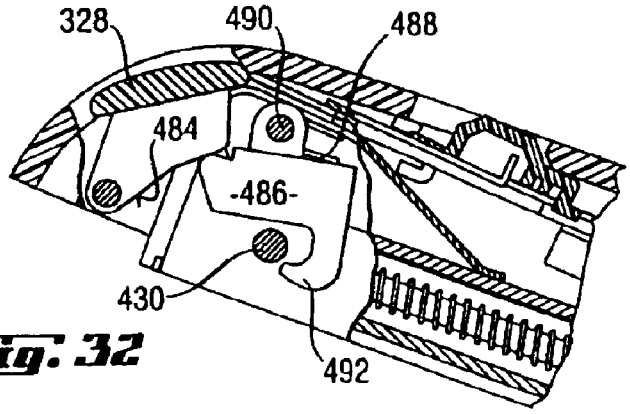
Figure 33:
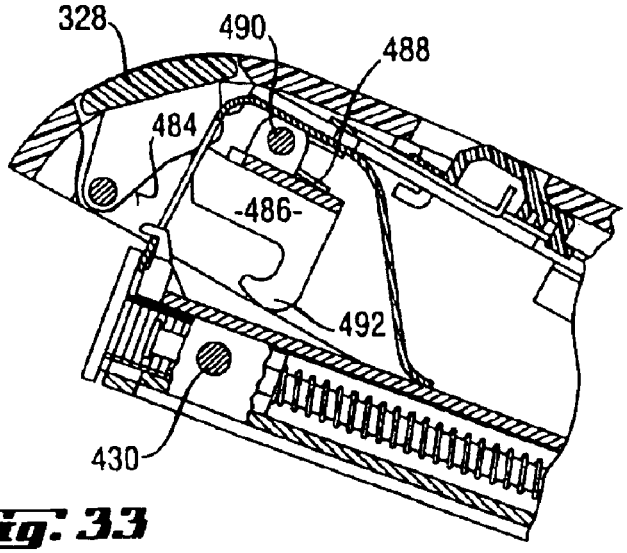
Figure 46:
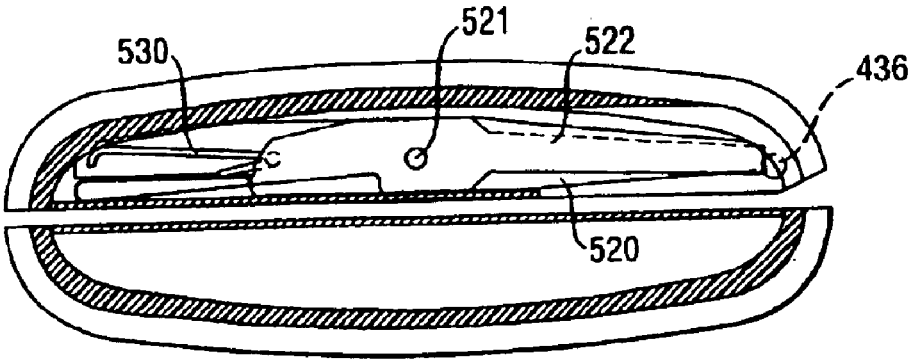
Figure 47:
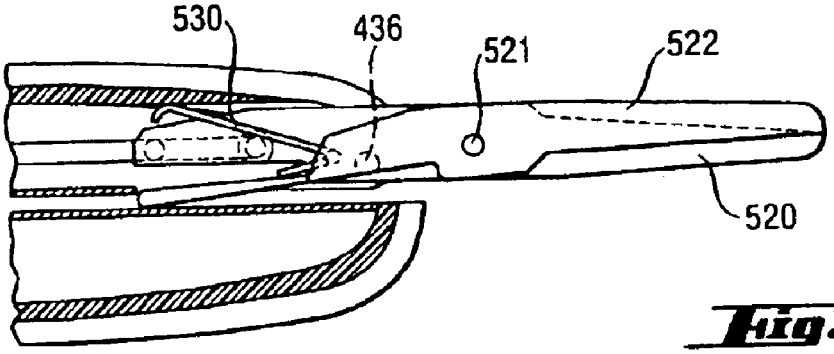
Figure 48:
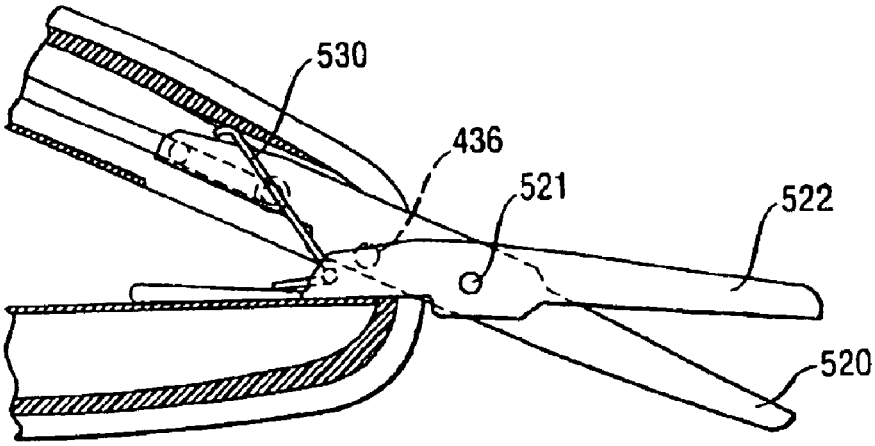
Figure 49:
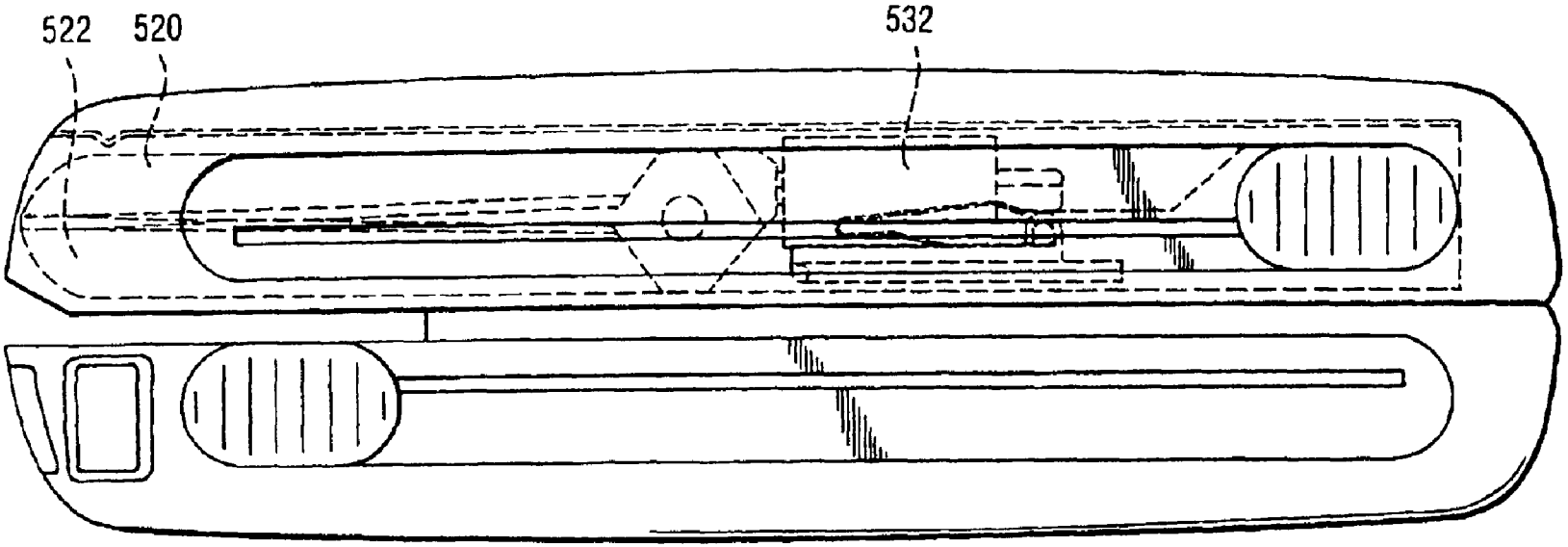
Figure 50:
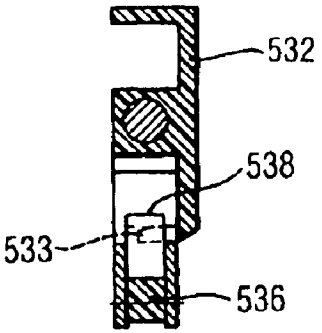
Figure 51:
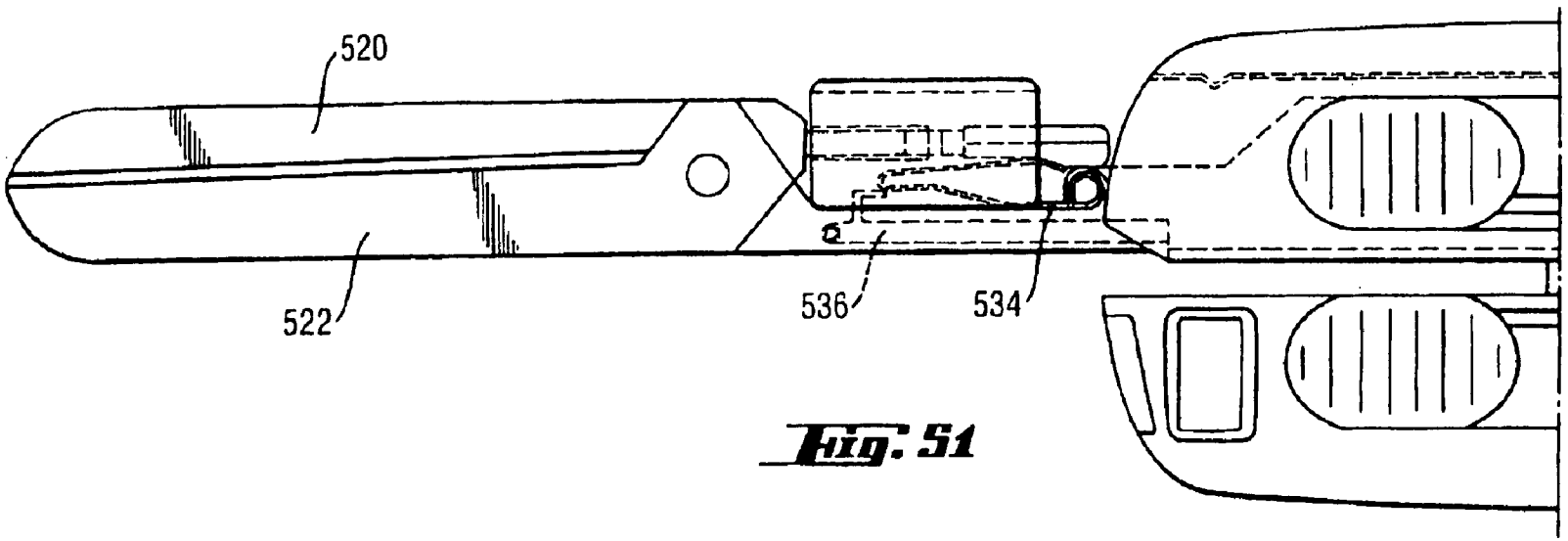
Figure 52:
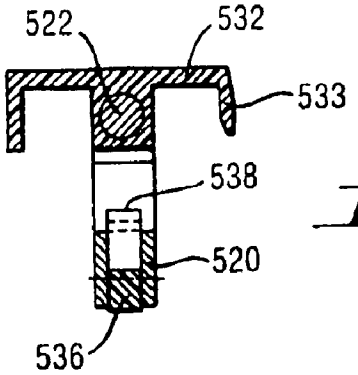
Figure 53:
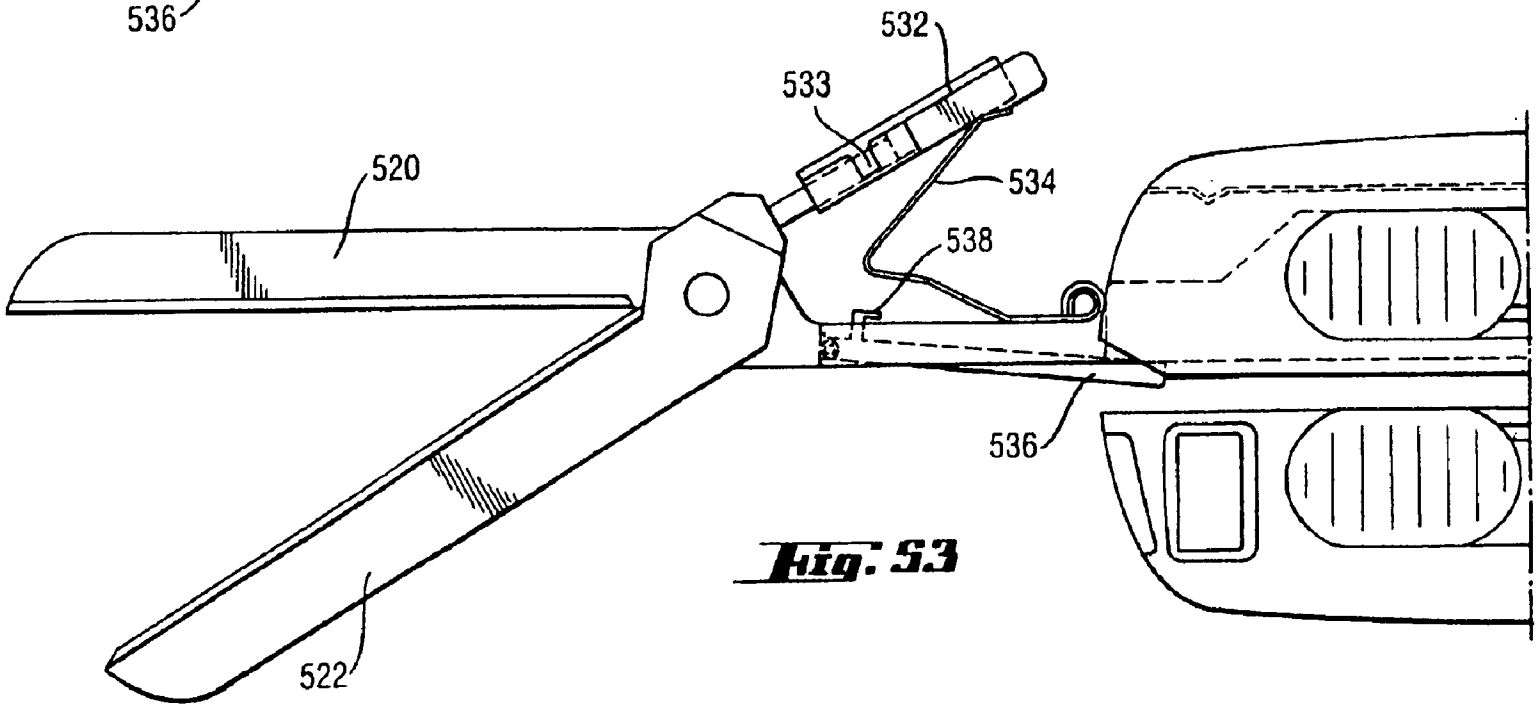
Figure 62:
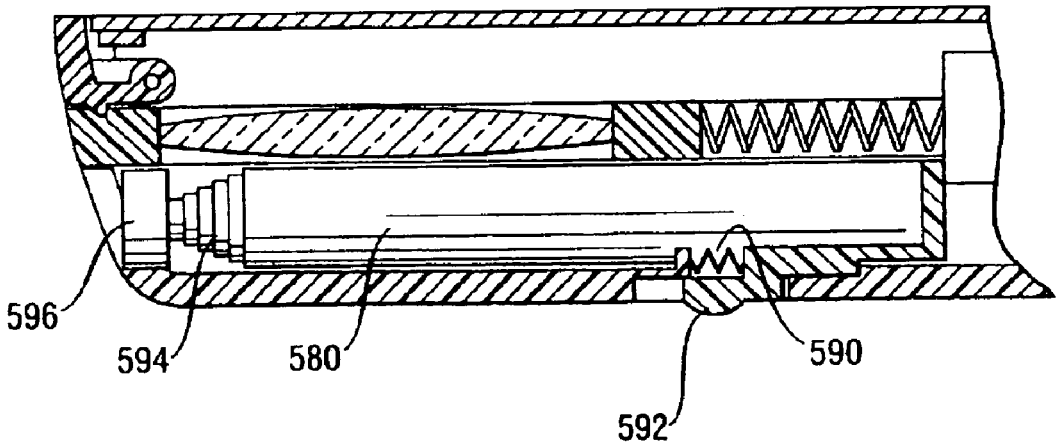
Figure 63:
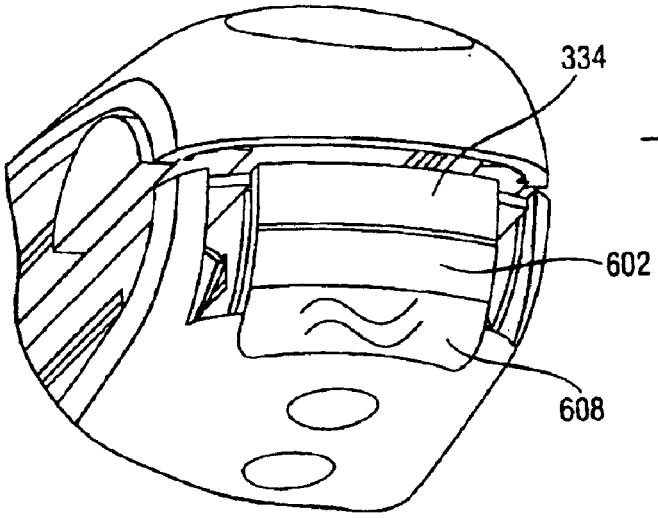
Figure 64:
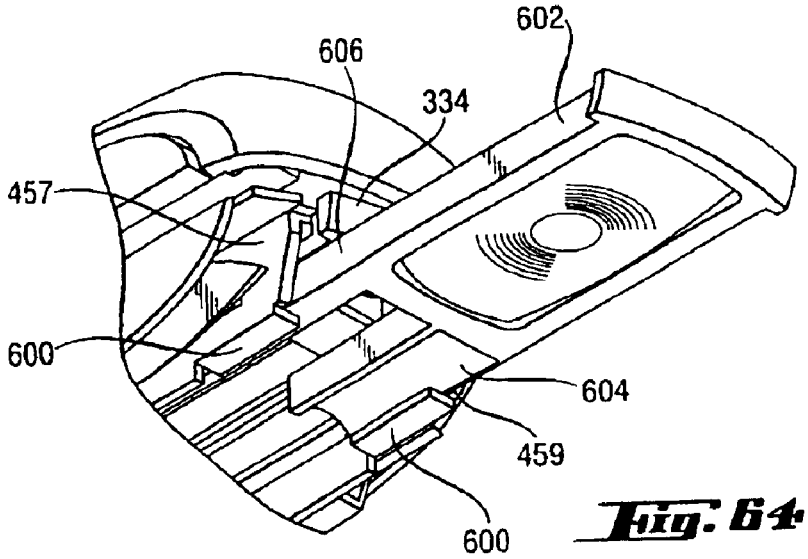
Figure 65:
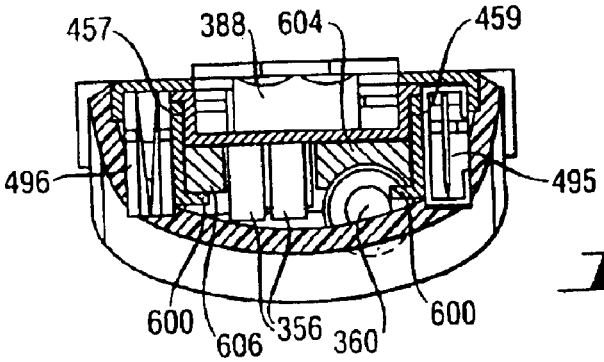

FIG. 1 is a view in longitudinal section of the implement in the open state, FIG. 2 is a view in longitudinal section of the implement in the closed state, FIG. 3 is a cross-sectional view on an enlarged scale, FIG. 4 is a perspective exploded view, FIGS. 5 and 6 respectively show the implement with scissors and letter opener in the use position and/or storage position, FIG. 7 shows a perspective view of the implement with scissors in the use position, FIG. 8 shows a perspective view of the implement with letter opener, cutter and magnifying glass in the use position, FIG. 9 shows a perspective view of the implement with scissors, staple remover and measuring tape, the latter being drawn out to some extent, FIG. 10 shows a perspective view of the implement in the open state with hole-puncher template, FIG. 11 is a partial section of a variant of the hole-puncher function, FIGS. 12 and 13 respectively show the second embodiment of the implement in perspective and in longitudinal section, FIGS. 14 and 15 are two mutually perpendicular sectional views of a variant with adhesive-tape dispenser, FIGS. 16 and 17 show perspective views from two sides of a further, preferred embodiment, FIG. 18 is a longitudinal section through the implement according to FIGS. 16/17, FIG. 19 is a longitudinal section perpendicular to the section according to FIG. 18, in the vicinity of the underside of the implement, FIG. 20 is a cross-section in the vicinity of the hole-puncher mechanism, FIGS. 21 to 24 show, in longitudinal section, the implement of FIGS. 16/17 in four different functional positions, FIGS. 23*a*–23*c* are details relating to FIG. 23, FIGS. 24*a*–24*c* are details relating to FIG. 24, FIG. 25 is an exploded view of the "skeleton" of the implement, FIGS. 26 to 30 serve to illustrate the opening and closing mechanism, FIGS. 31 to 33 show a variant of the locking mechanism, FIGS. 34 to 39 show the design of slide-action locking bars, FIG. 40 shows a detail of the safety lock, FIGS. 41 to 45 illustrate the scissors mechanism, FIGS. 46 to 48 show a variant of the configuration of the scissors, FIGS. 49 to 53 show a further variant of the scissors, FIGS. 54 to 57 serve to illustrate the cutter tool, FIGS. 58 to 61 relate to the staple remover, FIG. 62 shows a detail of a variant of the implement, FIGS. 63 to 65 relate to the magnifying-glass arrangement, FIGS. 66 to 69 illustrate the punching chamber, and FIG. 70 shows a perspective view of an alternative outer configuration of the implement.

GENERAL CONSTRUCTION

The implement presented here is a multipurpose hand-held implement, in particular for office work. The implement comprises a first component in the form of an upper shell 20 and a second component in the form of a lower shell 22. The shells respectively have base surfaces 2 and 3 which are directed towards one another, top surfaces 4 and 5 which are directed away from one another, side surfaces 6, 8 and 7, 9, and end surfaces 10, 12 and 11, 13. The term "shell" already indicates that the two components have a number of cavities. The components may consist of metal or plastic; it is also possible to have combinations in which, for example, plastic covers are positioned, preferably snapped, onto metal cores.

The upper and lower shells are connected by means of an articulation and are pushed apart from one another by a spring arrangement. Pivot movements of the two shells relative to one another permit the actuation of certain utensils, in the present case a pair of scissors, a hole puncher and a stapler. Other utensils are accommodated in cavities of the upper and lower shells and, for use purposes, are pushed or drawn out of said shells, of if appropriate are removed completely therefrom.

The upper and lower shells rest with congruent contours of their base surfaces 2, 3 one above the other and, in the locked state, form a closed body of the pocket-knife type. The locked state is secured by means of a double locking bar 24 which can be unlocked by means of a locking-mechanism or unlocking button 26.

Found on the top surface 4 of the upper shell is a hollow 28 in which there is located a clip 30 which is articulated on the upper shell such that it can be pivoted through a small angle and which makes it possible for the implement to be hooked in a pocket or the like.

A compartment, e.g. for adhesive tape or adhesive labels, may be provided in or beneath the clip 30.

The Stapling Mechanism (FIGS. 1, 2, 4)

A staple magazine, the stapling ram, a magazine spring and a securing button are located in the upper shell. The two locking bars of the abovementioned locking mechanism are located on either side of the staple magazine.

The lower shell contains the anvil 32, which is provided in a known manner with a stamped impression for inward stapling and with one for outward stapling and can be drawn out of a positively locking recess of the lower shell, and rotated, counter to the prestressing of a spring 34.

The staple magazine 36 can be pivoted relative to the upper shell around the same articulation as the upper shell is pivoted relative to the lower shell. This element here is a part which has been formed by punching and bending and can assume three positions relative to the upper shell: when the implement is closed, it is pushed into the upper shell (FIG. 2), and a spring-loaded hook 40 provided on the securing button 38 latches in and holds the magazine. Therefore, for each following stapling operation, the securing button has to be actuated first of all in order for the magazine to pass into the operating position under the prestressing of the magazine spring, here a leaf spring 41. This operating position is defined relative to the upper shell by a locking bar 42; in this position, the foremost staple of a staple block 44 is located beneath the stapling ram and above the selected stamped impression of the anvil.

In its front, the staple-receiving part 46, the staple magazine is designed with an upwardly open U-profile into which the staples can be introduced from above. In its rear section 48 connecting it to the articulation, in contrast, it forms a downwardly open hollow profile in order to leave space for the hole-puncher mechanism. For this reason, it would be difficult also to accommodate an advancement compression spring behind a staple block 44; use is thus made here of a clock spring, of which the free end is fixed in the vicinity of the staple stop 50 and which is received rotatably in the advancement block 52.

For the subsequent loading of a new staple block 44, the locking bar 42 is displaced and the magazine pivots into the position indicated by chain-dotted lines in FIG. 1, in which the magazine is accessible from above.

A stiffening bead 54, the function of which will be explained at a later point in the text, is stamped in the connecting section 48.

Articulation and Hole-Puncher Mechanism (FIGS. 1, 3, 4)

A single-piece part which has been formed by punching and bending and forms a punch guide 56 and a bearing block 58 is mounted on the lower shell. The rectilinearly guided punch 60 is seated in the punch guide and rests, by means of its collar 62, against the inside of the top plate 66 of the punch guide, under the action of a restoring spring 64. Located beneath the punch guide is a push-in slot 68 for a sheet which is to be punched, and a die 70 is provided in alignment with the punch. A chamber 72 for receiving the punchings is located beneath said die. Emptying takes place by the flap 74 being opened.

If the upper shell is pushed towards the lower shell, the bead 54 comes into contact with the upper side of the punch and actuates the latter, that is to say displaces it until it passes through the die 70 to the full extent.

The bearing block 58 is formed by two parallel legs of the punched and bent part which extends in the direction of the ends of the shells. They have aligned holes 76 passing through them, which holes are congruent with respect to similar holes 78 in the connecting section of the staple magazine. An articulation bolt 80 passes through the pairs of holes 76/78, when they have been positioned congruently with respect to one another, and the bearing block 79 of the upper shell and projects beyond the holes 78 on either side. In each case one leg spring 80 is positioned, by means of its coil, on said projecting stubs, and the arms of said leg springs are supported on the upper and lower shells. Accordingly, the shells are prestressed in the opening direction. Their opening angle is delimited by interacting stops on the upper and lower shells.

Slide-Action Utensils (FIGS. 3, 5 to 9)

Accommodated in chambers or channels 82, 84, 86, 88 of the upper shell which are open towards the lower shell and on an end side in each case are utensils which can be pushed out of the associated end-side opening. Channel 82 receives a knife blade (or a letter opener) 83; channel 84 receives a pair of scissors 85; channel 86 receives a staple remover 89; channel 88 receives a so-called cutter 87, which is a cutting implement with break-off part-blades. Common to all four utensils is the fact that they are connected, via guided shanks, to an operating element in the form of a sliding button 90. The four buttons are guided in pairs in longitudinal grooves of the upper shell and are pushed outwards into latch-in recesses or arresting means by springs 92. The letter opener, scissors and staple remover only have an inner and an outer latch-in position, whereas the cutter has a latch-in position for each break-off blade.

It can be seen, in particular, from a comparison of FIGS. 5 and 6 that

- the utensils accommodated on the same side of the staple magazine are pushed out of opposite ends of the implement,
- in which case the sliding button of one utensil delimits the push-out path of the other, and
- a pushed-out utensil prevents the respectively other utensil from being pushed out.

Apart from the fact that, in the case of the cutter, a new line of blades can be introduced after the last part-blades have worn out—indicated at 91 in FIG. 8—the letter opener, the cutter and staple remover do not have any special features.

Scissors (FIGS. 5 to 7)

Besides the hole puncher and the stapler, the pair of scissors 85 is the third utensil which is actuated by the two shells 20 and 22 being pushed together.

The scissors comprise four parts: guided blades 100, to which the associated sliding button is connected, articulation pin 102, articulated blade 104, and scissors spring 106. Each blade has a cutting-edge part on the near side, and an actuating part on the far side, of the scissors articulation, the actuating part of the blade 100 simultaneously being the shank thereof. The scissors spring 106 is arranged between the actuating parts and tends to spread these apart from one another; this is only possible, however, when the scissors are pushed out into their operating position because, until then, the blade 104 rests, with its cutting-edge part, against the base of the channel 84. In the operating position of the scissors, the articulation pin of the latter is at least approximately in alignment with the articulation bolt 80, and the articulated blade 104 is held in position against the base surface 3 of the lower shell 22 by the pressure of the scissors spring 106. When the scissors are retracted again by means of their sliding button, the scissors close automatically by virtue of the blade 104 running onto the upper shell 20.

Draw-Out Utensils (FIGS. 1, 2, 8, 9)

The lower shell 22 also contains utensils. A magnifying glass with a lens 120 and mount 122, which is accommodated in a recess 124, can be seen in FIG. 1. In the pushed-in position (FIG. 2), a finger-engagement hollow 126 projects beyond the contour of the lower shell 22 to some extent.

In the space beneath the articulation, the lower shell contains a roll-up measuring tape 130. In a manner known per se, the tape is wound onto a hub 132 which is provided with a self-locking device and prestressing spring 134, the self-locking device being released, and the measuring tape being drawn in, by pressure on the release mechanism 136. In the drawn-in position, a cutout 138 of the lower shell makes it possible for the end of the measuring tape to be gripped (FIG. 2).

Stationary Utensils (FIGS. 1, 2, 13)

Located in the lower shell is a lamp 140, which is fed by button cells 142 or rod-type cells 144 (FIG. 13). The switch 142 is located beneath the magnifying-glass receiving means; the light passes out through a transparent window 148 which has been introduced into the body of the lower shell. In the embodiment according to FIG. 13, a miniature laser arrangement with associated optics 150, namely a so-called laser pointer, serving as a "pointing implement", is also accommodated alongside the lamp. The switch 146 then, of course, has three positions: out, lamp on, laser pointer on. Battery exchange is made possible by the flap 152.

Removable Utensils (FIGS. 3, 10)

A ruler, which is usually provided with a scale in millimetres and/or inches and may then be referred to as a measuring rule, can also normally be found in an office. In keeping with its nature, such a measuring rule should not be connected fixedly or movably to the handheld implement. In the exemplary embodiment, it is provided that the measuring rule 160 can be removed from a chamber 162. This measuring rule is advantageously also provided as a hole-puncher template:

The lower shell has a flat groove or rectilinear guide 164 formed above the die, and the measuring rule has an L-shaped cross-section with a longer leg 166 (which is also provided with the graduated scale 168) and a shorter leg 170. The longer leg is dimensioned to be complementary to the rectilinear guide 164 and can be displaced therein. The measuring rule has stop noses 172 at both ends. Moreover, in the shorter leg 170, it has a triangular notch 171 in the centre between the two stops 172. Finally, two further dies 174, matching the punch, are made in the measuring rule. When the measuring rule rests against the lower shell 22 by means of either of the stop noses 172, the die 174 which is nearest in each case is congruent with the die 70 in the lower shell. The distance between the two dies 174 corresponds to the standard which is customary in the country in question.

The border of a sheet 176 which is to be punched is, then, brought to rest against the shorter leg 170, the centre of said border being in alignment with the triangular notch 171. The first punching operation takes place with the first stop nose resting against the lower shell; then the sheet 176 and measuring rule 170 are grouped together and displaced along the rectilinear guide until the other stop nose rests against the lower shell, and the second punching operation is carried out. Therefore, although only one punch is provided, a double punching operation with a predetermined distance between the holes may nevertheless be carried out using the handheld implement.

Alternative Hole-Punching Mechanism (FIG. 11)

Manipulation of the hole-puncher mechanism which has been described up until now is not quite optimum because the two shells project over the paper which is to be punched and therefore cannot be gripped to the full extent. The configuration according to FIG. 11, in which the sheet which is to be punched is pushed in from the other side, is therefore preferred. It goes without saying that the configuration of the bearing block has to be adapted correspondingly and the push-in slot 180 has to be provided by a step on the upper and/or lower shell. In this case, of course, the template 160 has to be introduced in a mirror-inverted manner, as is indicated in FIG. 11.

Alternative Accommodation for Utensils (FIGS. 12 and 13)

In the embodiments which have been described up until now, the utensils, knife, scissors, staple remover and cutter, are all accommodated in the upper shell 20. This shortens the possible push-out path on account of the sliding buttons running against one another and causes unnecessary widening of the upper shell, because it is possible to accommodate in each case two of these four utensils in the upper shell and to accommodate the other two in the lower shell, as illustrated in FIGS. 12 and 13. In this case, the corresponding sliding buttons 190 run past one another. Whereas in FIGS. 1 to 11 the upper shell is considerably higher than the lower shell, the two shells are approximately of the same height in the embodiment according to the FIGS. 12 and 13.

In this variant, the mount 122 of the magnifying glass is provided with a hinge 121, with the result that the magnifying glass can be angled in order to inspect an article illuminated by the lamp 140.

Alternative Utensil (FIGS. 14, 15)

It goes without saying that the selection of utensils accommodated in the-hand-held implement was made quite arbitrarily and depends largely on the intended use. Therefore, an adhesive-tape dispenser, for example, may be accommodated in place of the roll-up measuring tape, as is illustrated in FIGS. 14 and 15.

Integrally formed on the lower shell is a hub 200 on which a roll of adhesive tape 202 may be positioned after a resilient or lockable flap 201 has been opened. An outlet slot 204 permits the through-passage of the adhesive tape. The slot 204 is delimited at the top by the free border of a flap 208 with a toothing arrangement 206, on which the adhesive tape can be torn off. The remaining strip end then comes to rest on the bead 210. If the flap 208 is drawn outwards, it is possible to grip said strip end; when the flap is closed, the adhesive tape forms a loop, and the tendency of the latter to stick to the inside of the flap can be minimized by said flap being coated with Teflon or the like.

The following figures show a preferred embodiment with a number of variants.

The implement has an upper shell 300 and a lower shell 302, but these references are selected only in order to distinguish between the two shells, since they do not assume any particular spatial position for use. The two shells are located opposite one another in an essentially mirror-symmetrical manner and each have rounded contours which are symmetrical with respect to a longitudinal plane and to a transverse plane. The outer side of one of the shells may be flattened to some extent in order to prevent the implement from wobbling when it is set down on a table.

The two shells are separated by a peripheral slot, it being possible for the shells to be moved away from one another at an end V referred to as the "front" in order to bring the stapling mechanism into the operating position, while the push-in slot E for the hole puncher is at the end H referred to as the "rear". At this end, the upper shell is provided with a bevel A in order that the paper which is to be punched can also be pushed in when the implement is open. On the end sides (front and rear), the outer contour of the shells tapers to a very pronounced extent. The side surfaces S are set back and essentially planar. The contour of the two shells is such that punching and stapling can readily be carried out with one hand and without having to set the implement down on a base, while, in the locked state, the shells can readily be held in the hand as a handle for a tool. The implement comprises a series of utensils illustrated in FIGS. 16 and 17 as well as further utensils which will be clarified in the description in due course. A stapling device and a punching device are provided in the interior of the implement which is illustrated in the closed state in FIGS. 16 and 17. The following are also provided: a knife 304, a cutter blade 306, a pointer 308, a magnifying glass 310, a staple remover 312, a pair of scissors 314, and a tape measure 316. Instead of the pointer, it is also possible for a so-called laser pointer to be provided. The knife, cutter blade, scissors and staple remover are displaced outwards from the interior of the implement, and also drawn back again by means of slide-action locking bars 318.

The basic construction of the implement can be seen from FIGS. 18 to 20. A metallic "skeleton" with an upper part 320 and a lower part 322 forms the receiving means for, and/or parts of, the stapler and hole puncher and delimits spaces for receiving the other utensils. The upper part and lower part are each provided with a plastic cap which is fastened at appropriate locations.

Three operating elements are located in the upper cap 324: a main button 326 for locking and unlocking the upper and lower parts, a stapler-activating button 328, and a magazine-unlocking button 330.

In the lower cap 332, it is possible to see a magnifying-glass release button 334, two microswitch buttons 336, 338, a disengaging button 340, a flap 342 which gives access to a battery compartment, a light guide 344, and a flap 346 which permits emptying of the chamber 348 into which the punchings produced by the hole puncher pass. The tape measure 316 is provided with the conventional restoring mechanism (not shown) and with a braking lever 350 which can be displaced manually into a relief position counter to the prestressing of the spring 351. As can be seen in FIG. 19, the channel 352 which receives the knife 304 extends virtually over the entire longitudinal extent of the implement, while the channel 354 for the cutter blade 306 is only virtually half as long; this provides space for the diameter of the tape measure 316, which in this way can achieve a draw-out length of, for example, 100 cm. The two button batteries 356 and a lamp 358 can also be seen in FIG. 19, while the laser pointer 360 is located behind the microswitches 336, 338.

Referring now to FIGS. 21 to 24, the stapler will be described first of all. The stapler is a so-called flat-clinch stapler, that is to say a stapler in which first of all the staple is driven into the paper which is to be stapled, and the free staple ends are only folded over when the staple driver has reached its end position. FIG. 21 shows the implement in the closed and locked state. The main spring 362 prestresses the upper part and lower part in the opening direction. FIG. 22 shows the open implement, in the case of which, however, the staple magazine is not yet in the operating position. In FIG. 23, the staple magazine is released, and in FIG. 24 the staple carrier is pushed out.

The stapling procedure will be explained taking FIG. 23 as departure point.

The stapler is rendered operational by pressure being exerted on the button 328. The button is articulated at 364 and is prestressed into its rest position by the leg spring 366, in which rest position it engages, by means of two hooks 368, over two pins 430 (illustrated in FIG. 25) which are provided laterally on the outer channel 370 in which the staple carrier 408 is guided. When the button is actuated, the outer channel is released and passes, under the action of the leaf spring 372, into the position according to FIG. 23, where it strikes, by way of noses 374, against the end of slots made in the staple driver 376. The staple driver or the knife 376 is formed in one piece with the leaf spring 372.

It should be noted that, in the position according to FIGS. 22 and 23, the outer channel 370 rests against a stop 380 by means of one end 378. Accordingly, when the button 328 is actuated, the upper part 320 moves upwards instead of the outer channel moving downwards; however, since the implement is generally not supported, but is held freely in the hand, the jolt produced by the fairly powerful leaf spring 372 is damped partly by the main spring 362 and partly by the hand itself. A separate damper is optional. A double transmission lever 384 for the flat-clinch mechanism can be pivoted around a bearing 386 and is prestressed by a spring such that its longer ends 387 always rest against the upper part 320.

In the lower part 322, the anvil 388 is supported on a web 389 and anchored thereon. Its operation surface is located essentially flush with the upper side of the lower part. In the position illustrated in FIG. 23, the anvil 388 is fully enclosed around the periphery by a plastic platform 390 which can be pivoted around an articulation 392 provided on the lower part and is pushed against a stop (not shown) by a compression spring 394. In this arrangement, the platform is supported on a blocking angle 396 which, for its part, can slide parallel to the upper side of the lower part and is held in position against the anvil 388 by a compression spring 398. The upper side of that section of the platform 390 which encloses the anvil is higher than the operating surface of the anvil by the length of the staple legs.

If a stapling operation is to take place, the paper which is to be stapled is introduced into the gap between the lower and upper parts and the implement is closed. The stapling head comes to be positioned on the paper supported on the platform, with the result that, as the closure movement continues, it is pushed back into the upper part counter to the force of the leaf spring 372. In this process, the staple driver forces a staple out of the staple carrier and into the paper. Consequently, the transmission lever 384 is pivoted; its pivot position is thus representative of the angle between the outer channel and upper part. When the lever has reached a position corresponding to the staple having been pushed out by the staple driver to the full extent, it has displaced the upright legs 400 of the blocking angle, counter to the force of its prestressing spring 398, to such an extent that support is withdrawn from the platform 390; the latter is pushed down abruptly by the upper part, and the free legs of the staple which project beyond the paper which has been introduced are folded over in the process. In this case, the outer channel automatically hooks into the hooks 368 of the button 328 again. For each stapling operation, this button thus has to be reactivated. It goes without saying that this is not absolutely necessary: a latch-in recess, for example, could be provided for the button in order to hold the latter in the released state for a number of stapling operations.

Mounted in the outer channel is a slide rod 402 on which there is seated a thrust spring 404 which, via the slide 406, pushes the staples contained in the staple carrier 408 forwards. If a locking means, which will be explained in detail below is released, the spring 404 pushes the staple carrier 408 outwards out of the outer channel 370 to such an extent that it can be drawn out and loaded with a new staple block; this position is represented in FIG. 24.

The outer channel, staple carrier, slide rod, slides and staple block together form the staple magazine.

FIGS. 23*a* to 23*c* show, on a further-enlarged scale, the kinematics of the unlocking operation for the staple magazine.

FIGS. 24*a* to 24*c* show the interaction of the unlocking button 330 for the staple carrier with the fork-shaped extensions of the latter; fitted on the button 330, which can be pivoted around the articulation 331, are small bolts 333 which, in the event of pressure being exerted on the button, are lifted out of the hooks 434 of the staple carrier and consequently release the latter. When the staple carrier is pushed in again, the hooks automatically latch in again. The button 330 is prestressed into its rest and latch-in position by the spring 335.

The above described deactivation of the stapling mechanism serves primarily to avoid the situation where a staple is lost during every other actuation of the upper and lower shells, for example during hole punching or actuation of the scissors. The selected design in which the outer channel is set back in the upper part is advantageous insofar as the stiff stapler spring 372 is also deactivated thereby, which spring would otherwise counteract the actuation of the hole puncher or of the scissors. Furthermore, the implement is compact in the closed state. However, there are, of course, other possibilities for deactivating the stapler: displacing the staple driver such that it no longer comes into contact with the staple located in the magazine, blocking the magazine advancement, blocking the relative movement between the upper part and staple magazine, setting back the upper part and magazine into the upper shell to such an extent that the driver no longer reaches the anvil, and, finally, displacing the anvil such that, in the closed position, the tip of the staple remains free.

The functioning of the hole puncher will now be explained with reference to FIGS. 21–24. Conventional hole punchers for use in the office are provided with two or more punchers, which are set to a specific spacing of the filing mechanism, while the implement according to the invention has only one punch. Since the implement is conceived, in particular, for use outside of the actual office, the hole-puncher function will be used whenever there is a file to hand in which the relevant paper is to be filed. The user, then, takes the paper which is to be filed and rests it on the filing mechanism and marks, e.g. with a pencil, the locations where holes are necessary, to be precise directly on the border of the sheet. An arrow or the like could be provided on the outside of the implement in order to mark the centre of the punch. However, due to the relatively large distance of the punch from the outer contour of the implement where such a marking would be provided, this results in inaccuracies. It is therefore provided that the sheet (or sheets) which is to be punched is introduced into the slot 410 with the marking downwards, the light guide 344 making it possible to see the marking from the outside; the light guide is provided with an arrow or the like which is in alignment with the punch axis. It goes without saying that the light guide need not necessarily be guided to the punch platform from below since, in a variant, it could also project onto the paper from above (here, the terms "above" and "below", as has already been explained, relate only to the graphic illustration and not to the use position of the implement). In principle, the light guide 344 could also be replaced simply by a hole, through which one could see the paper which has been pushed in. However, it is preferred to design the light guide from transparent plastic, its cross-section preferably becoming larger towards the outside. To protect against scratching, its two ends are set back slightly. Lenticular curves which have an enlarging action could be integrally formed at one or both ends. The light guide is preferably rectangular in cross-section.

The punch 412 is guided rectilinearly in a hole-containing bracket 414 and a bore or a punched hole 416 of a block 418, which will be described in detail at a later point in the text. Force transmission to the punch 412 takes place by a stamped tongue 420 of the upper part, while said punch is carried back upwards by the outer channel; for this purpose, the punch is provided with a snap ring 422 introduced into a groove of the punch. This design saves space in comparison with the conventional design, in the case of which the punch is provided with a restoring spring.

FIG. 25 shows an exploded view of the "skeleton" of the implement. The upper cap 324 and lower cap 332 are plastic parts, preferably injection moulded from impact-resistant plastic, while the rest of the parts of the skeleton are each manufactured as parts which have been formed by punching and bending, preferably using metal or chromium steel. The upper part 320 is bent at right angles three times on either side, this producing a central section and, adjoining this laterally, pairs of respectively parallel flanks 424/425, 427/429, which form the guide channels for the displaceable tools (scissors and staple remover). The central, planar section is provided with recesses and deformations, the purpose of which will be explained at a later point in the text.

The inner bent flanks 424 and 427 are extended to the rear ("rear" is the hole-puncher end) and are provided with aligned bearing bores. The outer channel 370 has an upside-down U-shaped cross-section and is provided with an angled tongue 426 on which the slide rod 402 is fastened; inwardly projecting lugs 401 for supporting the staple carrier are located at the front end. An aperture 428 permits the through-passage of the punch with its spring ring 422, which is pushed on above the aperture after the introduction of the punch with the result that it can pass into operative connection with the tongue 420, integrally formed on the upper part, in order for the punch to be actuated. The pins 430 interact with the stapler-release button 328. The rearward extension of the two U-legs is provided with bearing bores 432.

The staple carrier 408 is U-shaped in cross-section, and its U-legs are extended to the rear and provided with hooks 434 which interact with the bolt 333 of the button 330, as has been explained above.

The block 418 is a further part which has been formed by punching and bending. It supports the bearing journal 436 around which the outer channel and the upper part can be pivoted. The bearing journal 436 is arranged in projecting side walls 440, beneath which there is a free space-for the introduction of paper which is to be punched. The vertical edges at the end of this free space form the stop 458 against which the paper can be positioned. The side walls are connected by a transverse metal plate 442, provided with the lower punch guide and arranged above the paper slot. The bracket 414 is fastened, e.g. spot welded, on the transverse metal plate. The block has a foot part 444 by means of which it is centred in the lower part, on which it is fastened, moreover, by means of spot welding or continuous joining. The configuration of the upper borders of the block will be described below in conjunction with the locking mechanism.

The lower part 322 comprises two metal sheets which are angled in an upside-down U-shaped manner and of which the upper sheet-metal angle 446 has the die 448 for the hole punching, a recess 450 for the through-passage of the light guide 344 and the introduction of the block foot 444 and a through-passage opening for the spring 362, as well as an aperture 452 into which the platform 390 can be displaced. The configuration of the angled legs 453, 455 will be explained at a later point in the text in conjunction with the displaceable utensils.

The lower sheet-metal angle 454 is connected to the upper one, for example, by spot welding. It has an aperture 456 for the through-passage of the punchings of the hole puncher and the reception of the light guide, a set-back hollow 438 for supporting the main spring 362, mounting holes 460 for the block foot, and an aperture 462 which corresponds to the aperture 452. The main spring 362 is supported in the set-back hollow 438 (FIG. 22), and the other end of said spring is supported on the outer channel, between the punch and the tongue 426; the spring is so short in comparison with its diameter that there is no need for any special measures against buckling of the spring. The two openings 464 in the upper sheet-metal angle and 466 in the lower sheet-metal angle permit the through-passage of the vertically bent part 400 of the blocking angle 396. The anvil 388, which consists of hardened steel, is pressed into an insert 468, which, for its part, is connected to the lower sheet-metal angle 454 by compression or some other means. The lower sheet-metal angle is narrower than the upper one, with the result that a guide channel for receiving further displaceable tools (knife, cutter) is delimited in each case between the angled legs 457, 459 of the inner sheet-metal angle and 453, 455 of the outer sheet-metal angle. The lower sheet-metal angle has, in the angled leg 459, a cut-out 470 which releases the lateral space necessary for the tape measure.

It can be gathered from the above description that the upper part has a channel delimited by the angled flanks on either side of the space necessary for the stapling mechanism, and that the lower part also has delimited channels on both sides of the pairs of legs.

It can be seen that, both in the upper shell and in the lower shell, the exposed, visible, outer side surfaces of the metal parts form angled sections which delimit the inner channels for the utensils and protect the latter towards the outside. Consequently, at the same time, the stability of the implement can be increased and minimization of the width of the components can be achieved.

It will now be described, with references to FIGS. 26 to 30, how the two shells in this exemplary embodiment are locked and unlocked with respect to one another. When the implement is closed—FIG. 28—the button 326, which, for unlocking purposes, is first of all pushed in counter to the force of a spring tongue 472 and is then displaced to the rear, that is to say in the direction of the hole puncher, projects to a very slight extent out of the upper shell. The tongue 472 is integrally formed on a leaf spring 474 which is arranged on the upper side of the upper part 320 and is held, and guided, there by tabs 475 which engage over it. Projections 476 on the upper edges of the block 418 engage, in the locked state (FIGS. 28 and 30), over lateral lugs 465 of the leaf spring 474, which are released from the projections when the button is displaced in the opening direction. When the leaf spring is displaced, lugs 478, which are integrally formed thereon and are provided at their ends with a downwardly directed nose, run over tines 463 (marked in FIG. 25) which are integrally formed on the upper part, with the result that the leaf spring can only assume two stable positions: locking end position or unlocking end position. A tongue 480 is cut out at the end which is directed away from the button 326, said tongue being angled downwards and, in the unlocking end position, latching into a recess 479 of the upper part 320. Thus, as soon as the implement is opened, the leaf spring 474 cannot be displaced into the locking end position again. It is only when the two shells have been brought into the closed position shown in FIG. 27 that the protrusions 482, integrally formed on the block, lift the tongue 480 to such an extent that it is released from the recess 479 and the implement can be locked by the button being displaced back; the second recess for the second protrusion 428 balances the lifting of the tongue 480. The solution presented here is preferred on account of its simplicity. Alternatively, the blocking means could also be dispensed with and be replaced by an automatic locking means on the block, said locking means taking effect as soon as the button 326—even in the case of the implement being opened—is displaced into the closed position. In this case, however, it would be necessary to block the stapler-release button 328, on the one hand, and the main button or locking button 326, on the other hand, with respect to one another: if the implement is locked when the stapling mechanism is in the released state, a loose deformed staple remains in the space above the anvil and, if stapling material is still located between the upper and lower shells, then, when the implement locks automatically, said upper and lower shells could be spread apart to such a pronounced extent that it is no longer possible to open the implement. It should also be noted that although, when the implement is closed, it is possible to push the buttons 328 and 330, the staple magazine and the staple carrier latch in again when the buttons are released, and so the design illustrated in FIG. 26 remains intact when the implement is opened.

According to FIG. 24, the release button 328 for the stapling mechanism is articulated at the top. However, the alternative design illustrated in FIGS. 31 to 33 is preferred. There, the button moves "rearwards" rather than "downwards". The button 328 here has a stop surface 484 by means of which it rests against an abutment surface of the link 486, which is prestressed into the closed position by a U-shaped leaf spring 488. The link 486 is articulated at 490 and engages beneath the pins 430 of the outer channel by means of hooks 492. As before, the link locks automatically in the case of each stapling operation.

In the lateral guide channels formed by the flanks 424/425 and 427/429 in the upper part 320 and by the legs 455/457 and 453/459 in the lower part 322, the knife, cutter, staple remover and scissors are guided in a longitudinally displaceable manner via corresponding guide shanks 493, 494, 495 and 496, respectively, which are integrally formed on said utensils or injection-moulded around them and consist of metal or plastic or plastic-encapsulated metal. Since the guides are shortened to a pronounced extent in the corner regions by the heavily rounded outer contours of the implement, but the highest possible stability of the tool guides is necessary, in particular, in the pushed-out use positions, the utensils are additionally guided via sliding blocks 497, which slide in guide slots 498.

The sheet-metal sections on either side of the slots are bridged, at locations where stability requires it, by connections 499 which are pressed out inwards, but do not obstruct the guide function for the sliding blocks. As will further be explained at a later point in the text, the sliding block of the scissors has a rear-engagement means 524 and, for this reason, the scissors cannot, like the three other utensils, be pushed into the relevant channel; rather, the rear-engagement means 524 is introduced through the branch channel 433 which can be seen in FIG. 25.

Provided in the guide shanks 493 to 496 of the utensils are recesses ~503 in which there is arranged a slide-action locking-bar mechanism for displacing and arresting the utensils.

The slide-action locking bars 318 may be connected to the slide-action locking-bar mechanism via direct connecting webs 500, which renders necessary corresponding longitudinal slots 505 in the outer channel boundaries 425, 429, 453 and 455, on which the catches 507 for the utensils may also be arranged. Alternatively, it is also possible for such slots to be provided in the base surfaces 511 of the upper and lower shells and—as is shown in FIGS. 38/39—for the connecting webs to the slide-action locking bars to be routed around the outer channel boundaries, e.g. 453, in the form of a U in the region of the separating joint between the upper part and lower-part.

The intention is for each utensil to be blocked both in the inner and in the outer end positions; for unblocking, the user displaces the respective slide-action locking bar in a direction perpendicular to the extent of the slot, either upwards or "downwards" (corresponding catches can be seen in FIG. 25) or inwards. In the case of the first-mentioned design, the implement may be of a somewhat thinner construction, but, for all that, the slide-action locking bars are less easy to operate. For the simplest possible operation, a design in which disengagement takes place by the slide-action locking bars being pushed inwards is thus preferred. In order that the side-action locking bars are not pushed in inadvertently, they are located approximately flush with the outer contour of the shell in the relevant region.

An example of the last-mentioned design is represented in FIGS. 34 to 37: the button 318 is seated on a pivotable lever 500 on which there is integrally formed a leaf spring 502 which bears a locking-bar block 504. The block 504 is released from the catch 506 by the button being pressed downwards on one side. The leaf spring ensures that the block latches in automatically in the end positions. The plastic button 318 is integrally formed, e.g. injection-moulded, on the metallic lever, and the assembly is designed such that it can be mounted through the slot 505 from the outside. In the case of the design illustrated in FIGS. 38 and 39, the button 318 is seated on a detent 508 which latches in under prestressing by a leaf spring 510 (FIG. 38) and is lifted out of this latch-in position into the released position (FIG. 39). As can be seen, the side walls here, e.g. 453, do not have any slots; rather, the connection between the button and utensil is routed around the free edge on the outside. In addition to these arresting means for the individual utensils, an additional safety locking means could be provided, in particular for those utensils which could cause injury if pushed out unintentionally, and this additional safety locking means blocks such utensils individually or in groups. FIGS. 18 and 40 give a schematic illustration of such an additional safety locking means in the form of a rocker 512 which is mounted in the lower part, is fork-shaped and engages, by means of its arms 513, into the guide channels for the knife and the cutter, with result that these utensils are blocked in their inner end is position. The utensils are unblocked by pressure being exerted on the button 340, and can be pushed out by means of their side-action locking bars.

Before different variants of pairs of scissors are explained, some remarks which apply to all variants may be of use. It is in no way immaterial as to which channel should contain the-scissors. The scissors are to be designed and positioned such that, rather than running onto the shells or even running into the slot of the hole puncher, the cut material is guided past the shells. This is initiated by specially designed directing flanks which are provided on the scissor blades and are adapted to the form of the implement. However, the cut material, in particular paper, hangs down after cutting, and the selected arrangement of the scissors in the upper shell ensures that the path over the upper shell over which the cut material has to run over a relatively large width gives a small height difference, and the paper therefore does not abut laterally in the region of the channel with the stapler remover either. Conversely, for running over the lower shell, although there is a large height difference to be overcome, the width against which the lower section of paper could butt is small. It goes without saying that the arrangement of the scissors and the design of the directing surfaces on the scissor blades have to be adapted in each case in accordance with the orientation thereof.

FIGS. 41 to 45 show a first, preferred variant of the scissors, FIGS. 44 and 45 respectively being sections along the lines A—A and B—B of FIG. 42. The scissors have a guided blade 520 and a slave blade 522 which is articulated on said guided blade at 521. The blade 520 is not just guided, like the other utensils, via a straightforward guide block, but via one with a rear-engagement means, because the blade 520 cannot be supported on the outer wall of the guide channel. This rear-engagement block 524 can be seen in FIG. 44. Since there has to be a connection to the relevant slide-action locking bar from that side of the blade 520 which is directed away from the rear-engagement means, the blade 522 is correspondingly short. In the pushed-out position, it anchors automatically on the lower shell, for example, as is illustrated, by means of a spring-prestressed hook 526 which, when the scissors are pushed in, is released from the lower shell and positioned in a corresponding recess 528 of the blade 520. An aperture 527 in the lower shell permits the through-passage of the hook 526; the opening 529 also serves for this purpose. A wire spring 523 prestresses the blade 522 into the open position. The scissors are actuated by the two shells being pushed together and released. In order to achieve the best possible deflection of the cut material, the scissors can be extended to such an extent that the scissors articulation is not congruent with the pin 436, with the result that there has to be a relative displacement between the blade 522 and the lower shell 302 during cutting.

In the case of the variant illustrated in FIGS. 46 to 48, the slave scissor blade 522 is virtually as long as the guided blade, but is designed to be so narrow that the connection to the slide-action locking bar of the scissors can still be guided past it. The wire spring 530 prestresses the two blades in the open direction and holds the blade 522 in position against the lower part. Here too, the slave blade 522 is obviously displaced along the lower shell during cutting.

A further variant of the scissors is represented in FIGS. 49 to 53. Here, the shearing movement is not produced by the shells being displaced; rather, the slave scissor blade 522 is actuated by the thumb, preferably with the implement in a closed state, while the fingers hold the body of the implement. The blade 522 is provided with a rotatable thumb rest 523, which, at the same time, holds the two blades locked together in the pushed-in position and pushed-out position. A wire spring 534 prestresses the two blades into the open position. The thumb rest 532 can be brought into, and out of, the operating position manually or else can swing out automatically when the outer end position is reached, while it is put back in position manually for the operation of pushing the scissors into the implement. A spring-prestressed blocking lever 536, provided on the guided blade 520, secures the scissors in the pushed-out position once the thumb rest has been swung up and consequently pivoted out of the continuation 538. When the thumb rest is swung down, it engages into the continuation 538, as result of which the blocking lever 536 is lifted and the locked scissor blades are consequently released in order to be pushed into the implement.

Figure 55:
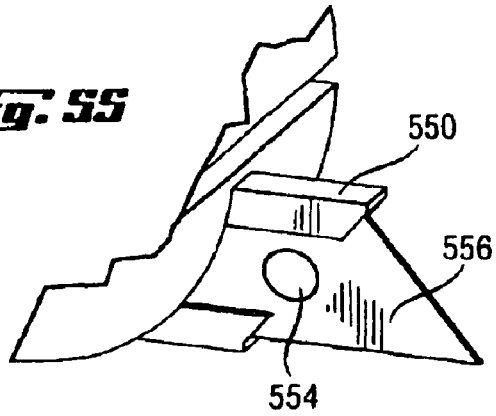
Figure 54:
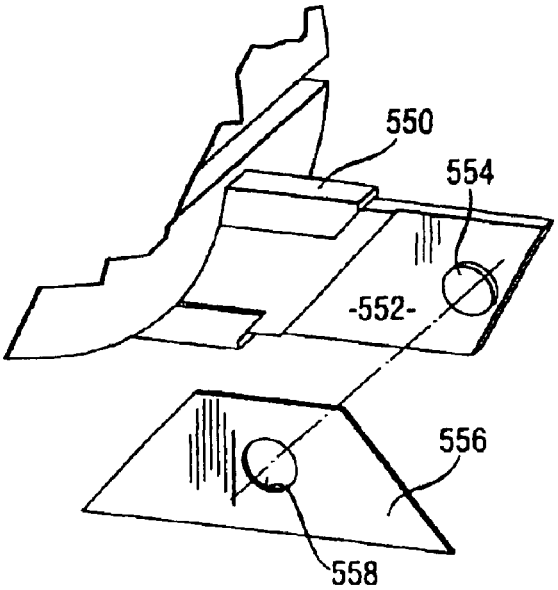

FIGS. 54–57 show details of the blade holder for the cutter blades. FIGS. 54 and 55 show a first embodiment. The blade holder 552, which is preferably manufactured from plastic, runs in a support 550 which is preferably manufactured from metal, has a C-shaped cross-section and, when the blade holder is pushed out, under the action of a compression spring, is also extended by a predetermined distance. The support here serves as a means for supporting the blade holder and for securing the double blade 556 which can be fitted, by means of its centring hole 558, onto the pin 554 when, for the purpose of exchange or rotation of the double blade, the blade holder 552 is pushed out beyond the latch-in position of the support 550 to such an extent that the double blade is freed and can be laterally removed and introduced. In this embodiment, three latch-in positions are provided for the slide-action locking bar: retracted position, cutting position, blade-exchange position.

Figure 57:
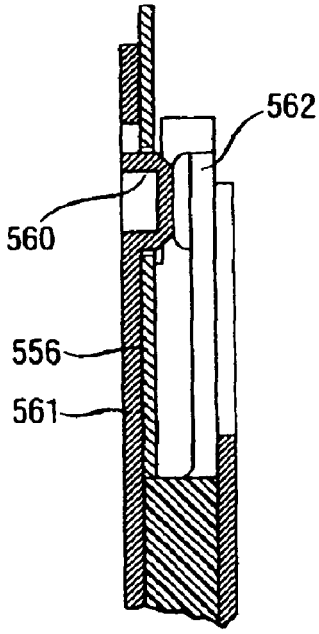
Figure 56:
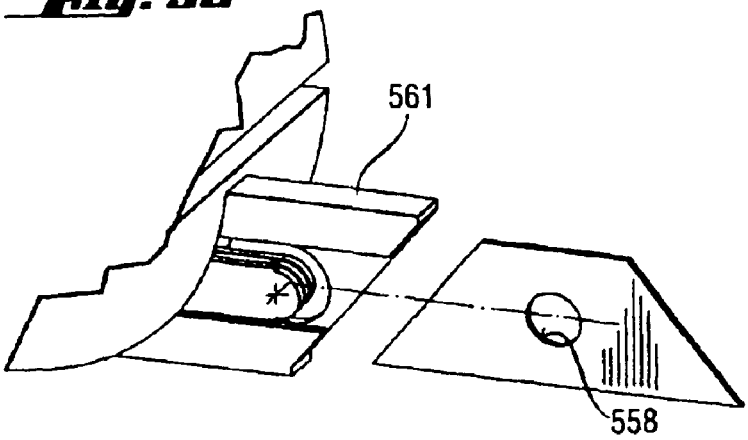
Figure 58:
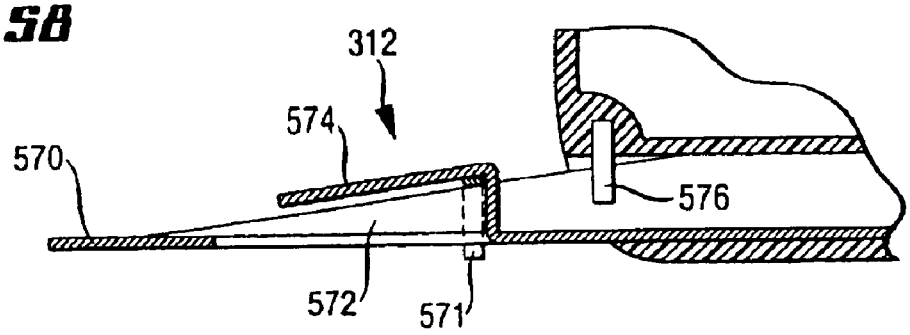
Figure 59:
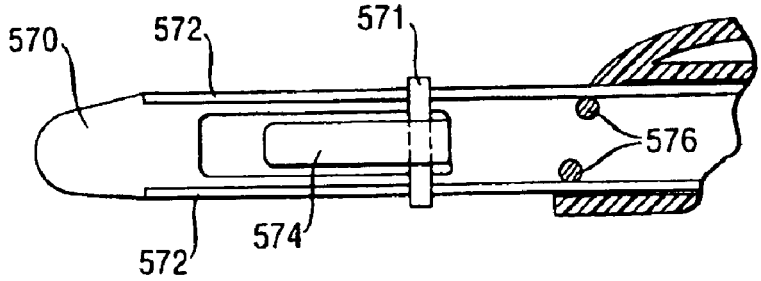
Figure 60:
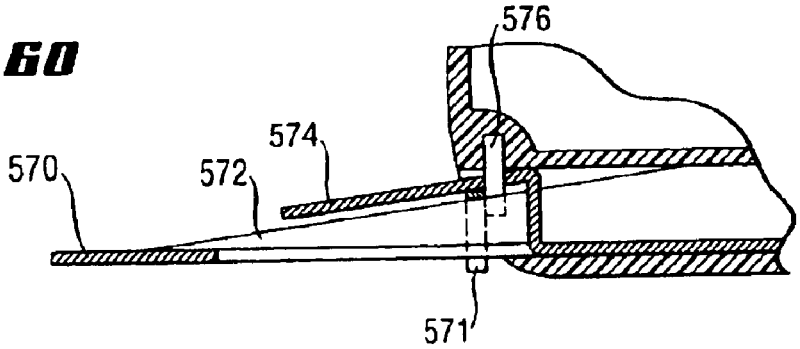
Figure 61:
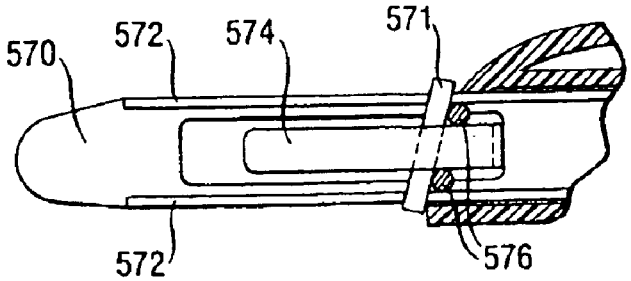

In the variant according to FIGS. 56 and 57, the blade exchange takes place from the front. In this case, the double blade 556 latches in automatically in the bevelled pin 560 when it is pushed into the blade holder 561. In order to draw out the blade, the pin 560 can be ejected from the centring hole 558 by means of the button 562 and the blade can be removed to the front.

FIGS. 58 to 61 show details of the staple remover 312. It comprises a push-in nose 570 which, on the closed side of a staple 571 which is to be removed, is pushed between said staple and the stapled bundle of paper. Progressively higher webs 572 which are integrally formed on at the sides force the staple legs out of the paper. An integrally formed tab 574 which has been bent out is positioned over the spine of the staple and prevents a situation where the staple has to be drawn out on one side and then laboriously removed by hand. In the opening region of the guide channel which receives the staple remover, two small pins 576 are fastened on either side of the tab 574, and these pins detach the staple from the staple remover when the latter is pushed back into the upper shell. On its outer side directed towards the outer channel boundary, the staple remover is preferably bevelled such that, in the case of the slight oblique positioning of the implement, said staple remover can be positioned flatly on the paper from which the staple is to be removed, as can be seen from FIG. 70.

FIG. 62 illustrates, in partial section, a variant in which a pointer 580 which comprises sleeves which can be drawn out telescopically is provided instead of the lamp and/or laser pointer. A release button 592, held in a state in which it is prestressed into its rest position by means of compression spring 590, engages behind the sleeves 594 and, upon actuation, pushes them outwards to such an extent that the knob 596 on the inner most sleeve can be gripped and drawn out. Alternatively, the pointer could also be arranged on a carriage which can be pushed out by means of a button, preferably counter to the force of a restoring spring, to such an extent that the knob 596 can be gripped.

FIGS. 63 to 65 show greater details of the construction in the region of the magnifying glass. Two lugs 600 are angled inwards from the legs 457 and 459, these lugs serving to guide the rear extension of the magnifying-glass frame 602. This extension is non-symmetrically fork-shaped with a wider leg 604, the underside of which has a recess of partially circular cross-section—the laser pointer 360 is located there—and with a narrower leg 606. The batteries 356 are located between the two legs; the spring which prestresses the magnifying glass into the open position acts on the wider leg, but, for better clarity, is not illustrated. The locking button 334 by means of which the magnifying glass is secured in the lower shell is arranged above the magnifying glass. A transparent insert 608 which permits the laser and/or lamp light to pass through is located beneath the magnifying glass.

FIGS. 66 to 69 show details of the chamber 348 for the punchings and of the access flap 346 for emptying the chamber. In contrast with hole punchers for use in the office, the volume of this chamber is relatively small, with the result that the user may well forget to empty the chamber at the correct time. In order to avoid overfilling, provision is made for the user to be given a signal when the chamber should be emptied.

FIG. 66 shows a cross-section of the closed chamber. Integrally formed on the lower cap 332 is a chamber housing 620 on which the flap 346 is articulated. The flap is, for its part, provided with upright walls which, together with the chamber housing, prevent punchings from being able to pass into the interior of the lower shell in an uncontrolled manner. The flap 346 has a double latch-in locking means. In its closed position, it latches in, by means of small protrusions 622, on the inwardly jutting borders 624 of the chamber housing. If the pressure loading within the chamber 348 becomes too high, this first locking means yields and the flap 346 opens into the position according to FIG. 67, in which position the flap, however, is locked again, namely by larger protrusions 626. The retaining force of the latter has to be overcome manually. The slightly opened position of the flap, in which no punchings have yet been released, signals to the user that the chamber should be emptied as soon as possible. FIGS. 68 and 69 respectively show a cross-section and longitudinal-section of this emptying position of the flap 346.

It goes without saying that a snap-in or displaceable cover could also be provided instead of a swing-out closure, but in this case the advantageous signalling action would no longer be provided.

Finally, FIG. 70 shows a further variant, in which the upper shell is designed as a lever which engages between flanks of the lower shell and, in the locked state, is flush with the contours thereof. Front and rear slots permit the introduction of paper which is to be stapled or to be punched.

It goes without saying that, again, the stapling parts and hole-puncher parts, as are illustrated in FIGS. 21–24, are accommodated in the lever 700. The utensils, e.g. scissors 706, staple remover 708, etc., are located in the upright sides 702, 704.

What is claimed is:

1. A multipurpose handheld implement comprising:

a first member and a second member, the first and second members being connected together to move between a first position, in which they form an elongated body, and a second position;

wherein the first member comprises a staple magazine and a staple driver and the second member comprises a staple anvil of a stapler;

the members when in the second position forming an interspace to receive a workpiece for processing by the stapler as the first and second members are moved relative to one another;

wherein inactivating means are provided by which the stapler is inactivatable so that the members can be moved into the first position without ejecting a staple; and wherein at least one of the members comprises at least one additional tool movable between respective storing and working positions, the first and second members when in the first position forming a grip for handling the at least one additional tool in its working position.

2. The implement of claim 1, wherein locking means for releasably holding the first and second members in the first position are provided.

3. The implement of claim 2, wherein the locking means comprise a latch manually operable by an actuator on an outside of the implement.

4. The implement of claim 1, wherein the inactivating means automatically inactivates the stapler after each stapling operation.

5. The implement of claim 1, wherein activating means for activating the stapler after inactivation are provided.

6. The implement of claim 5, wherein the activating means are manually operable by an actuator on an outside of the implement.

7. The implement of claim 1, wherein locking means for releasably holding the first and second members in the first position are provided, wherein the locking means comprise a latch manually operable by a first actuator on an outside of the implement, wherein the inactivating means automatically inactivates the stapler after each stapling operation, wherein activating means for activating the stapler after inactivation are provided, wherein the activating means are manually operable by a second actuator on an outside of the implement, and wherein the first and second actuators are arranged on the first member.

8. The implement of claim 7, wherein the first actuator is a slider switch arranged on a top surface of the first member and the second actuator is a push button arranged on an end surface of the first member, adjacent to the staple driver.

9. The implement of claim 1, wherein the inactivating means is manually operable.

10. The implement of claim 1, wherein the inactivating means interrupts an operative connection between the staple driver and a staple bar within the staple magazine.

11. The implement of claim 10, wherein the staple driver is displaceable between an active and an inactive position.

12. The implement of claim 11, wherein the staple driver is spring-biased in one of the active and inactive positions.

13. The implement of claim 11, wherein the staple driver is displaceable at least into one of the active and inactive positions by an actuator.

14. The implement of claim 10, wherein the inactivating means comprises a displaceable staple stop by which staples are removable from an area where the staple driver moves into the staple magazine.

15. The implement of claim 1, wherein the staple magazine is biased by a spring towards the anvil, wherein the staple magazine is lockable against the bias of the spring and manually releasable, and wherein the stapler is inactivated when the staple magazine is locked.

16. The implement of claim 15, wherein the staple magazine locks itself automatically after each stapling operation in an inactivated position.

17. The implement of claim 15, wherein the staple magazine comprises lateral projections which are engageable by locking hooks provided in the first member.

18. The implement of claim 15, wherein the staple driver is positioned above a staple bar in the staple magazine when the stapler is activated.

19. The implement of claim 15, wherein the staple driver is positioned between a front end of the staple magazine and a staple bar when the stapler is inactivated.

20. The implement of claim 15, wherein the staple magazine is lockable in the first member by a locking mechanism comprising a lever having locking hooks for the staple magazine, the lever being supported by the first member and spring-biased into a locking position.

21. The implement of claim 20, wherein the locking hooks embrace the staple magazine in fork fashion and are moveable into a locking engagement with the staple magazine.

22. The implement of claim 20, wherein the lever is pivotable into a releasing position via an actuator.

* * * * *